US011252511B2

(12) United States Patent
Lo et al.

(10) Patent No.: US 11,252,511 B2
(45) **Date of Patent: *Feb. 15, 2022**

(54) PACKAGE STRUCTURE AND METHODS OF MANUFACTURING SOUND PRODUCING CHIP, FORMING PACKAGE STRUCTURE AND FORMING SOUND PRODUCING APPARATUS

(71) Applicant: xMEMS Labs, Inc., Santa Clara, CA (US)

(72) Inventors: Chiung C. Lo, San Jose, CA (US); David Hong, Los Altos, CA (US); Jemm Yue Liang, Sunnyvale, CA (US); Lei Chen, Hayward, CA (US); Hai-Hung Wen, Hsinchu County (TW); JengYaw Jiang, Saratoga, CA (US); Martin George Lim, Hillsborough, CA (US); Wen-Chien Chen, New Taipei (TW); Hsien-Ken Liao, Taichung (TW); Chun-I Chang, Hsinchu County (TW)

(73) Assignee: xMEMS Labs, Inc., Santa Clara, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/334,831

(22) Filed: May 31, 2021

(65) Prior Publication Data

US 2021/0297787 A1 Sep. 23, 2021

Related U.S. Application Data

(63) Continuation-in-part of application No. 17/008,580, filed on Aug. 31, 2020, and a continuation-in-part of (Continued)

(51) Int. Cl.
*H04R 17/00* (2006.01)
*H04R 3/00* (2006.01)

(Continued)

(52) U.S. Cl.
CPC ..... *H04R 17/00* (2013.01); *H04R 1/025* (2013.01); *H04R 3/00* (2013.01); *H04R 7/04* (2013.01);

(Continued)

(58) Field of Classification Search
CPC ..... H04R 17/00; H04R 31/006; H04R 1/025; H04R 3/00; H04R 7/04; H04R 7/18; H04R 2201/003
See application file for complete search history.

(56) References Cited

U.S. PATENT DOCUMENTS 6,590,992 B1 7/2003 Nakamura
7,146,016 B2 * 12/2006 Pedersen ..... B81B 3/0072 381/175

(Continued)

FOREIGN PATENT DOCUMENTS

DE 10 2011 004 570 A1 8/2012
DE 10 2017 223 869 A1 7/2019

(Continued)

OTHER PUBLICATIONS

Wikipedia, Microelectromechanical Systems, Dec. 2017, https://en.wikipedia.org/wiki/Microelectromechanical_systems.

*Primary Examiner* — Oyesola C Ojo
(74) *Attorney, Agent, or Firm* — Winston Hsu

(57) ABSTRACT

A package structure includes a housing and a sound producing chip. The sound producing chip is disposed within the housing. The sound producing chip includes a membrane and an actuator. The membrane includes a coupling plate and a spring structure connected to the coupling plate. The (Continued)

actuator is configured to receive a driving signal to actuate the membrane. The spring structure is situated between the coupling plate and the actuator. The coupling plate is actuated to move by the actuator via the spring structure.

27 Claims, 36 Drawing Sheets

Related U.S. Application Data application No. 16/920,384, filed on Jul. 2, 2020, now Pat. No. 11,057,716.

(60) Provisional application No. 63/051,909, filed on Jul. 15, 2020, provisional application No. 63/012,089, filed on Apr. 18, 2020, provisional application No. 62/954,237, filed on Dec. 27, 2019.

(51) Int. Cl.
*H04R 31/00* (2006.01)
*H04R 7/18* (2006.01)
*H04R 7/04* (2006.01)
*H04R 1/02* (2006.01)

(52) U.S. Cl.
CPC ..... *H04R 7/18* (2013.01); *H04R 31/006* (2013.01); *H04R 2201/003* (2013.01)

(56) References Cited

U.S. PATENT DOCUMENTS

| | | | | |
|---|---|---|---|---|
| 7,763,488 | B2 | 7/2010 | Goodelle | |
| 7,790,492 | B1 | 9/2010 | Baumhauer | |
| 8,336,191 | B1 | 12/2012 | Byers | |
| 8,824,707 | B2 | 9/2014 | Bachman | |
| 9,516,421 | B1 * | 12/2016 | Loeppert | H04R 17/02 |
| 10,284,960 | B2 * | 5/2019 | Grosh | H04R 7/06 |
| 10,390,145 | B1 | 8/2019 | Hsieh | |
| 2002/0067663 | A1 | 6/2002 | Loeppert | |
| 2007/0147650 | A1 | 6/2007 | Lee | |
| 2007/0278601 | A1 | 12/2007 | Goodelle | |
| 2008/0168887 | A1 | 7/2008 | Takegawa | |
| 2009/0034773 | A1 | 2/2009 | Song | |
| 2009/0146527 | A1 | 6/2009 | Lee | |
| 2010/0119097 | A1 | 5/2010 | Ohtsuka | |
| 2010/0167799 | A1 | 7/2010 | Makihata | |
| 2010/0219722 | A1 | 9/2010 | Onishi | |
| 2010/0284553 | A1 | 11/2010 | Conti | |
| 2011/0062573 | A1 | 3/2011 | Zhe | |
| 2011/0085684 | A1 | 4/2011 | Kim | |
| 2011/0198714 | A1 | 8/2011 | Yang | |
| 2012/0018244 | A1 * | 1/2012 | Robert | B06B 1/0292 181/142 |
| 2012/0027234 | A1 * | 2/2012 | Goida | H04R 31/006 381/150 |
| 2012/0087522 | A1 | 4/2012 | Lee | |
| 2013/0050227 | A1 | 2/2013 | Petersen | |
| 2013/0121509 | A1 * | 5/2013 | Hsu | H04R 19/005 381/104 |
| 2013/0140655 | A1 | 6/2013 | Yeh | |
| 2013/0294636 | A1 | 11/2013 | Cassett | |
| 2014/0084396 | A1 * | 3/2014 | Jenkins | B81C 1/00158 257/419 |
| 2015/0245118 | A1 | 8/2015 | Dehe | |
| 2016/0219377 | A1 | 7/2016 | Chi | |
| 2017/0021391 | A1 * | 1/2017 | Guedes | B06B 1/0603 |
| 2017/0041717 | A1 * | 2/2017 | Zou | B81C 1/00158 |
| 2017/0048624 | A1 | 2/2017 | Clerici | |
| 2017/0276646 | A1 | 9/2017 | Moreira Araujo | |
| 2017/0320726 | A1 * | 11/2017 | Leitgeb | B81B 7/0061 |
| 2017/0325030 | A1 | 11/2017 | Stoppel | |
| 2018/0041828 | A1 | 2/2018 | Sibbald | |
| 2018/0098139 | A1 * | 4/2018 | Arevalo Carreno | H04R 31/006 |
| 2018/0139542 | A1 | 5/2018 | Zou | |
| 2018/0213312 | A1 | 7/2018 | Hsiao | |
| 2018/0343524 | A1 | 11/2018 | Lim | |
| 2018/0367921 | A1 | 12/2018 | Murarka | |
| 2019/0045307 | A9 | 2/2019 | Kaplan | |
| 2019/0145806 | A1 | 5/2019 | Lim | |
| 2019/0208330 | A1 | 7/2019 | Bretthauer | |
| 2019/0289405 | A1 | 9/2019 | Littrell | |
| 2020/0075839 | A1 | 3/2020 | Sooriakumar | |
| 2020/0236470 | A1 * | 7/2020 | Cerini | H04R 19/005 |
| 2021/0009407 | A1 | 1/2021 | Yoo | |

FOREIGN PATENT DOCUMENTS

| | | | |
|---|---|---|---|
| GB | 2538432 | A | 11/2016 |
| JP | 2010-283451 | A | 12/2010 |
| KR | 10-0785803 | B1 | 12/2007 |
| KR | 10-0931575 | B1 | 12/2009 |
| KR | 10-2011-0039815 | A | 4/2011 |
| KR | 10-1471084 | B1 | 12/2014 |
| KR | 10-2016-0146952 | A | 12/2016 |
| KR | 10-2019-0060158 | A | 6/2019 |
| WO | 2008/076929 | A1 | 6/2008 |
| WO | 2016/107975 | A1 | 7/2016 |
| WO | 2016/162829 | A1 | 10/2016 |

* cited by examiner

PACKAGE STRUCTURE AND METHODS OF MANUFACTURING SOUND PRODUCING CHIP, FORMING PACKAGE STRUCTURE AND FORMING SOUND PRODUCING APPARATUS

CROSS REFERENCE TO RELATED APPLICATIONS

This application is a continuation-in-part (CIP) of U.S. patent application Ser. No. 16/920,384 filed on Jul. 2, 2020, which claims the benefit of U.S. provisional application No. 62/954,237, filed on Dec. 27, 2019. This application claims the benefit of U.S. provisional application No. 63/051,909, filed on Jul. 15, 2020 and the priority of U.S. patent application Ser. No. 17/008,580 filed on Aug. 31, 2020, which claims the benefit of U.S. provisional application No. 63/012,089, filed on Apr. 18, 2020. All of the above-referenced applications are incorporated herein by reference.

BACKGROUND OF THE INVENTION

1. Field of the Invention

The present application relates to a package structure and a method of manufacturing a sound producing chip, a method of forming a package structure and a method of forming a sound producing apparatus, and more particularly, to a package structure having a sound producing chip capable of enhancing sound quality and related methods of manufacturing a sound producing chip, forming a package structure and forming a sound producing apparatus.

2. Description of the Prior Art

Magnet and Moving coil (MMC) based sound producing devices, including balance-armature speaker drivers, have been developed for decades and many modern devices still depend on them to generate sound.

MMC is ill fitted as a truly broad band sound source due to various resonance frequencies of the device which falls within the audible band. For example, the resonance associated with the membrane and its support, resonance associated with the electrical inductance (L) of the moving coil and the mechanical capacitance (C) of the membrane support, the mechanical resonance arise from the spring of air within back enclosure and the mass of the membrane, the ringing of the membrane surface, or, in the case of balance armature (BA) speakers, the triple resonance of the front chamber, back camber and the port tube, etc., would fall within the audible band. In the design of MMC, some of such resonances are viewed upon as desirable features, and smart arrangements were made to utilize such resonance to increase the displacement of the membrane and therefore generating higher sound pressure level (SPL).

Recently, MEMS (Micro Electro Mechanical System) microspeakers become another breed of sound producing devices which make use of a thin film piezoelectric material as actuator, a thin single crystal silicon layer as membrane and make use of a semiconductor fabrication process. Despite the material and manufacturing process, the age-old MMC design mentality and practices were applied, almost blindly, to MEMS microspeakers, without taking differences between the MMC and MEMS into consideration. Hence, some disadvantages on the MEMS sound producing device product would be produced.

Therefore, it is necessary to improve the prior art.

SUMMARY OF THE INVENTION

It is therefore a primary objective of the present invention to provide a package structure with a sound producing chip capable of enhancing sound quality. Furthermore, a related method of manufacturing a sound producing chip, a related method of forming a package structure and a related method of forming a sound producing apparatus are also provided.

An embodiment of the present invention provides a package structure including a housing and a sound producing chip. The sound producing chip is disposed within the housing. The sound producing chip includes a membrane and an actuator. The membrane includes a coupling plate and a spring structure connected to the coupling plate. The actuator is configured to receive a driving signal to actuate the membrane. The spring structure is situated between the coupling plate and the actuator. The coupling plate is actuated to move by the actuator via the spring structure.

Another embodiment of the present invention provides a method of manufacturing a sound producing chip. The method includes: providing a wafer, wherein the wafer includes a first layer and a second layer; forming and patterning an actuating material on a first side of the wafer; patterning the first layer of the wafer, so as to form a trench line; and removing a first part of the second layer of the wafer. A second part of the second layer forms at least one anchor structure, and the patterned first layer forms a membrane anchored by the at least one anchor structure. A slit is formed within and penetrates through the membrane because of the trench line. The membrane includes a coupling plate and a spring structure connected to the coupling plate, and the spring structure is formed because of the slit. The spring structure is situated between the coupling plate and the actuator. The coupling plate is actuated to move by the actuator via the spring structure.

Another embodiment of the present invention provides a method of forming a package structure. The method includes: providing a housing; manufacturing a sound producing chip by an aforementioned method; and disposing the sound producing chip within the housing.

Another embodiment of the present invention provides s method of forming a sound producing apparatus. The method includes: forming a package structure by an aforementioned method; and assembling the package structure into the sound producing apparatus via a surface mount technology.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
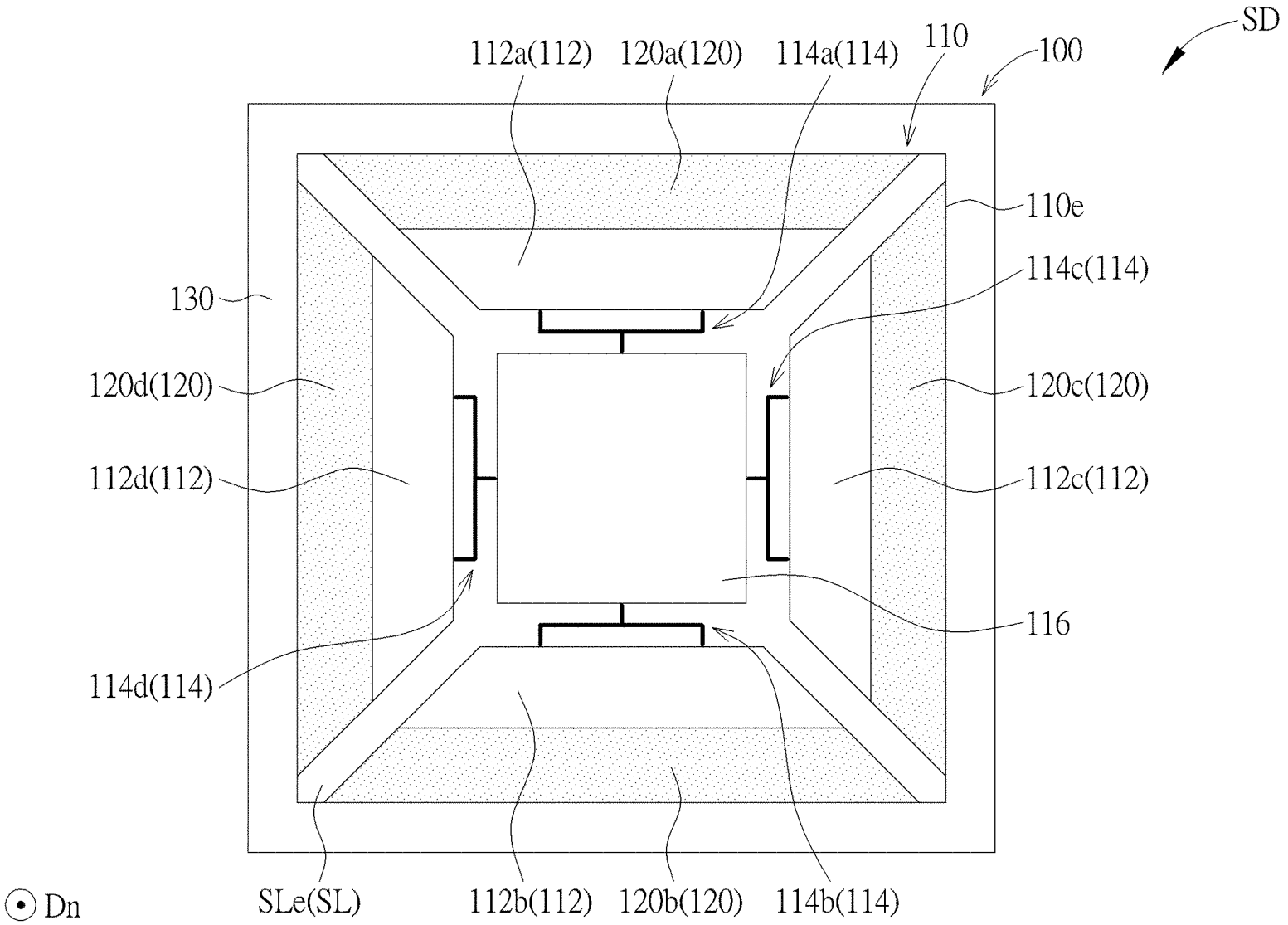
FIG. 1 is a schematic diagram of a top view illustrating a sound producing device having a first type of a sound producing chip according to an embodiment of the present invention.

To provide a better understanding of the present invention to those skilled in the art, preferred embodiments and typical material or range parameters for key components will be detailed in the follow description. These preferred embodiments of the present invention are illustrated in the accompanying drawings with numbered elements to elaborate on the contents and effects to be achieved. It should be noted that the drawings are simplified schematics, and the material and parameter ranges of key components are illustrative based on the present day technology, and therefore show only the components and combinations associated with the present invention, so as to provide a clearer description for the basic structure, implementing or operation method of the present invention. The components would be more complex in reality and the ranges of parameters or material used may evolve as technology progresses in the future. In addition, for ease of explanation, the components shown in the drawings may not represent their actual number, shape, and dimensions; details may be adjusted according to design requirements.

In the following description and in the claims, the terms "include", "comprise" and "have" are used in an open-ended fashion, and thus should be interpreted to mean "include, but not limited to . . . ". Thus, when the terms "include", "comprise" and/or "have" are used in the description of the present invention, the corresponding features, areas, steps, operations and/or components would be pointed to existence, but not limited to the existence of one or a plurality of the corresponding features, areas, steps, operations and/or components.

In the following description and in the claims, when "a A1 component is formed by/of B1", B1 exist in the formation of A1 component or B1 is used in the formation of A1 component, and the existence and use of one or a plurality of other features, areas, steps, operations and/or components are not excluded in the formation of A1 component.

Although terms such as first, second, third, etc., may be used to describe diverse constituent elements, such constituent elements are not limited by the terms. The terms are used only to discriminate a constituent element from other constituent elements in the specification, and the terms do not relate to the sequence of the manufacture if the specification do not describe. The claims may not use the same terms, but instead may use the terms first, second, third, etc. with respect to the order in which an element is claimed. Accordingly, in the following description, a first constituent element may be a second constituent element in a claim.

It should be noted that the technical features in different embodiments described in the following can be replaced, recombined, or mixed with one another to constitute another embodiment without departing from the spirit of the present invention.

There are two main differences between the MMC sound producing device and the MEMS sound producing device, e.g., piezoelectric actuated MEMS sound producing device: 1) The characteristic of membranes motion generated during sound production is drastically different, where an MMC sound producing device is force-based but a piezoelectric actuated MEMS sound producing device is position-based; 2) The quality factor (i.e., Q factor) of an MEMS sound producing device resonance is typically 100±40 which has spiky and narrow peaking frequency response; while the Q factor of MMC resonances are typically in the range of 0.7~2, much smaller than the Q factor of the MEMS sound producing device, and therefore has very smooth and broad peaking.

The feasibility for an MMC sound producing device to utilize resonances to produce the desirable frequency response depends a lot on the low Q factor of such resonance which allows multiple relatively broad-banded smooth peaking to be kneaded together and form a frequency response which is relatively flat between those resonance frequencies.

However, such resonance-kneading is no longer feasible for the MEMS sound producing device because the resonance Q factor is way too high and the excessive ringing around the resonance frequency will cause: a) severe membrane excursion and induce rather massive nonlinearity, and b) extended ringing after the excitation source has terminated (high Q factor comes from low dissipation factor, so once the ringing starts, like hitting the edge of the coin, the ringing will sustain for an extended period of time after the impact). The item a causes THD (Total Harmonic Distortion) and IM (Inter-modulation) to rise due to the nonlinearity caused by the excessive membrane excursion, while the item b would cause sound quality to become "colored" and "muddied".

The fundamental idea of the present invention is to move the resonance frequency of the MEMS sound producing device upward to be above the audio band (e.g., beyond 16 kHz), such that barely/no resonance happens in the audio band. Hence, the membrane excursion, the THD and IM, the nonlinearity and the extended ringing can be avoided when the sound producing device produces a sound wave, wherein the frequency of the sound wave is in the audio band. In this case, the sound producing device may achieve high performance.

Figure 2:
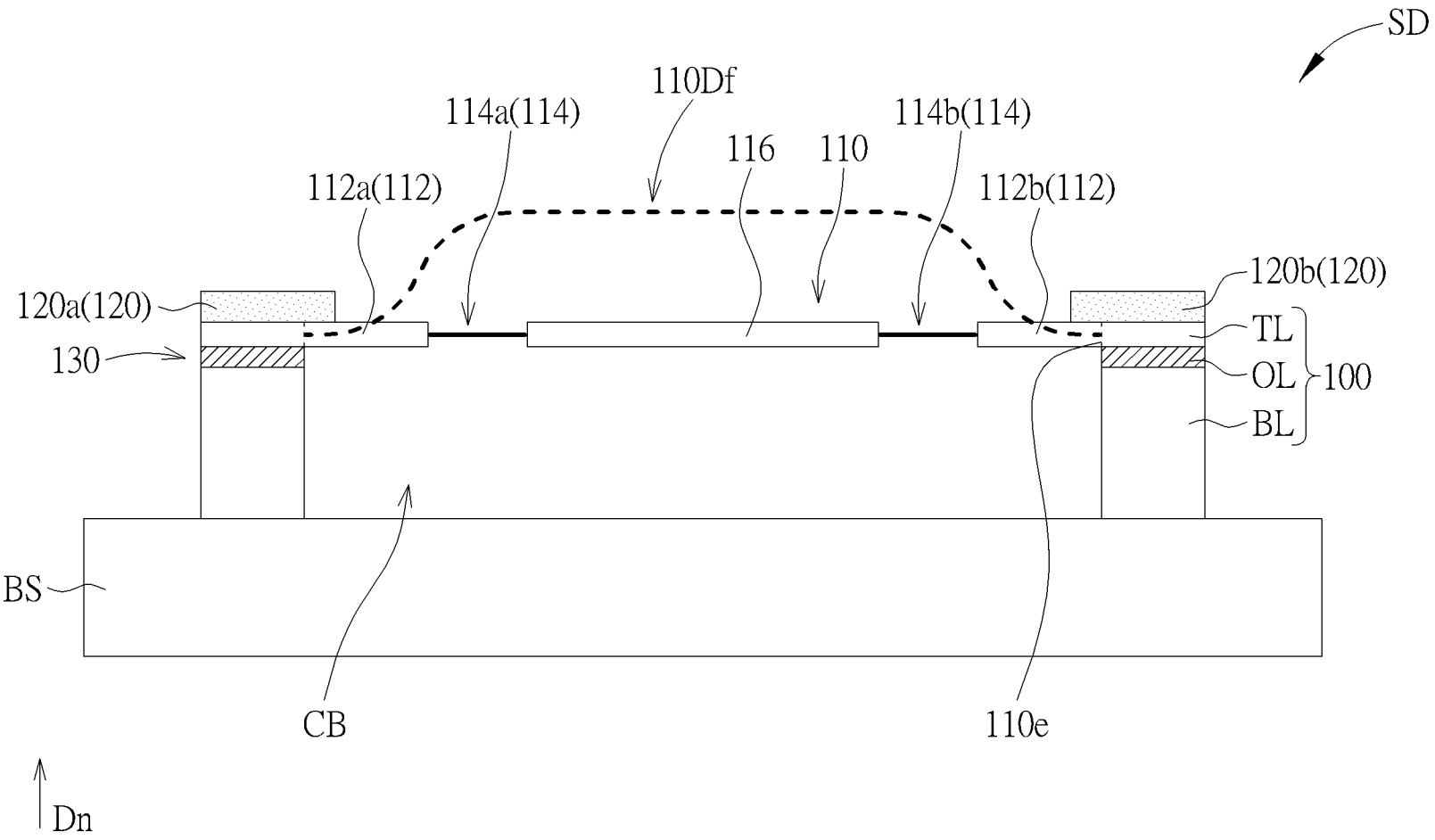
FIG. 2 is a schematic diagram of a cross sectional view illustrating the sound producing device having the first type of the sound producing chip according to the embodiment of the present invention.
Figure 3:
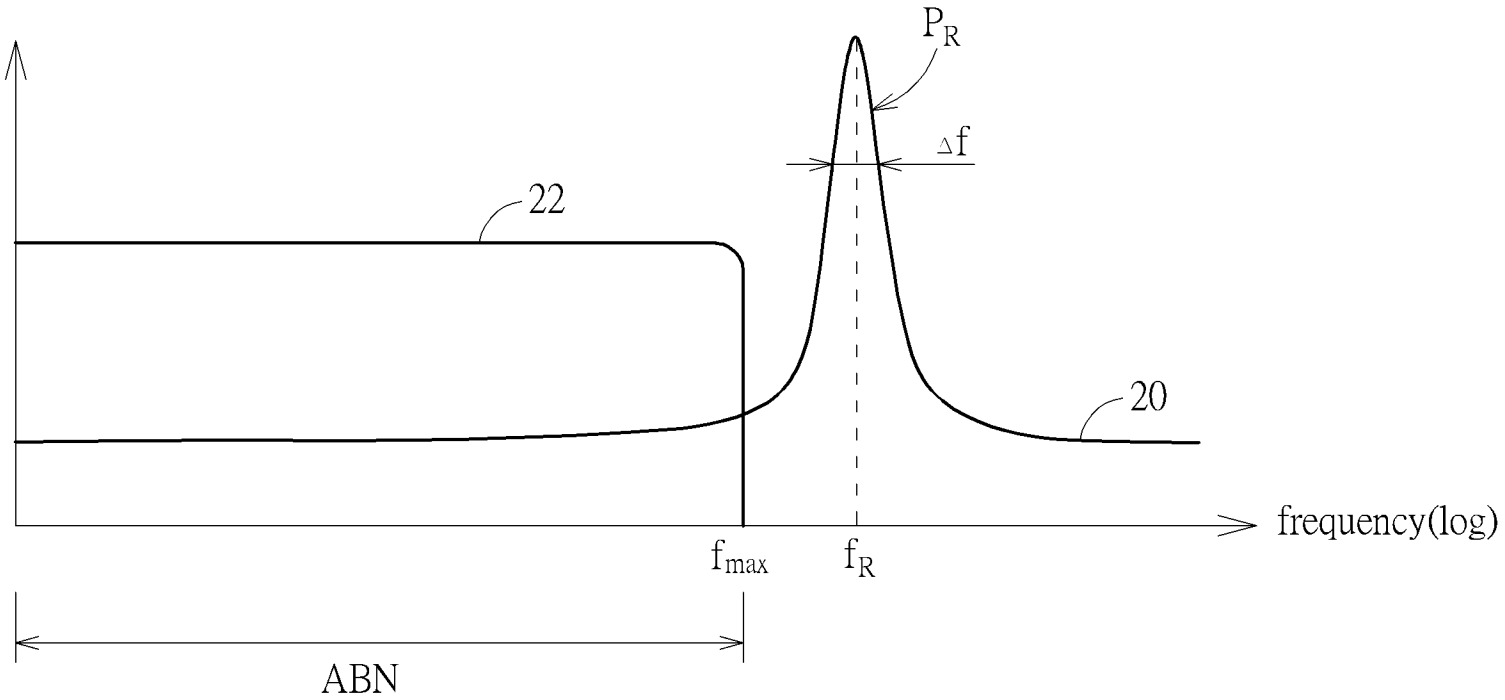
FIG. 3 is a schematic diagram illustrates a frequency response of a membrane and an input audio band according to an embodiment of the present invention.

Referring to FIG. 1 to FIG. 3, FIG. 1 is a schematic diagram of a top view illustrating a sound producing device having a first type of a sound producing chip according to an embodiment of the present invention, FIG. 2 is a schematic diagram of a cross sectional view illustrating the sound producing device having the first type of the sound producing chip according to the embodiment of the present invention, and FIG. 3 is a schematic diagram illustrates a frequency response of a membrane and an input audio band according to an embodiment of the present invention. As shown in FIG. 1 and FIG. 2, the sound producing device SD includes a base BS and at least one sound producing chip 100 disposed on the base BS. The base BS may be hard or flexible, wherein the base BS may include silicon, germanium, glass, plastic, quartz, sapphire, metal, polymer (e.g., polyimide (PI), polyethylene terephthalate (PET)), any other suitable material or a combination thereof. As an example, the base BS may be a circuit board including a laminate (e.g. copper clad laminate, CCL), a land grid array (LGA) board or any other suitable board containing conductive material, such that the base BS may include one or more conductive component(s), such as connecting trace(s), active component(s), passive component(s) and/or connecting pad(s). As another example, the base BS may be an integrated circuit chip, but not limited thereto.

In FIG. 1, the sound producing device SD may include one sound producing chip 100, but not limited thereto. The sound producing chip 100 is a MEMS chip configured to produce the sound wave. In detail, the sound producing chip 100 may include at least one membrane 110, at least one actuator 120 and an anchor structure 130, wherein the membrane 110 is actuated to produce the sound wave by the actuator 120, and the anchor structure 130 is connected to a plurality of outer edges 110*e* of the membrane 110, wherein the outer edges 110*e* of the membrane 110 define a boundary of the membrane 110. In FIG. 1, the sound producing chip 100 may include one membrane 110 and one actuator 120, but not limited thereto. Correspondingly, in FIG. 2, because the sound producing chip 100 is disposed on the base BS, the sound producing device SD may further include a chamber CB existing between the membrane 110 and the base BS. Specifically, since the actuator 120 needs to actuate the membrane 110, the actuator 120 may be disposed on the membrane 110 or be close to the membrane 110. For instance, in FIG. 1 and FIG. 2, the actuator 120 is disposed on the membrane 110 (e.g., the actuator 120 may be in contact with the membrane 110), but not limited thereto. The actuator 120 has a high linear electromechanical converting function. In some embodiments, the actuator 120 may include a piezoelectric actuator, an electrostatic actuator, a nanoscopic-electrostatic-drive (NED) actuator, an electromagnetic actuator or any other suitable actuator, but not limited thereto. For example, in an embodiment, the actuator 120 may include a piezoelectric actuator, the piezoelectric actuator may contain such as two electrodes and a piezoelectric material layer disposed between the electrodes, wherein the piezoelectric material layer may actuate the membrane 110 based on driving voltages received by the electrodes, but not limited thereto. For example, in another embodiment, the actuator 120 may include an electromagnetic actuator (such as a planar coil), wherein the electromagnetic actuator may actuate the membrane 110 based on a received driving current and a magnetic field (i.e. the membrane 110 may be actuated by the electromagnetic force). For example, in still another embodiment, the actuator 120 may include an electrostatic actuator (such as conducting plate) or a NED actuator, wherein the electrostatic actuator or the NED actuator may actuate the membrane 110 based on a received driving voltage and an electrostatic field (i.e. the membrane 110 may be actuated by the electrostatic force). The actuator 120 may be disposed on the membrane 110 or disposed in the membrane 110 based on the type of the actuator 120 and/or other requirement(s).

Note that the anchor structure 130 may be a fixed end (or fixed edge) respecting the membrane 110 during the operation of the sound producing device SD. In other words, the anchor structure 130 need not be actuated by the actuator 120 when the actuator 120 actuates the membrane 110, and the anchor structure 130 is immobilizing during the operation of the sound producing device SD. Note that "the operation of the sound producing device SD" described in the present invention represents that the sound producing device SD generates the sound wave.

Regarding actuation caused by the actuator 120, the actuator 120 is configured to receive a driving signal (driving voltage and/or driving current) to actuate the membrane 110, wherein the driving signal is corresponding to an input audio signal, and the sound wave produced by the sound producing chip 100 is corresponding to the input audio signal. For example, the sound wave, the input audio signal and the driving signal have the same frequency, but not limited thereto. Also, in one frequency, the driving signal is greater as the input audio signal is greater, such that sound pressure level (SPL) of the sound wave is greater. Moreover, in the present invention, the input audio signal and the driving signal have an input audio band ABN, and the input audio band ABN has an upper bound at a maximum frequency $f_{max}$. That is to say, the frequency of the input audio signal is not higher than the maximum frequency $f_{max}$, or a partial energy of the input audio signal (and/or the driving signal) higher than the maximum frequency $f_{max}$ is less than a specific threshold. In the present invention, the maximum frequency $f_{max}$ may be a maximum human audible frequency, e.g., 22 kHz, or lower, depending on various applications. For example, the maximum frequency $f_{max}$ of a voice-related application may be 5 kHz, which is significantly lower than the maximum human audible frequency (22 kHz), but not limited thereto.

In FIG. 3, a curve 20 representing a frequency response of the membrane 110 and a curve 22 representing an input audio band ABN of the input audio signal are also schematically illustrated. As shown in FIG. 3, the membrane 110 of the present invention is designed to have a first resonance frequency $f_R$ higher than the maximum frequency $f_{max}$ such that resonance of the membrane 110 would barely happen in the input audio band ABN. In some embodiments, the first resonance frequency $f_R$ is higher than the maximum human audible frequency, but not limited thereto. Note that the first resonance frequency $f_R$ is a lowest resonance frequency of the membrane 110, and the first resonance frequency $f_R$ of the membrane 110 is measured after the sound producing chip 100 is formed completely. Namely, according to the design of the sound producing chip 100, if at least one structure (e.g., the actuator 120 and/or other suitable structure) is disposed on the membrane 110, the first resonance frequency $f_R$ of the membrane 110 is measured by measuring a combination of the membrane 110 and the structure(s) disposed on the membrane 110; if no other structure is disposed on the membrane 110, the first resonance frequency $f_R$ of the membrane 110 is measured by measuring the membrane 110 only.

In some embodiments, in order to avoid the resonance of the membrane 110 falling/happening within the input audio band ABN, the first resonance frequency $f_R$ of the membrane 110 shall be significantly higher than the maximum frequency $f_{max}$ of the input audio band ABN. For example, as shown in FIG. 3, the first resonance frequency $f_R$ of the membrane 110 shall be at least higher than the maximum frequency $f_{max}$ plus a half of a first resonance bandwidth $\Delta f$ corresponding to the first resonance frequency $f_R$ (i.e., $f_R > f_{max} + \Delta f/2$), wherein the first resonance bandwidth $\Delta f$ represents a full width at half maximum (FWHM) of a pulse $P_R$ corresponding the first resonance frequency $f_R$, and a half of the first resonance bandwidth $\Delta f$ (i.e., $\Delta f/2$) represents a half width at half maximum (HWHM) of the pulse $P_R$ corresponding the first resonance frequency $f_R$. Preferably, the first resonance frequency $f_R$ of the membrane 110 may be chosen to yield a rise of 3~10 dB within the input audio band ABN to alleviate resonance or even guarantee no resonance within the input audio band ABN. In some embodiments, the first resonance frequency $f_R$ of the membrane 110 may be higher than the maximum frequency $f_{max}$ plus a multiple of the first resonance bandwidth $\Delta f$, but not limited thereto.

In some embodiments, the first resonance frequency $f_R$ of the membrane 110 may be at least 10% higher than the maximum frequency $f_{max}$ of the input audio band ABN (i.e., the upper bound of the input audio band ABN). For example, for the sound producing device SD receiving PCM (Pulse-Code Modulation) encoded sources such as CD music or MP3, or wireless channel source such as Bluetooth, the data sample rate is generally 44.1 kHz and, by the Nyquist law, the upper limit frequency of the input audio signal (i.e., the maximum frequency $f_{max}$) would be approximately 22 kHz. Therefore, the first resonance frequency $f_R$ would preferably range from 23 kHz to 27.5 kHz≈25 kHz±10%·22 kHz, which would guarantee the driving signal of the sound producing device SD contains no frequency component near the first resonance frequency $f_R$. Therefore, the membrane excursion and the extended ringing can be avoided, and the sound quality is further enhanced.

Note that, the Q factor may be defined as $Q=(f_R/\Delta f)$. The Q factor of the membrane 110 may be in a range of 100±40, or be at least 50. In this case, $\Delta f=(f_R/Q)$ would be relatively small compared to the first resonance frequency $f_R$ when the Q factor is sufficiently large.

Note that, the first resonance frequency $f_R$, the first resonance bandwidth $\Delta f$ and the Q factor are parameters determined at/before the manufacturing process. Once the sound producing device SD is designed and manufactured, those parameters are fixed.

In order to achieve the above characteristics, any suitable type of the sound producing chip 100 may be provided. In the following, the first type of the sound producing chip 100 shown in FIG. 1 and FIG. 2 is exemplarily provided and explained, but the present invention is not limited thereto.

Generally, the resonance frequency of the membrane 110 may be adjusted in many ways. For example, the material of the membrane 110, the geometric shape of the membrane 110, the material of the component disposed on the membrane 110, the disposition of the component disposed on the membrane 110 and the geometric shape of the component disposed on the membrane 110 may affect the resonance frequency of the membrane 110, but not limited thereto.

In principle, when a Young's modulus of the membrane 110 is greater, the first resonance frequency $f_R$ of the membrane 110 may be higher. As an example, in order to make the membrane 110 obtain sufficiently high first resonance frequency $f_R$, the membrane 110 of this embodiment may have material with high Young's modulus, such as greater than 100 GPa for single crystal silicon, but not limited thereto. Thus, the membrane may have a Young's modulus greater than such as 100 GPa, but not limited thereto. The Young's modulus of the membrane 110 may be adjusted based on practical requirement. Note that, the Young's modulus of the membrane 110 is measured after the sound producing chip 100 is formed completely. Namely, according to the design of the sound producing chip 100, if at least one structure (e.g., the actuator 120 and/or other suitable structure) is disposed on the membrane 110, the Young's modulus of the membrane 110 is measured by measuring a combination of the membrane 110 and the structure(s) disposed on the membrane 110; if no other structure is disposed on the membrane 110, the Young's modulus of the membrane 110 is measured by measuring the membrane 110 only.

Regarding the material of the sound producing chip 100, the sound producing chip 100 may include material(s) having a high Young's modulus to form the membrane 110 with high first resonance frequency $f_R$, wherein this high Young's modulus may be greater than 100 GPa for instance, but not limited thereto. In this embodiment, the sound producing chip 100 may include silicon (e.g., single crystalline silicon or poly-crystalline silicon), silicon carbide, germanium, gallium nitride, gallium arsenide, stainless steel, and other suitable high stiffness material or a combination thereof. For example, the sound producing chip 100 may be formed of a silicon wafer, a silicon on insulator (SOI) wafer, a polysilicon on insulator (POI) wafer, an epitaxial silicon on insulator wafer, or a germanium on insulator (GOI) wafer, but not limited thereto. In FIG. 2, the sound producing chip 100 of this embodiment is formed of the SOI wafer for instance. In some embodiments, each material included in the membrane 110 has a Young's modulus greater than 100 GPa, such that the first resonance frequency $f_R$ of the membrane 110 may be higher, but not limited thereto. Moreover, if each material included in the membrane 110 has the high Young's modulus, the aging phenomenon of the membrane 110 may be decreased, and the membrane 110 may have the high temperature tolerance.

In FIG. 1 and FIG. 2, the actuator 120 may affect the resonance frequency of the membrane 110 because the actuator 120 is disposed on the membrane 110. In this embodiment, since the actuator 120 may decrease the resonance frequency of the membrane 110 due to such as a Young's modulus of material of the actuator 120 or a weight of the actuator 120, the actuator 120 may be designed to be a patterned layer to decrease the weight of the actuator 120 and the influence of the resonance frequency of the membrane 110. In other words, the actuator 120 may cover a portion of the membrane 110. Under the condition of the patterned actuator 120, not only the decrease of the first resonance frequency $f_R$ of the membrane 110 caused by the actuator 120 may be reduced, but also the weight of the actuator 120 may be less. Because of the lighter weight of the actuator 120, the displacement of the membrane 110 may be greater to enhance the SPL of the sound wave under the same signal. Also, because the weight/area of the actuator 120 is reduced, during the operation of the sound producing device SD, the power consuming by the actuator 120 may be diminished.

As shown in FIG. 1 and FIG. 2, in the first type of the sound producing chip 100, the membrane 110 of the sound producing chip 100 includes a coupling plate 116 and at least one spring structure 114 connected to the coupling plate 116, wherein the spring structure 114 is situated between the coupling plate 116 and the actuator 120 in the top view. The membrane 110 may optionally include a driving plate 112, the spring structure 114 may be connected between the driving plate 112 and the coupling plate 116, and the driving plate 112 may be connected between the anchor structure 130 and the spring structure 114. The shape, area and size of the coupling plate 116 and the shape, area and size of the driving plate 112 may be designed based on requirement(s). According to the above, since the actuator 120 is a patterned layer, the actuator 120 partially covers the membrane 110. Specifically, as shown in FIG. 1 and FIG. 2, the actuator 120 does not overlap the coupling plate 116 in a normal direction Dn of the membrane 110 (e.g., the normal direction Dn of the membrane 110 may be parallel to a normal direction the base BS), and at least a portion of the actuator 120 may be disposed on at least a portion of the driving plate 112 (i.e., at least a portion of the actuator 120 may overlap at least a portion of the driving plate 112). For example, in some embodiments, the actuator 120 may be completely disposed on at least a portion of the driving plate 112, but not limited thereto; in some embodiments, a portion of the actuator 120 may be disposed on at least a portion of the driving plate 112, and another portion of the actuator 120 may be disposed on at least a portion of the anchor structure 130, but not limited thereto. In this case, the actuator 120 may actuate the driving plate 112 to actuate the whole membrane 110. Although the actuator 120 does not overlap the coupling plate 116, the actuator 120 can actuate the coupling plate 116 through the driving plate 112 on which the actuator 120 is disposed and the spring structure 114 connected between the driving plate 112 and the coupling plate 116 (i.e., the coupling plate 116 is actuated to move by the actuator 120 via the spring structure 114). Optionally, the actuator 120 may not overlap the spring structure 114 in the normal direction Dn of the membrane 110, but not limited thereto.

The actuator 120 may be divided into a plurality of parts, and the membrane 110 may be actuated by these parts of the actuator 120 from many directions. For example, as shown in FIG. 1, the actuator 120 may include a first part 120*a*, a second part 120*b*, a third part 120*c* and a fourth part 120*d*, the first part 120*a* and the second part 120*b* may be disposed on opposite sides of the coupling plate 116, and the third part 120*c* and the fourth part 120*d* may be disposed on opposite sides of the coupling plate 116. In FIG. 1, in the first type of the sound producing chip 100, the actuator 120 may substantially surround the coupling plate 116, such that the third part 120*c* may be between the first part 120*a* and the second part 120*b*, and the fourth part 120*d* may be between the first part 120*a* and the second part 120*b* and opposite to the third part 120*c*, but not limited thereto. In some embodiments, the actuator 120 may not surround the coupling plate 116 (e.g., a second type of the sound producing chip 100 described in the below embodiment). Furthermore, in FIG. 1, the first part 120*a*, the second part 120*b*, the third part 120*c* and the fourth part 120*d* of the actuator 120 may be separated from each other by such as edge slits SLe (the edge slits SLe will be explained in the below embodiment), but not limited thereto. In some embodiments, the actuator 120 may further include an outer part (not shown in figures) disposed on the anchor structure 130, and the first part 120*a*, the second part 120*b*, the third part 120*c* and the fourth part 120*d* of the actuator 120 may be connected to the outer part, but not limited thereto.

In addition, as shown in FIG. 1 and FIG. 2, since the actuator 120 is disposed on the driving plate 112 and substantially surrounds the coupling plate 116, the driving plate 112 may substantially surround the coupling plate 116. For instance, the driving plate 112 may include a first driving part 112*a* on which the first part 120*a* of the actuator 120 is disposed, a second driving part 112*b* on which the second part 120*b* of the actuator 120 is disposed, a third driving part 112*c* on which the third part 120*c* of the actuator 120 is disposed and a fourth driving part 112*d* on which the fourth part 120*d* of the actuator 120 is disposed. The first driving part 112*a* and the second driving part 112*b* may be disposed on opposite sides of the coupling plate 116, and the third driving part 112*c* and the fourth driving part 112*d* may be disposed on opposite sides of the coupling plate 116. Similarly, in FIG. 1, the first driving part 112*a*, the second driving part 112*b*, the third driving part 112*c* and the fourth driving part 112*d* of the driving plate 112 may be separated from each other by such as edge slits SLe (the edge slits SLe will be explained in the below embodiment), but not limited thereto. In some embodiments, the coupling plate 116 may be situated at a center of the membrane 110, but not limited thereto.

Correspondingly, since the actuator 120 is divided into a plurality of parts, the sound producing chip 100 includes a plurality of spring structures 114 (i.e., the at least one spring structure 114 includes a plurality of spring structures 114). In detail, the sound producing chip 100 may include a first spring structure 114*a*, a second spring structure 114*b*, a third spring structure 114*c* and a fourth spring structure 114*d*. The first spring structure 114*a* and the second spring structure 114*b* may be disposed on opposite sides of the coupling plate 116, and the third spring structure 114*c* and the fourth spring structure 114*d* may be disposed on opposite sides of the coupling plate 116. The first spring structure 114*a* is connected between the coupling plate 116 and the first driving part 112*a*, the second spring structure 114*b* is connected between the coupling plate 116 and the second driving part 112*b*, the third spring structure 114*c* is connected between the coupling plate 116 and the third driving part 112*c*, and the fourth spring structure 114*d* is connected between the coupling plate 116 and the fourth driving part 112*d*. In another aspect, the coupling plate 116 is connected between the first spring structure 114*a* and the second spring structure 114*b*, and the coupling plate 116 is also connected between the third spring structure 114*c* and the fourth spring structure 114*d*.

Moreover, the spring structure 114 is configured to increase the displacement of the membrane 110 (i.e., enhance the SPL of the sound wave) and/or release the residual stress of the membrane 110, wherein the residual stress is generated during the manufacturing process of the sound producing chip 100 or originally exist in the sound producing chip 100. Furthermore, because of the existence of the spring structure 114, the membrane 110 may deform elastically during the operation of the sound producing device SD. In this embodiment, the membrane 110 may upwardly deform (or upwardly move) and downwardly deform (or downwardly move) alternately in FIG. 2. For example, the membrane 110 may deform into a deformed type 110Df shown in FIG. 2, but not limited thereto. Note that, in the present invention, the terms "upwardly" and "downwardly" are substantially along a direction parallel to the normal direction Dn of the membrane 110. In some embodiments, the coupling plate 116 may be only connected to the spring structures 114, so as to further increase the displacement of the membrane 110 during the operation of the sound producing device SD, but not limited thereto. In the present invention, the spring structure 114 may be any suitable structure which can achieve the above functions. In the following embodiments, details of the spring structure 114 will be further exemplarily explained.

Regarding the manufacturing method of the sound producing chip 100 of the present invention, the sound producing chip 100 is formed by any suitable manufacturing process. In this embodiment, the sound producing chip 100 may be formed by at least one semiconductor process to be a MEMS chip. In the following, as an example, the details of the manufacturing process of the sound producing chip 100 is described under the condition that the sound producing chip 100 is formed of the SOI wafer, but the manufacturing method is not limited thereto. As shown in FIG. 2, the sound producing chip 100 includes a base silicon layer BL, a top silicon layer TL and an oxide layer OL disposed between the base silicon layer BL and the top silicon layer TL. Firstly, the top silicon layer TL is patterned to form the profile of the membrane 110 (e.g., the profile of the coupling plate 116, the driving plate 112 and the spring structure 114), wherein the patterned process may include such as a photolithography, an etching process, any other suitable process or a combination thereof. Then, the patterned actuator 120 is formed on the top silicon layer TL. Hereafter, the base silicon layer BL and the oxide layer OL are partially etched to complete the membrane 110 formed of the top silicon layer TL, wherein the remaining base silicon layer BL, the remaining oxide layer OL and a portion of the top silicon layer TL may be combined to serve as the anchor structure 130 connected to the membrane 110. Moreover, in this embodiment, since the sound producing chip 100 is formed by at least one semiconductor process, not only the size of the sound producing chip 100 (i.e., thickness and/or the lateral dimension) may be decreased, but also the number of the manufacturing steps and the manufacturing cost of the sound producing chip 100 may be reduced. Furthermore, if the membrane 110 only includes one material with high Young's modulus (e.g., silicon or other suitable material), the number of the manufacturing steps and the manufacturing cost of the sound producing chip 100 may be further reduced.

According to the above manufacturing method, since the coupling plate 116 connected to the spring structures 114 exists, even if the structural strength of the membrane 110 is weakened due to the formation of the spring structure 114 (e.g., in some embodiments, the spring structure 114 may be formed by patterning the top silicon layer TL), the breaking possibility of the membrane 110 may be decreased and/or the break of the membrane 110 may be prevented during the manufacture. In other words, the coupling plate 116 may maintain the structural strength of the membrane 110 in a certain level.

In the following, some details of the first type of the sound producing chip will be further exemplarily explained. Note that the first type of the sound producing chip is not limited by the following embodiments which are exemplarily provided.

Figure 4:
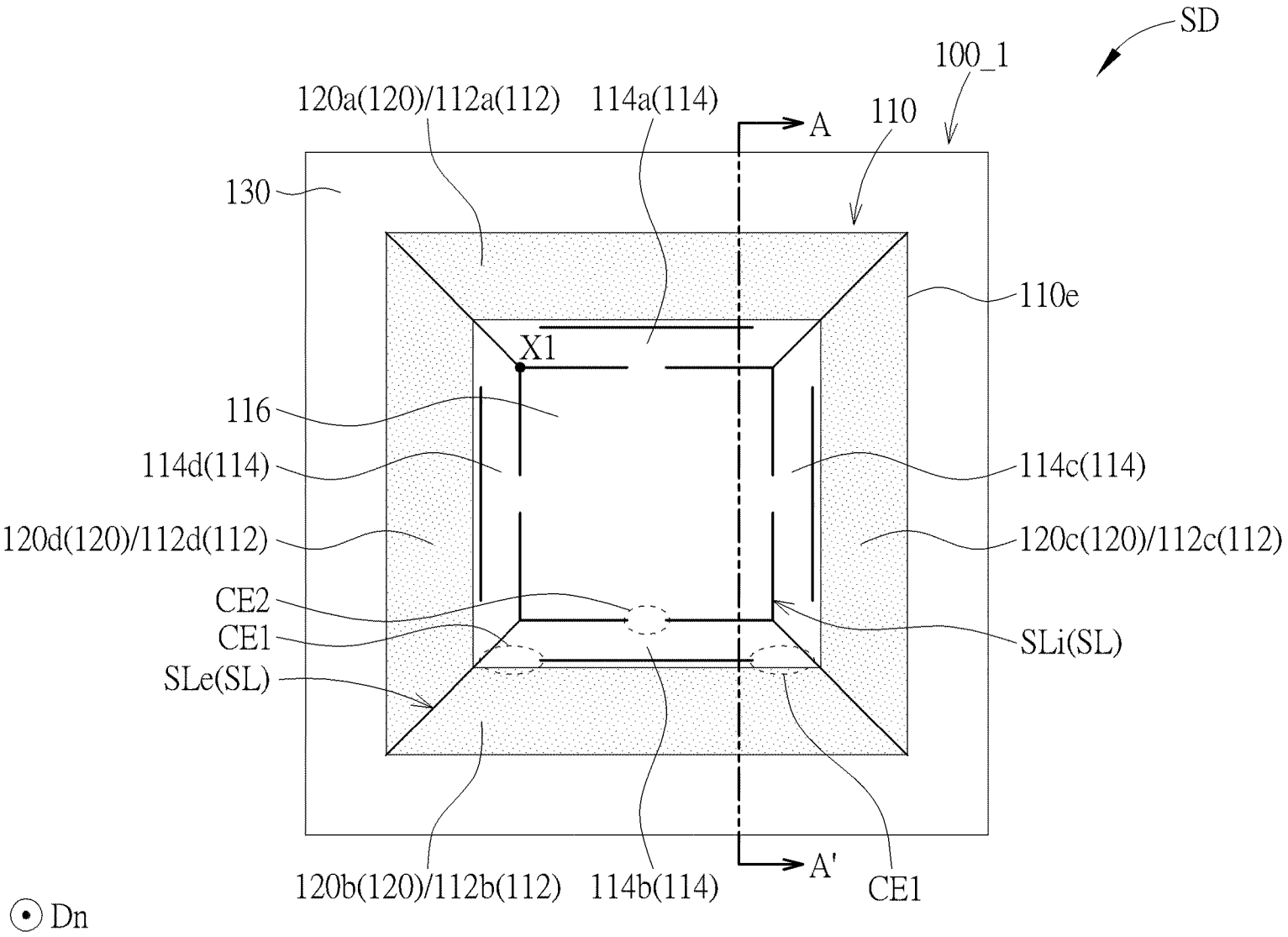
FIG. 4 is a schematic diagram of a top view illustrating a sound producing device according to a first embodiment of the present invention.
Figure 5:
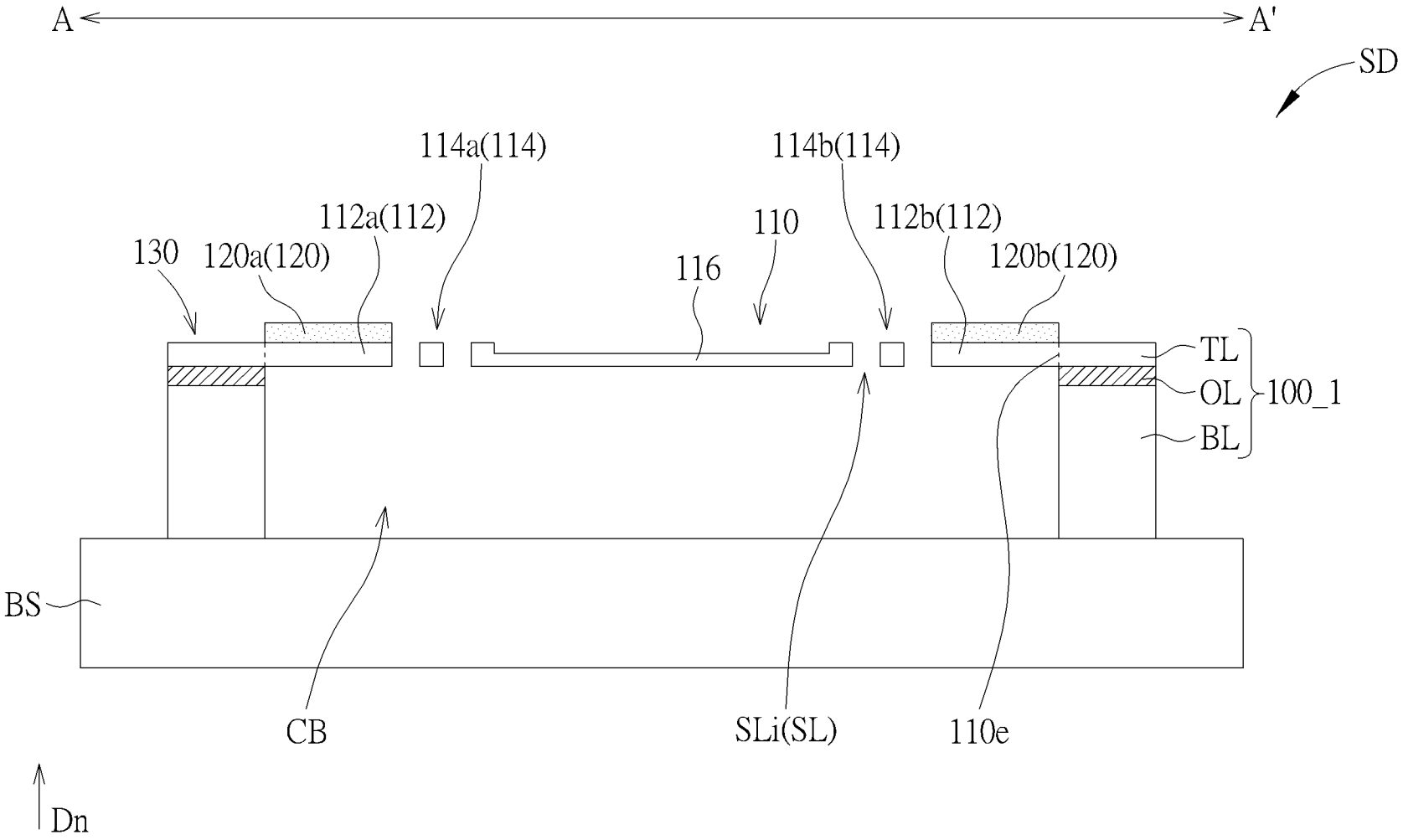
FIG. 5 is a schematic diagram of a cross sectional view taken along a cross-sectional line A-A' in FIG. 4.

Referring to FIG. 4 and FIG. 5, FIG. 4 is a schematic diagram of a top view illustrating a sound producing device according to a first embodiment of the present invention, and FIG. 5 is a schematic diagram of a cross sectional view taken along a cross-sectional line A-A' in FIG. 4, wherein the sound producing chip 100_1 is the first type. Compared with FIG. 1, the sound producing chip 100_1 shown in FIG. 4 and FIG. 5 further shows a plurality of slits SL of the membrane 110, wherein the spring structures 114 are formed because of at least a portion of the slits SL. In this embodiment, because of the existence of the slits SL, the residual stress of the membrane 110 is released. Since the spring structures 114 are formed because of at least a portion of the slits SL, the increase of the displacement of the membrane 110 is related to the arrangement of the slits SL. Namely, the SPL of the sound wave may be enhanced based on the arrangement of the slits SL. Furthermore, the slits SL may be designed to make the membrane 110 deform elastically during the operation of the sound producing device SD.

The arrangement of the slits SL and the patterns of the slits SL may be designed based on the requirement(s), wherein each slit SL may be a straight slit, a curved slit, a combination of straight slits, a combination of curved slits or a combination of straight slit(s) and curved slit(s). As an example, in this embodiment, as shown in FIG. 4 and FIG. 5, the slits SL may include a plurality of edge slits SLe and a plurality of internal slits SLi, each of the edge slits SLe is connected to at least one of the outer edges 110*e* of the membrane 110 (e.g., only one end of the edge slit SLe is connected to at least one outer edge 110*e* of the membrane 110) and extends towards the coupling plate 116 of the membrane 110, and the internal slits SLi are not connected to the outer edges 110*e* of the membrane 110. For instance, at least one of the edge slits SLe may be connected to one corner of the outer edges 110*e* of the membrane 110 (e.g., each edge slit SLe in FIG. 4 is connected to one corner of the outer edges 110*e* of the membrane 110), but not limited thereto. Optionally, in some embodiments, the internal slits SLi may not be situated at the region of the driving plate 112 on which the actuator 120 is disposed (e.g., this disposition is shown in FIG. 4), but not limited thereto. Moreover, in this embodiment, some internal slits SLi may be connected to the edge slits SLe, and some internal slits SLi may not be connected to any other slit, but not limited thereto. For example, in FIG. 4, each edge slit SLe may be connected to two of the internal slits SLi, but not limited thereto. For example, in FIG. 4, each internal slit SLi may be a straight slit, and two internal slits SLi connected to the same edge slit SLe may extend along different directions, but not limited thereto. Note that, an intersection point (e.g., intersection point X1) is formed due to the intersection of at least three slits SL, and the intersection point X1 is an end point respecting to these at least three slits SL. That is to say, the intersection point X1 may be a divided point of these at least three intersecting slits SL. For example, in FIG. 4, the intersection point X1 is formed due to the intersection of one edge slit SLe and two internal slits SLi, and the intersection point X1 is an end point of one edge slit SLe and two internal slits SLi, but not limited thereto. Optionally, the coupling plate 116 in some embodiments may be substantially surrounded by the slits SL, but not limited thereto.

In addition, the spring structures 114 of this embodiment are formed because of the edge slits SLe and the internal slits SLi. Referring to the upper portion of FIG. 4 which substantially shows a quarter of the membrane 110, three internal slits SLi may be substantially parallel to each other (for example, three internal slits SLi may be parallel to the upper outer edge 110*e*), the first spring structure 114*a* is fashioned by forming these three internal slits SLi and two edge slits SLe situated aside these three internal slits SLi, but not limited thereto. Furthermore, each spring structure 114 in FIG. 4 has two first connecting ends CE1 connected to the driving plate 112 and one second connecting end CE2 connected to the coupling plate 116, each first connecting end CE1 is close to one of the edge slits SLe, and the second connecting end CE2 is between the first connecting ends, but not limited thereto. The formations of other spring structures 114 shown in FIG. 4 are similar to the above, and these will not be redundantly described.

Figure 6:
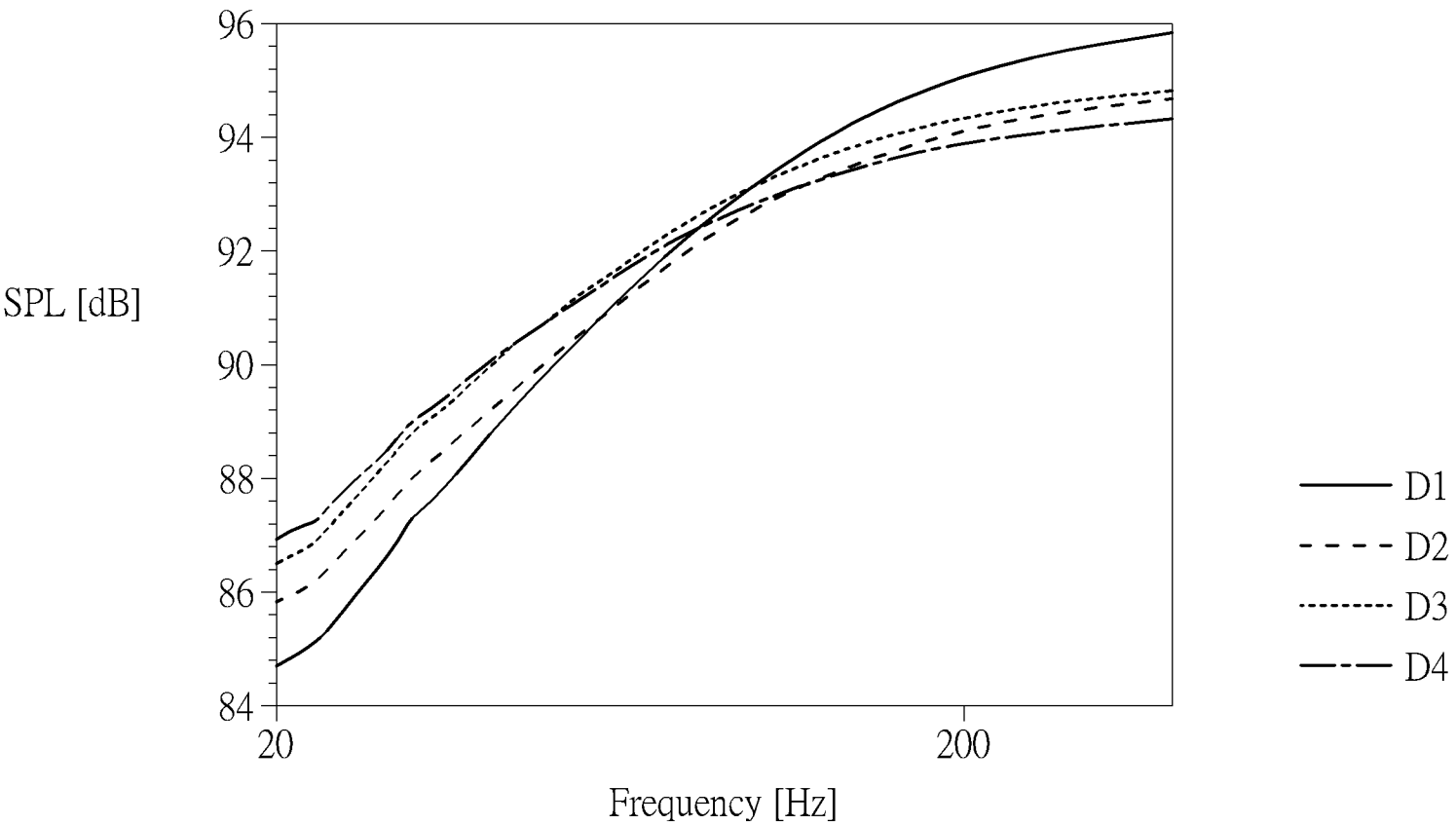
FIG. 6 is a schematic diagram illustrates frequency responses of membranes having different slits according to an embodiment of the present invention.

FIG. 6 is a schematic diagram illustrates frequency responses of membranes having different slits according to an embodiment of the present invention, wherein D1, D2, D3 and D4 shown in FIG. 6 represent the widths of the slits SL, and D1>D2>D3>D4. In general, the slits SL may leak the air during the operation of the sound producing device SD, so as to decrease the SPL of the sound wave. For example, a SPL drop may occur at low frequency (e.g., ranging from 20 Hz to 200 Hz) of the sound wave. In a viewpoint, according to FIG. 6 which shows the SPL drop at low frequency (e.g., ranging from 20 Hz to 200 Hz) of the sound wave, the SPL drop is reduced as the width of the slit SL is less. Thus, the slits SL need to be narrow for decreasing the leak of the air. In some embodiments, the width of the slit SL may be close to or smaller than 2 μm or close to or smaller than 1 μm under the condition that the sound producing device SD does not operate, but not limited thereto. Furthermore, regarding the design of the membrane 110, during the operation of the sound producing device SD, portions near the slit SL and respectively situated on opposite side of the slit SL may have similar displacement, such that the enlargement of the slit SL may be decreased, thereby reducing the leak of the air through the slit SL. In another viewpoint, the coupling plate 116 may constrain the movement of the membrane 110, such that the enlargement of the slit SL may be decreased during the operation of the sound producing device SD, thereby reducing the leak of the air through the slit SL. Accordingly, the SPL drop at the low frequency of the sound wave may be improved.

Moreover, in this embodiment, the membrane 110 may have a non-uniform thickness. In FIG. 4 and FIG. 5, the thickness of the membrane 110 is decreased with proximity of a center of the membrane 110. For example, the membrane 110 may substantially have a first thickness and a second thickness, the first thickness may be less than the second thickness, and (membrane) portion with the first thickness may be surrounded by (membrane) portion with the second thickness, but not limited thereto. For example, the first thickness may be corresponding to a portion of the coupling plate 116, and the second thickness may be corresponding to another portion of the coupling plate 116, the spring structures 114 and/or the driving plate 112, but not limited thereto. In some embodiments, the thickness of the membrane 110 may be gradually changed. In short, the membrane 110 having non-uniform thickness implies that, the membrane 110 may comprise a first membrane portion with the first thickness and a second membrane portion with the second thickness distinct from the first thickness.

Furthermore, in FIG. 4, the actuator 120 may completely cover the driving plate 112 (i.e., the overall driving plate 112 may overlap the actuator 120), but not limited thereto.

In addition, the polymer material has a low Young's modulus and a low thermal stability, and the polymer material ages with time significantly. In this embodiment, because of the absence of the polymer material in the sound producing chip 100_1 and on the sound producing chip 100_1 (e.g., the sound producing chip 100_1 does not include the polymer material and the sound producing chip 100_1 is not coated with a film containing the polymer material), the resonance frequency of the membrane 110, the operating temperature of the sound producing device SD and the life time of the sound producing device SD are not disadvantageously affected by the polymer material.

Figure 7:
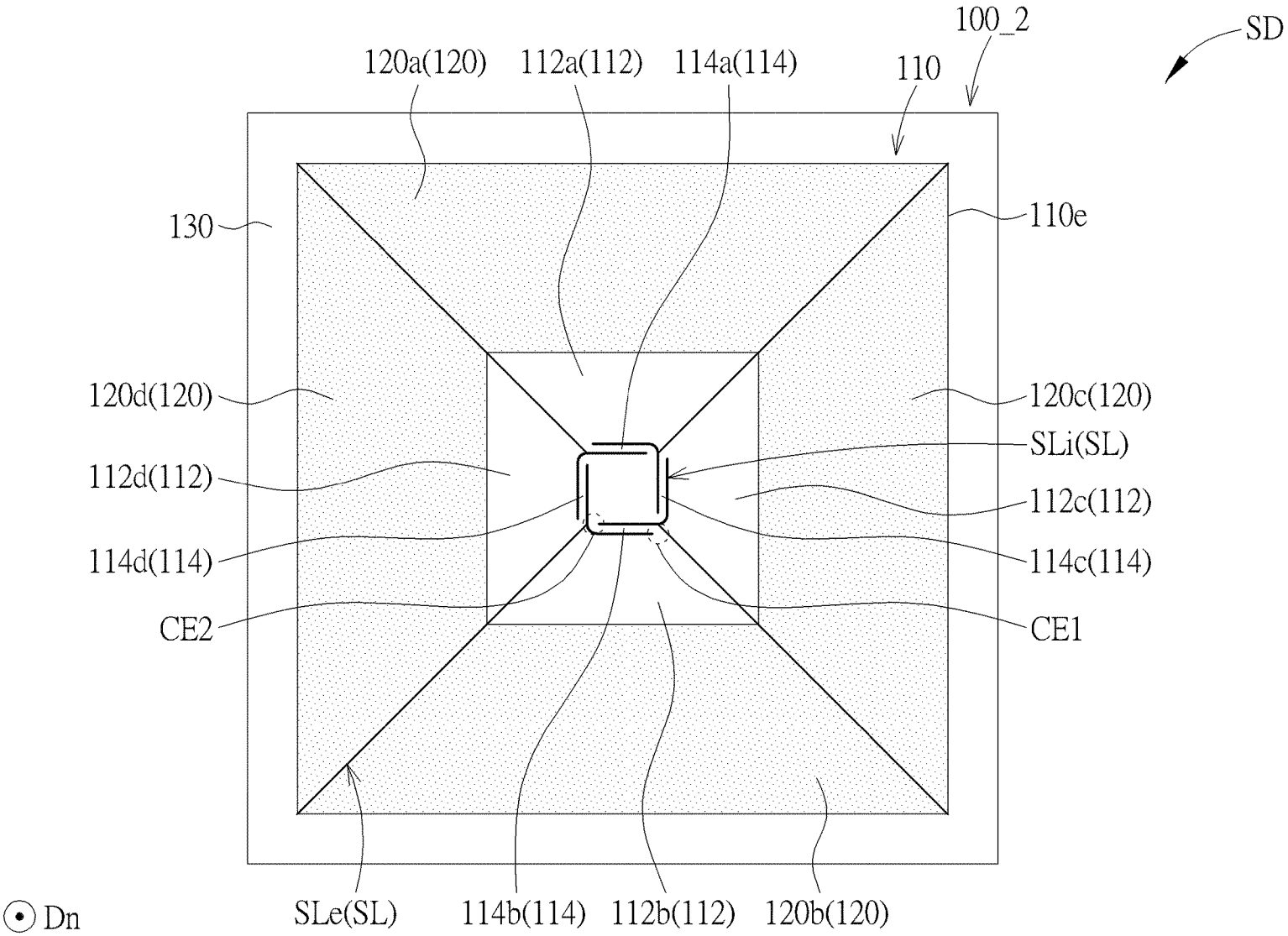
FIG. 7 is a schematic diagram of a top view illustrating a sound producing device according to a second embodiment of the present invention.

FIG. 7 is a schematic diagram of a top view illustrating a sound producing device according to a second embodiment of the present invention, wherein the sound producing chip 100_2 is the first type, and the sound producing chip 100_2 is not coated with a film, such as a film containing the polymer material having low Young's modulus (e.g., this film may be used to seal the slits). As shown in FIG. 7, a difference between the first embodiment (shown in FIG. 4 and FIG. 5) and this embodiment is the arrangement of the slits SL. In this embodiment, each internal slit SLi may be connected to one of the edge slits SLe, but not limited thereto. For example, in FIG. 7, each edge slit SLe may be connected to two of the internal slits SLi, but not limited thereto. Furthermore, in FIG. 7, the internal slits SLi may have different types. For instance, in two internal slits SLi connected to the same edge slit SLe, one of these two internal slits SLi may be a straight slit, and another one of these two internal slits SLi may be a combination of a straight slit and a curved slit, but not limited thereto. Moreover, referring to the upper portion of FIG. 7 which substantially shows a quarter of the membrane 110, one internal slit SLi which is a straight slit and one internal slit SLi which is a combination of a straight slit and a curved slit are shown, and the straight slits of these two internal slits SLi are arranged in a lateral direction perpendicular to the normal direction Dn of the membrane 110 and parallel to each other. In addition, as shown in the upper portion of FIG.

4 which substantially shows a quarter of the membrane 110, the first spring structure 114*a* is fashioned by forming these two internal slits SLi and two edge slits SLe situated aside these two internal slits SLi, but not limited thereto. Furthermore, each spring structure 114 in FIG. 7 has one first connecting end CE1 connected to the driving plate 112 and close to one edge slit SLe and one second connecting end CE2 connected to the coupling plate 116 and close to another edge slit SLe, but not limited thereto. The formations of other spring structures 114 shown in FIG. 7 are similar to the above, and these will not be redundantly described. Moreover, in this embodiment, the internal slits SLi may form a vortex pattern in top view, but not limited thereto.

Figure 8:
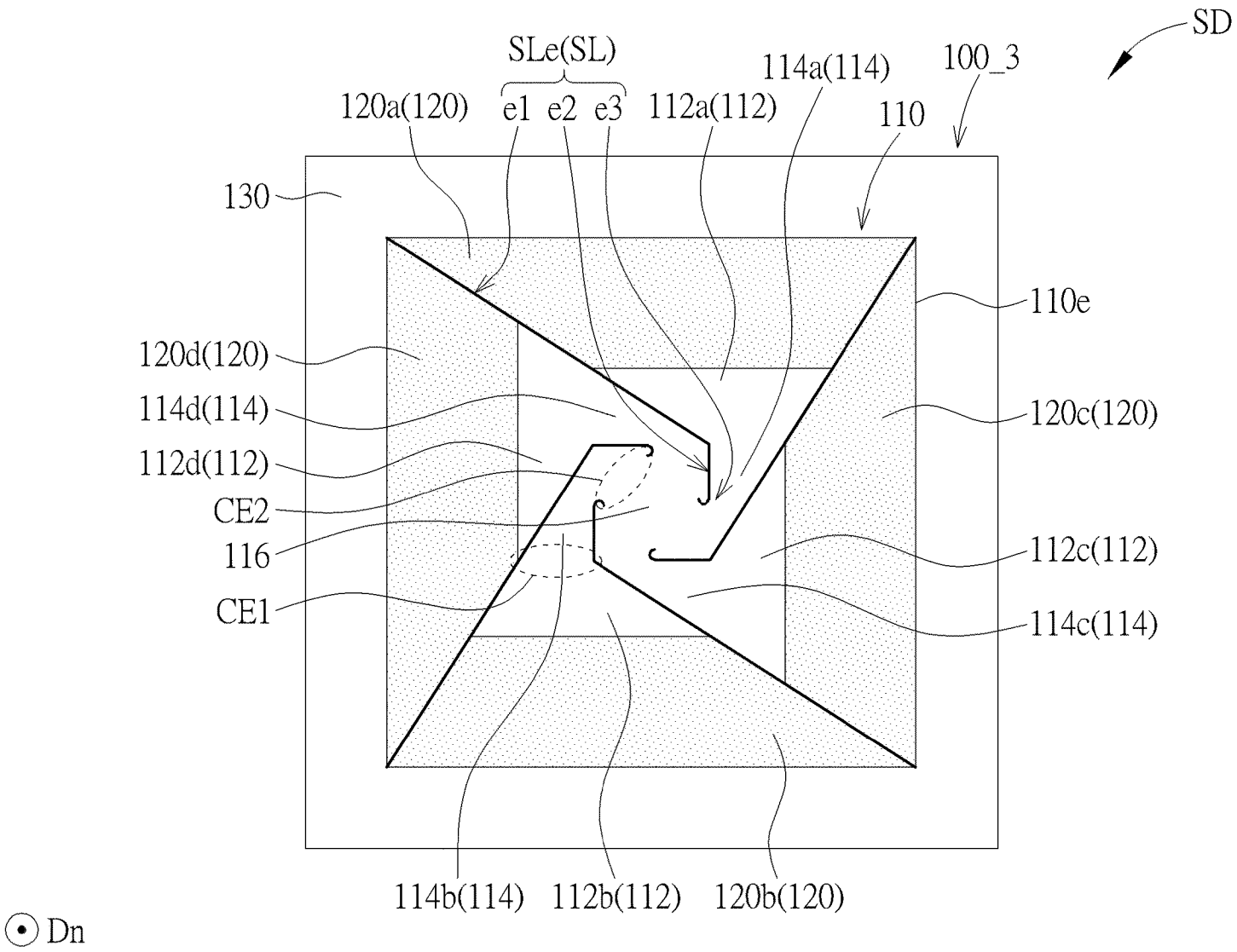
FIG. 8 is a schematic diagram of a top view illustrating a sound producing device according to a third embodiment of the present invention.

FIG. 8 is a schematic diagram of a top view illustrating a sound producing device according to a third embodiment of the present invention, wherein the sound producing chip 100_3 is the first type, and the sound producing chip 100_3 is not coated with a film, such as a film containing the polymer material having low Young's modulus (e.g., this film may be used to seal the slits). As shown in FIG. 8, a difference between the first embodiment (shown in FIG. 4 and FIG. 5) and this embodiment is the arrangement of the slits SL. In this embodiment, the slits SL may include a plurality of edge slits SLe only, and the spring structures 114 may be formed because of the edge slits SLe, wherein each spring structure 114 may be between two adjacent edge slits SLe. For example, in FIG. 8, each edge slit SLe of this embodiment may include a first portion e1, a second portion e2 connected to the first portion e1 and a third portion e3 connected to the second portion e2, and the first portion e1, the second portion e2 and the third portion e3 are arranged in sequence from the outer edge 110*e* to the inner of the membrane 110, wherein in one of the edge slits SLe, an extending direction of the first portion e1 which is a straight slit may be not parallel to an extending direction of the second portion e2 which is another straight slit, and the third portion e3 may be a curved slit (i.e., the edge slit SLe may be a combination of two straight slits and one curved slit), but not limited thereto. The third portion e3 might have a hook-shaped curved end of the edge slit SLe, wherein the hook-shaped curved ends surround the coupling plate 116. The hook-shaped curved end implies that, a curvature at the curved end or at the third portion e3 is larger than curvature(s) at the first portion e1 or the second portion e2, from a top view perspective. The curved end of the third portion e3 may be configured to minimize stress concentration near the end of the spring structure. In addition, the edge slit SLe with the hook shape extends toward the center of the membrane 110, or toward the coupling plate 116 within the membrane 110. The edge slit SLe may be carving out a fillet in the membrane 110.

The pattern of the edge slit SLe may be designed based on the requirement(s). In this embodiment, as shown in FIG. 8, the spring structure 114 may have one first connecting end CE1 connected to the driving plate 112 and one second connecting end CE2 connected to the coupling plate 116, the spring structure 114 is between the first connecting end CE1 and the second connecting end CE2, the first connecting end CE1 may be between the first portion e1 of one of the edge slits SLe and the second portion e2 of another one of the edge slits SLe, and the second connecting end CE2 may be between two third portions e3 of two adjacent edge slits SLe, but not limited thereto. Optionally, as shown in FIG. 8, a connecting direction of the first connecting end CE1 is not parallel to a connecting direction of the second connecting end CE2, but not limited thereto. Moreover, in this embodiment, the slits SL may form a vortex pattern in top view, but not limited thereto. Furthermore, in FIG. 8, a portion of the driving plate 112 may overlap the actuator 120, but not limited thereto.

Figure 9:
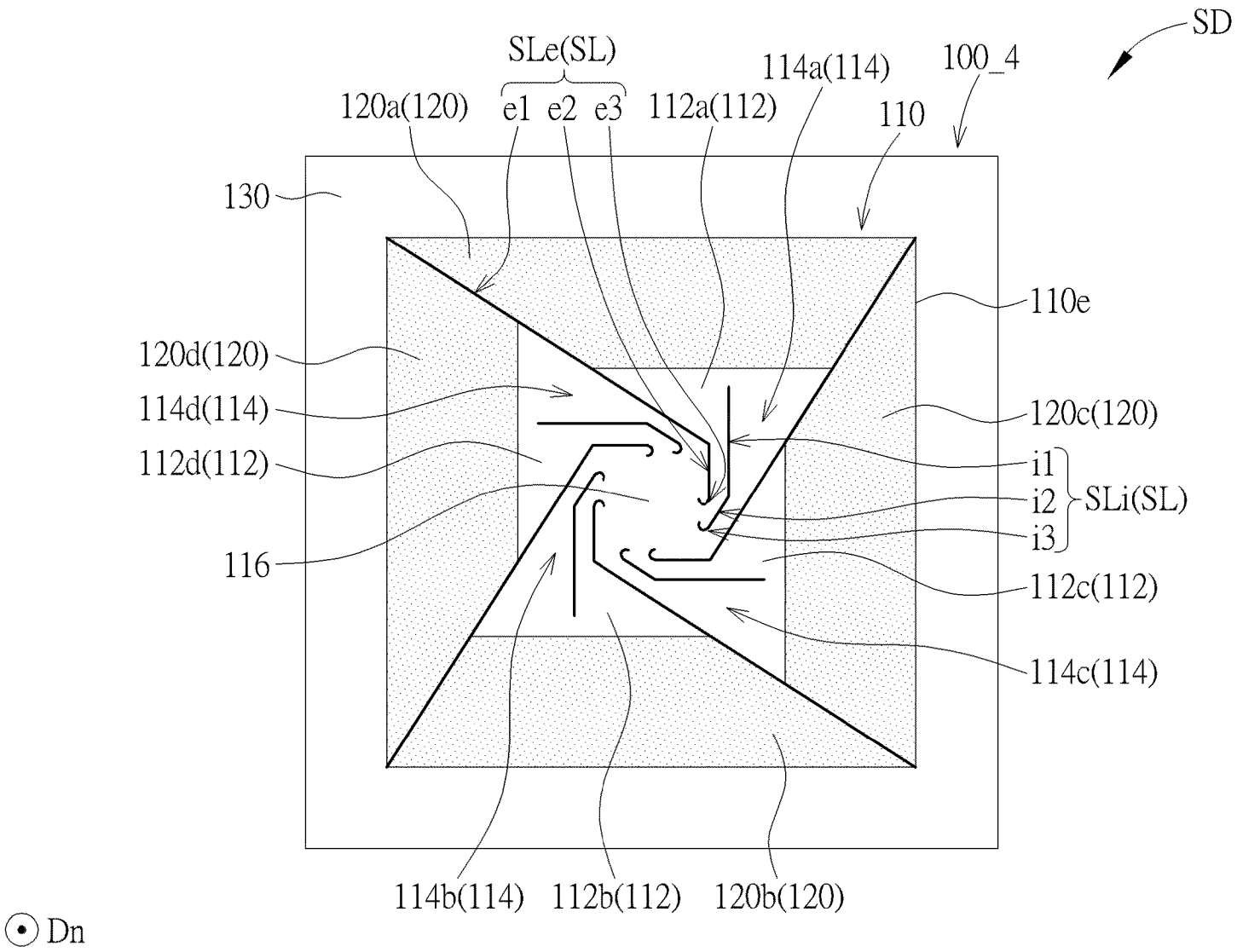
FIG. 9 is a schematic diagram of a top view illustrating a sound producing device according to a fourth embodiment of the present invention.
Figure 10:
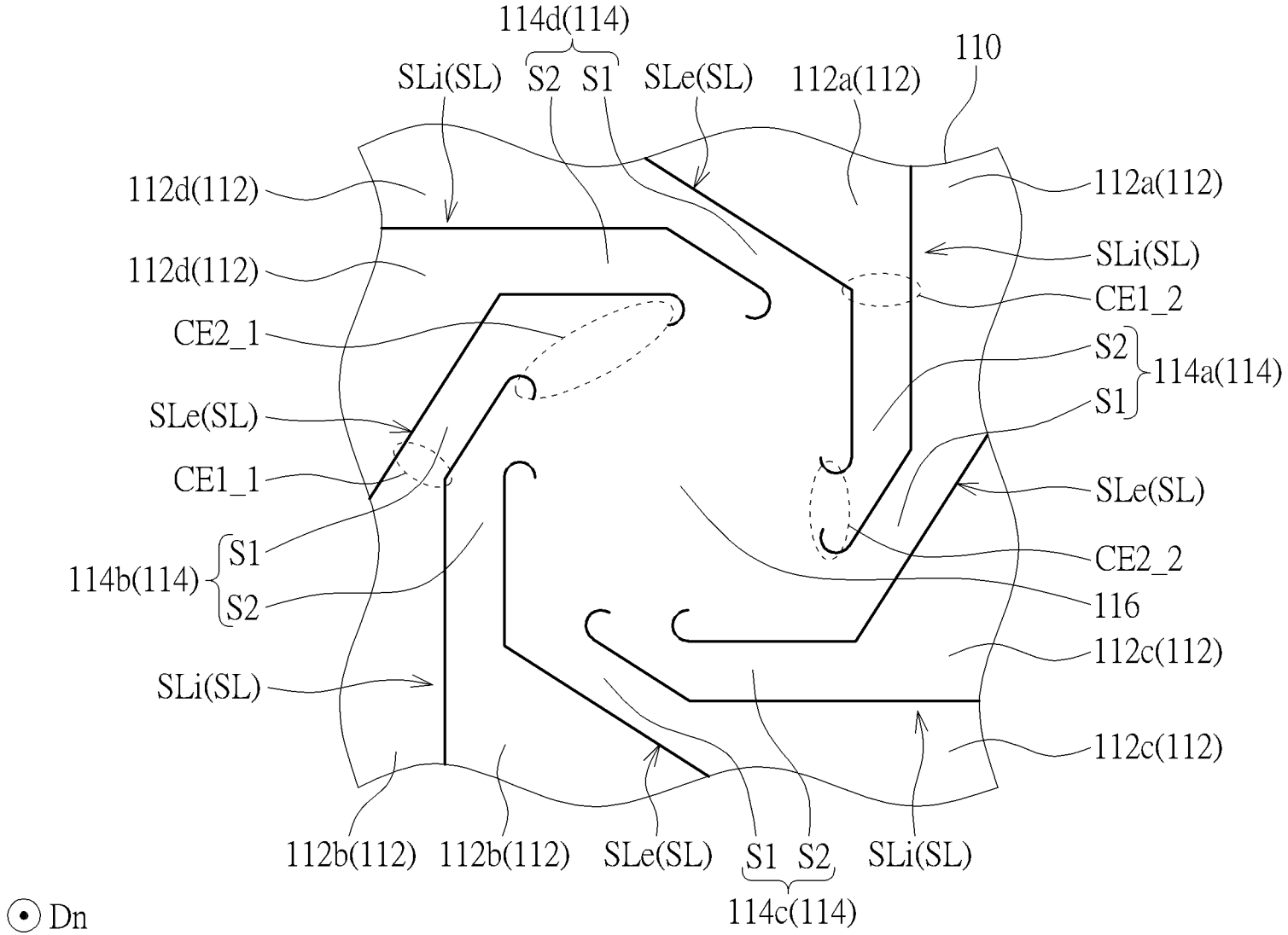
FIG. 10 is a enlarge diagram illustrating a center part of FIG. 9.

FIG. 9 is a schematic diagram of a top view illustrating a sound producing device according to a fourth embodiment of the present invention, and FIG. 10 is a enlarge diagram illustrating a center part of FIG. 9, wherein the sound producing chip 100_4 is the first type, and the sound producing chip 100_4 is not coated with a film, such as a film containing the polymer material having low Young's modulus (e.g., this film may be used to seal the slits). As shown in FIG. 9 and FIG. 10, a difference between the third embodiment (shown in FIG. 8) and this embodiment is the arrangement of the slits SL. In this embodiment, the slits SL may further include a plurality of internal slits SLi, and each internal slit SLi may be between two of the edge slits SLe, but not limited thereto. In FIG. 9, each internal slit SLi does not connected to the edge slit SLe and extends towards to the coupling plate 116 of the membrane 110, but not limited thereto. The pattern of the edge slit SLe and the pattern of the internal slit SLi may be designed based on the requirement(s). For example, each internal slit SLi of this embodiment may include a first section i1, a second section i2 connected to the first section i1 and a third section i3 connected to the second section i2, and the first section i1, the second section i2 and the third section i3 are arranged towards the inner of the membrane 110 in sequence, wherein in one of the internal slits SLi, an extending direction of the first section i1 which is a straight slit may be not parallel to an extending direction of the second section i2 which is another straight slit, and the third section i3 may be a curved slit (i.e., the internal slit SLi may be a combination of two straight slits and one curved slit), but not limited thereto. Moreover, in one of the internal slits SLi, an end of the first section i1 may be connected to the second section i2, and another end of the first section i1 may be situated at the driving plate 112 and not be connected to any other slit. As an example, in FIG. 9, the end of the first section i1 which is not connected to any other slit may be situated at the region of the driving plate 112 on which the actuator 120 is not disposed (i.e., the internal slits SLi may not be situated at the region of the driving plate 112 on which the actuator 120 is disposed), but not limited thereto. As another example, the end of the first section i1 which is not connected to any other slit may be situated at the region of the driving plate 112 on which the actuator 120 is disposed, but not limited thereto.

In FIG. 9 and FIG. 10, each spring structure 114 disposed between two adjacent edge slits SLe may be divided into two subdivisions S1 and S2 by one internal slit SLi, each of the subdivisions S1 and S2 may have a first connecting end (CE1_1, CE1_2) connected to the driving plate 112 and a second connecting end (CE2_1, CE2_2) connected to the coupling plate 116, and each of the subdivisions S1 and S2 is between its first connecting end (CE1_1, CE1_2) and its second connecting end (CE2_1, CE2_2). For example, the first connecting end CE1_1 of the subdivision S1 may be between the first portion e1 of one of the edge slits SLe and the second section i2 of one of the internal slits SLi, the second connecting end CE2_1 of the subdivision S1 may be between the third portion e3 of one of the edge slits SLe and the third section i3 of one of the internal slits SLi, the first connecting end CE1_2 of the subdivision S2 may be between the second portion e2 of one of the edge slits SLe and the first section i1 of one of the internal slits SLi, and the second connecting end CE2_2 of the subdivision S2 may be between the third portion e3 of one of the edge slits SLe and the third section i3 of one of the internal slits SLi, but not limited thereto. Optionally, as shown in FIG. 9 and FIG. 10, in each subdivision S1, a connecting direction of the first connecting end CE1_1 is not parallel to a connecting direction of the second connecting end CE2_1; in each subdivision S2, a connecting direction of the first connecting end CE1_2 is not parallel to a connecting direction of the second connecting end CE2_2, but not limited thereto. Moreover, in this embodiment, the slits SL may form a vortex pattern in top view, but not limited thereto.

Figure 11:
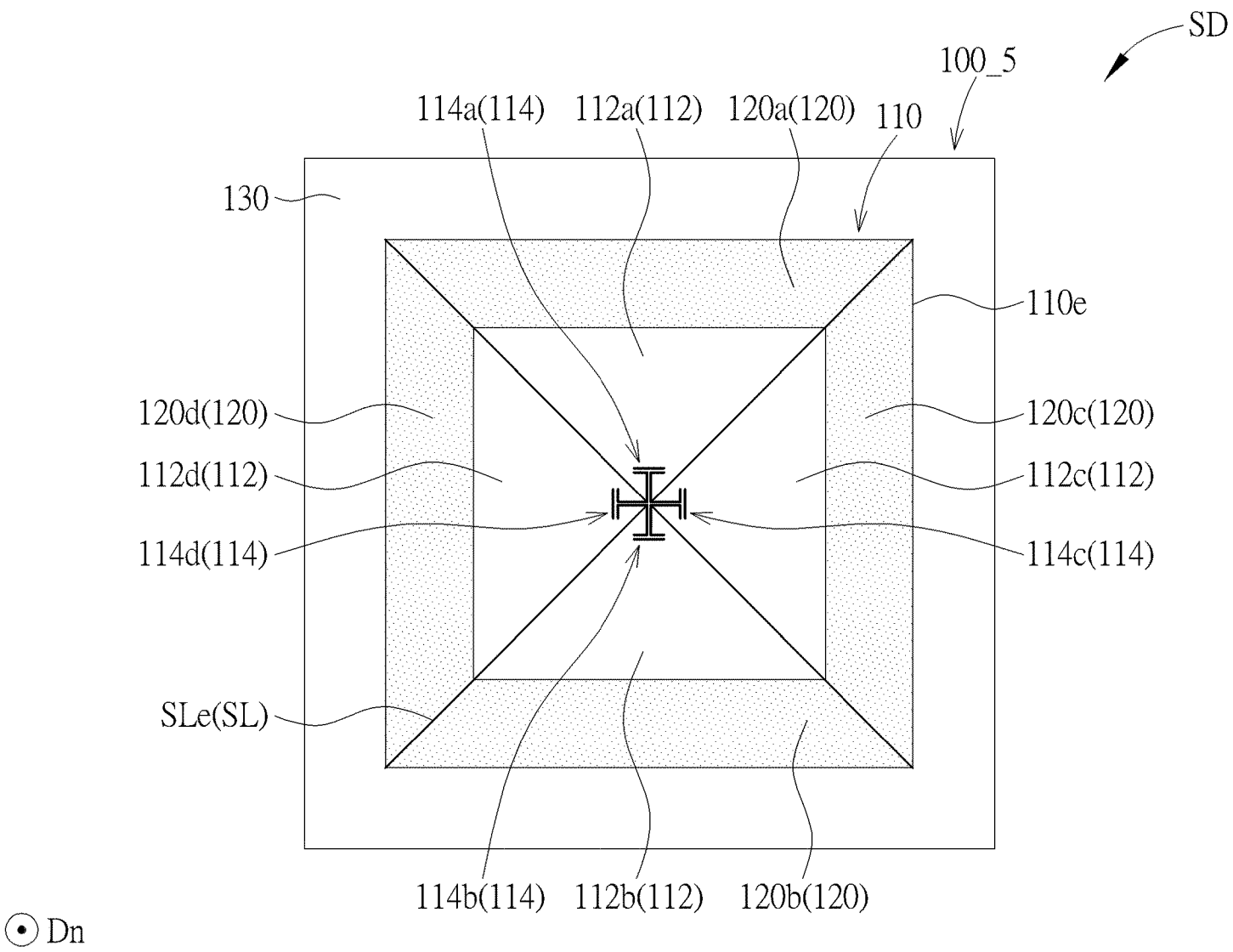
FIG. 11 is a schematic diagram of a top view illustrating a sound producing device according to a fifth embodiment of the present invention.
Figure 12:
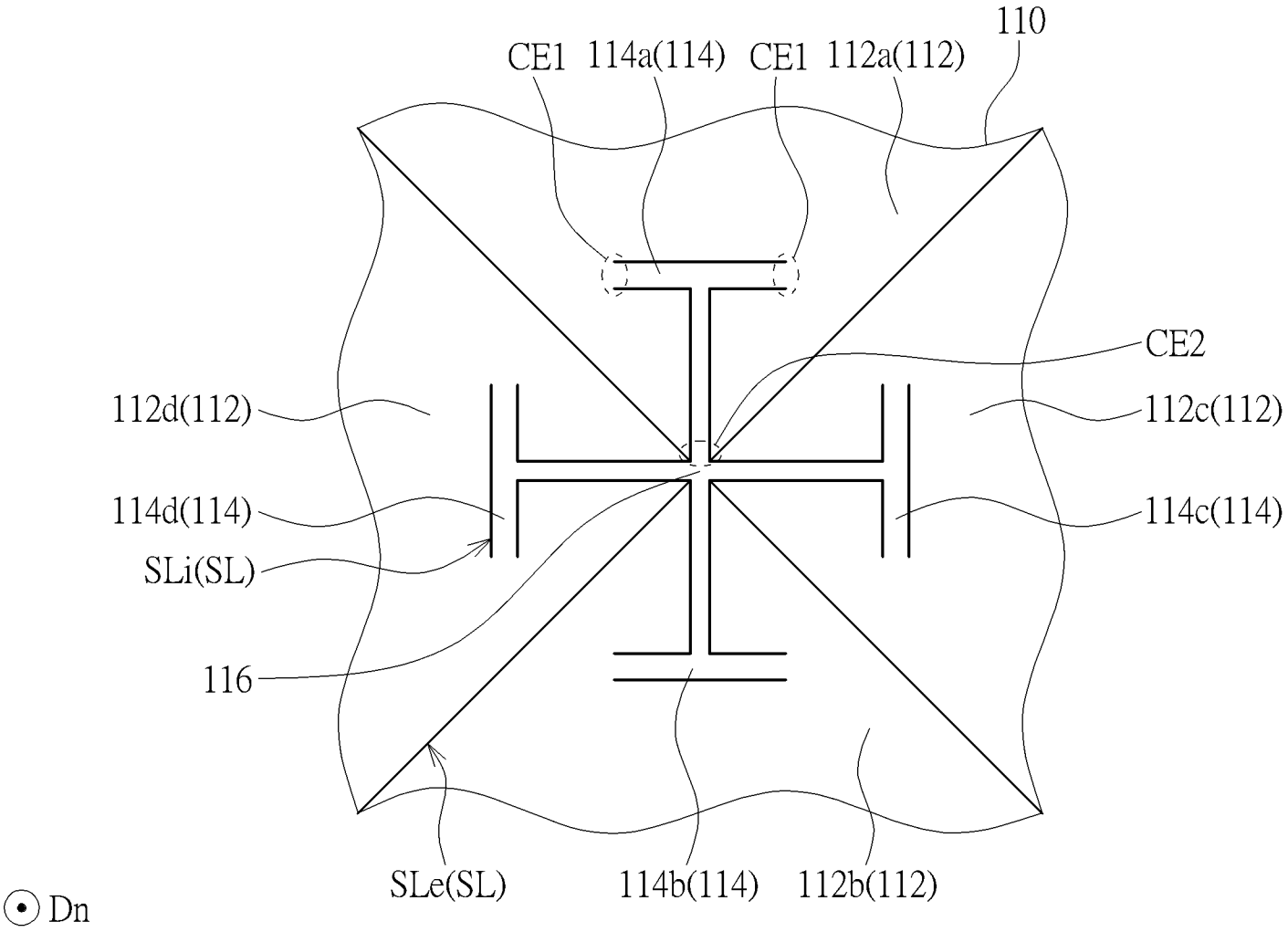
FIG. 12 is a enlarge diagram illustrating a center part of FIG. 11.

Referring to FIG. 11 and FIG. 12, FIG. 11 is a schematic diagram of a top view illustrating a sound producing device according to a fifth embodiment of the present invention, FIG. 12 is a enlarge diagram illustrating a center part of FIG. 11, wherein the sound producing chip 100_5 is the first type, and the sound producing chip 100_5 is not coated with a film, such as a film containing the polymer material having low Young's modulus (e.g., this film may be used to seal the slits). As shown in FIG. 11 and FIG. 12, a difference between the first embodiment (shown in FIG. 4 and FIG. 5) and this embodiment is the arrangement of the slits SL. In FIG. 11 and FIG. 12, the internal slit SLi connected to the edge slit SLe may be an L-shape (i.e., a combination of two straight slits), the internal slit SLi not connected to the edge slit SLe may be a l-shape (i.e., a straight slit), and the l-shaped internal slit SLi may be parallel to a portion of the L-shaped internal slit SLi, but not limited thereto. In this embodiment, the spring structures 114 of this embodiment may be formed because of the internal slits SLi. As shown in FIG. 11 and FIG. 12, each spring structure 114 may be fashioned by forming one l-shaped internal slit SLi and two L-shaped internal slits SLi, but not limited thereto. Optionally, as shown in FIG. 12, a connecting direction of the first connecting end CE1 of the spring structure 114 is not parallel to a connecting direction of the second connecting end CE2 of the spring structure 114, but not limited thereto. Moreover, as shown in FIG. 11 and FIG. 12, the area of the coupling plate 116 may be much smaller than the area of the driving plate 112, but not limited thereto. Furthermore, in FIG. 11, a portion of the driving plate 112 may overlap the actuator 120, but not limited thereto.

Figure 13:
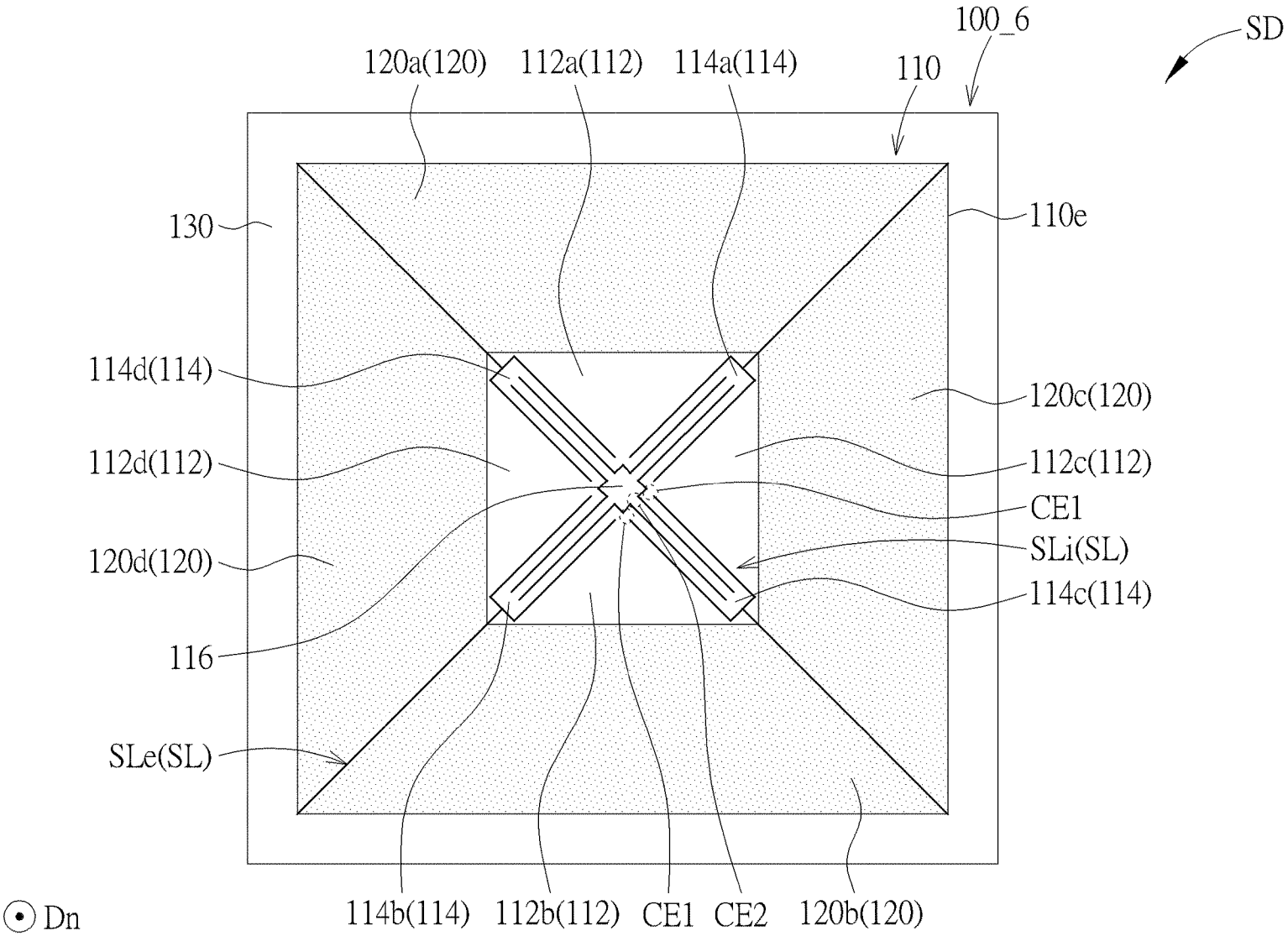
FIG. 13 is a schematic diagram of a top view illustrating a sound producing device according to a sixth embodiment of the present invention.

FIG. 13 is a schematic diagram of a top view illustrating a sound producing device according to a sixth embodiment of the present invention, wherein the sound producing chip 100_6 is the first type, and the sound producing chip 100_6 is not coated with a film, such as a film containing the polymer material having low Young's modulus (e.g., this film may be used to seal the slits). As shown in FIG. 13, a difference between the first embodiment (shown in FIG. 4 and FIG. 5) and this embodiment is the arrangement of the slits SL. In FIG. 13, the internal slit SLi connected to the edge slit SLe is an L-shape (i.e., a combination of two straight slits), the internal slit SLi not connected to the edge slit SLe is a W-shape (i.e., a combination of four straight slits), and a portion of the W-shaped internal slit SLi is parallel to a portion of the L-shaped internal slit SLi, but not limited thereto. In this embodiment, the spring structures 114 of this embodiment are formed because of the internal slits SLi. As shown in FIG. 13, each spring structure 114 is fashioned by forming two L-shape internal slits SLi and two W-shaped internal slits SLi, such that the spring structure 114 shown in FIG. 13 is an M-shape, but not limited thereto. Note that, the first spring structure 114*a* is connected to the coupling plate 116, the first driving part 112*a* and the third driving part 112*c*, the second spring structure 114*b* is connected to the coupling plate 116, the second driving part 112*b* and the fourth driving part 112*d*, the third spring structure 114*c* is connected to the coupling plate 116, the second driving part 112*b* and the third driving part 112*c*, and the fourth spring structure 114*d* is connected to the coupling plate 116, the first driving part 112*a* and the fourth driving part 112*d*, but not limited thereto. Optionally, as shown in FIG. 13, a connecting direction of the first connecting end CE1 of the spring structure 114 is not parallel to a connecting direction of the second connecting end CE2 of the spring structure 114, but not limited thereto. Moreover, as shown in FIG. 13, the area of the coupling plate 116 may be much smaller than the area of the driving plate 112, but not limited thereto. Furthermore, in FIG. 13, a portion of the driving plate 112 may overlap the actuator 120, but not limited thereto.

Note that, the arrangements of the slits SL described in the above embodiments are examples. Any other suitable arrangement of the slits SL which can increase the displacement of the membrane 110 and/or release the residual stress of the membrane 110 can be used in the present invention.

Figure 14:
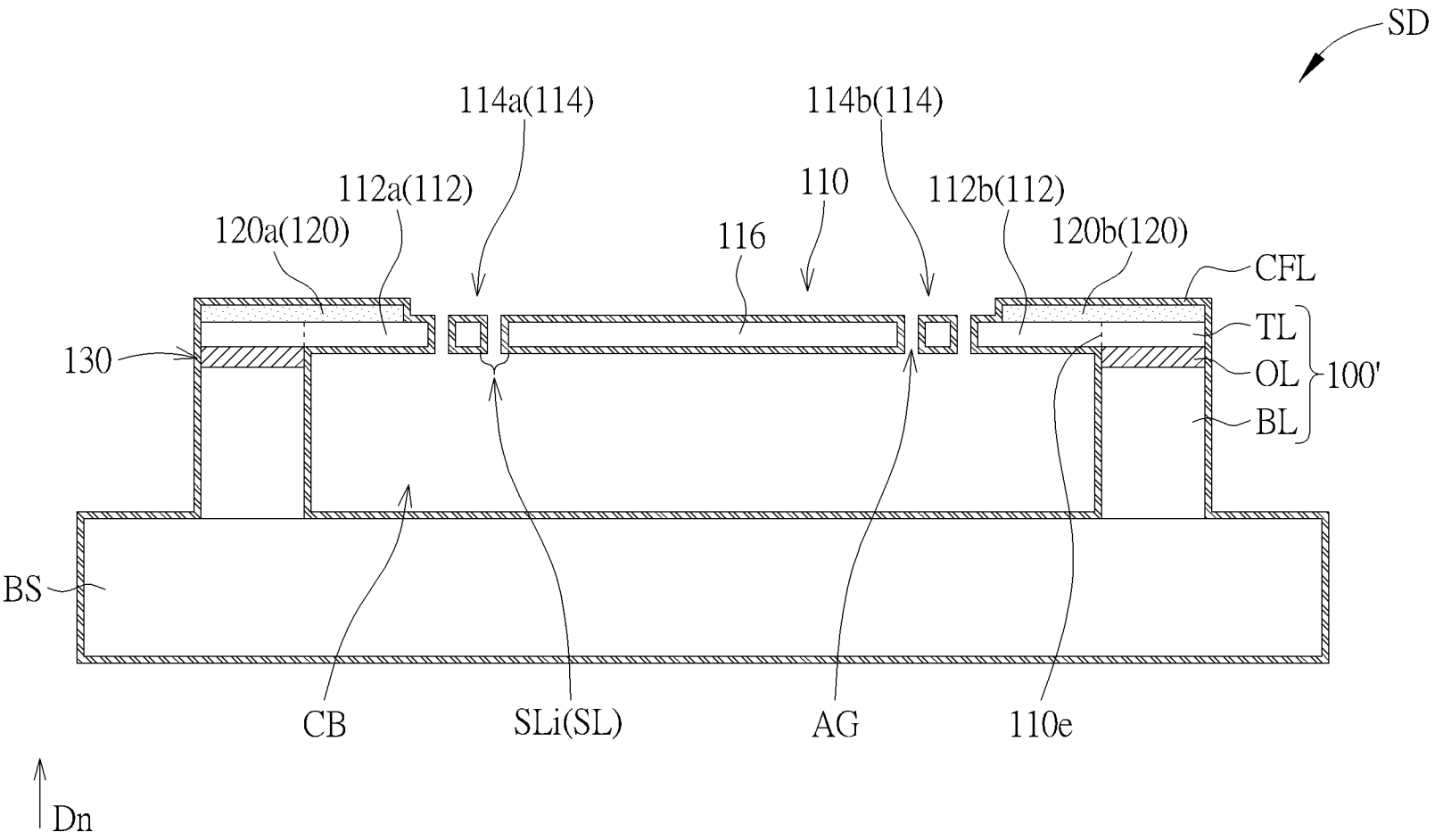
FIG. 14 is a schematic diagram of a cross sectional view illustrating a sound producing device according to a seventh embodiment of the present invention.
Figure 15:
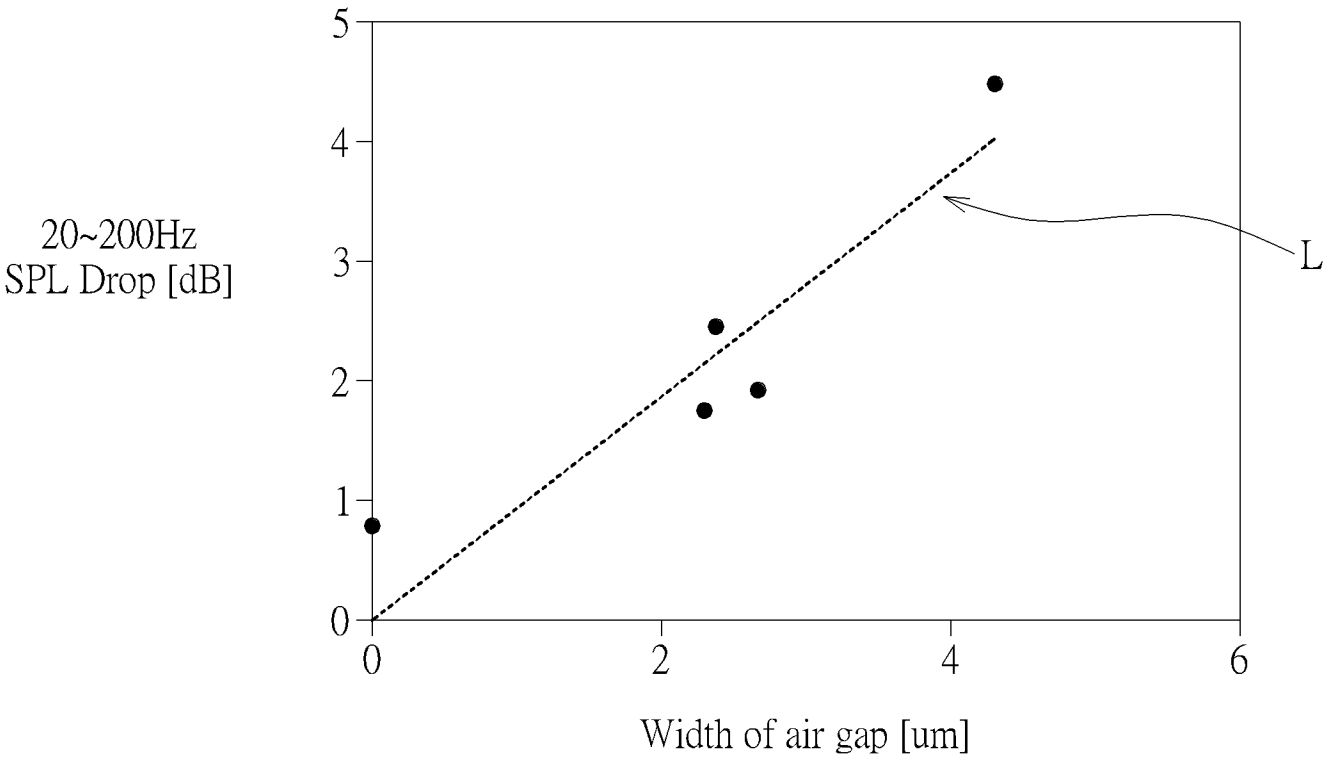
FIG. 15 is a schematic diagram illustrates a relation of a drop of sound pressure level and an air gap in a slit according to an embodiment of the present invention.

Referring to FIG. 14 and FIG. 15, FIG. 14 is a schematic diagram of a cross sectional view illustrating a sound producing device according to a seventh embodiment of the present invention, and FIG. 15 is a schematic diagram illustrates a relation of a drop of sound pressure level and an air gap in a slit according to an embodiment of the present invention. Note that, the sound producing chip 100' may be the first type, the second type (explained in the following embodiment) or any other suitable type. For example, if the sound producing chip 100' is the first type, the membrane 110 of the sound producing chip 100' may be referred to the above embodiments, or the membrane 110 of the sound producing chip 100' may be a variant embodiment without departing from the spirit of the present invention, but not limited thereto. As shown in FIG. 14, the sound producing device SD may further include a conformal layer CFL covering the sound producing chip 100'. In this embodiment, the sound producing chip 100' is coated with the conformal layer CFL, but not limited thereto. Optionally, the base BS is also coated with or covered by the conformal layer CFL, but not limited thereto. In addition, the conformal layer CFL may include any suitable dielectric material, such as silicon dioxide, silicon nitride, and/or polymer material, such as polyimide or Parylene-C, but not limited thereto. The conformal layer CFL containing the dielectric material may be formed by an atomic layer deposition (ALD) or a chemical vapor deposition (CVD), and the conformal layer CFL containing the dielectric material may be formed by a vapor deposition, such that the conformal layer CFL may be a deposited layer, but not limited thereto.

The conformal layer CFL is configured to seal the slit(s) or decrease an air gap AG existing in the slit SL, so as to reduce the leak of the air through the slit SL, thereby overcoming the SPL drop at the low frequency (e.g., ranging from 20 Hz to 200 Hz) of the sound wave. In some embodiments, as shown in FIG. 14, a portion of the conformal layer CFL and the air gap AG may exist in the slit SL, but not limited thereto. In some embodiments, a portion of the conformal layer CFL may exist in the slit SL, such that the slit SL may be sealed by the conformal layer CFL, but not limited thereto. As shown in FIG. 15, the SPL drop is substantially reduced as the width of the air gap AG is less (e.g., referring to a regression line L). Furthermore, in FIG. 15, when the slit SL is sealed by the conformal layer CFL to make the air gap AG absent in the slit SL, the SPL drop is least. Thus, in order to reduce the SPL drop at the low frequency of the sound wave, in some embodiments, a width of the air gap AG may be less than 2 μm if the air gap AG exists in the slit SL (the width of the air gap AG is measured under the condition that the sound producing device SD does not operate), or the slit SL is sealed by the conformal layer CFL to make the air gap AG absent in the slit SL, but not limited thereto.

Figure 16:
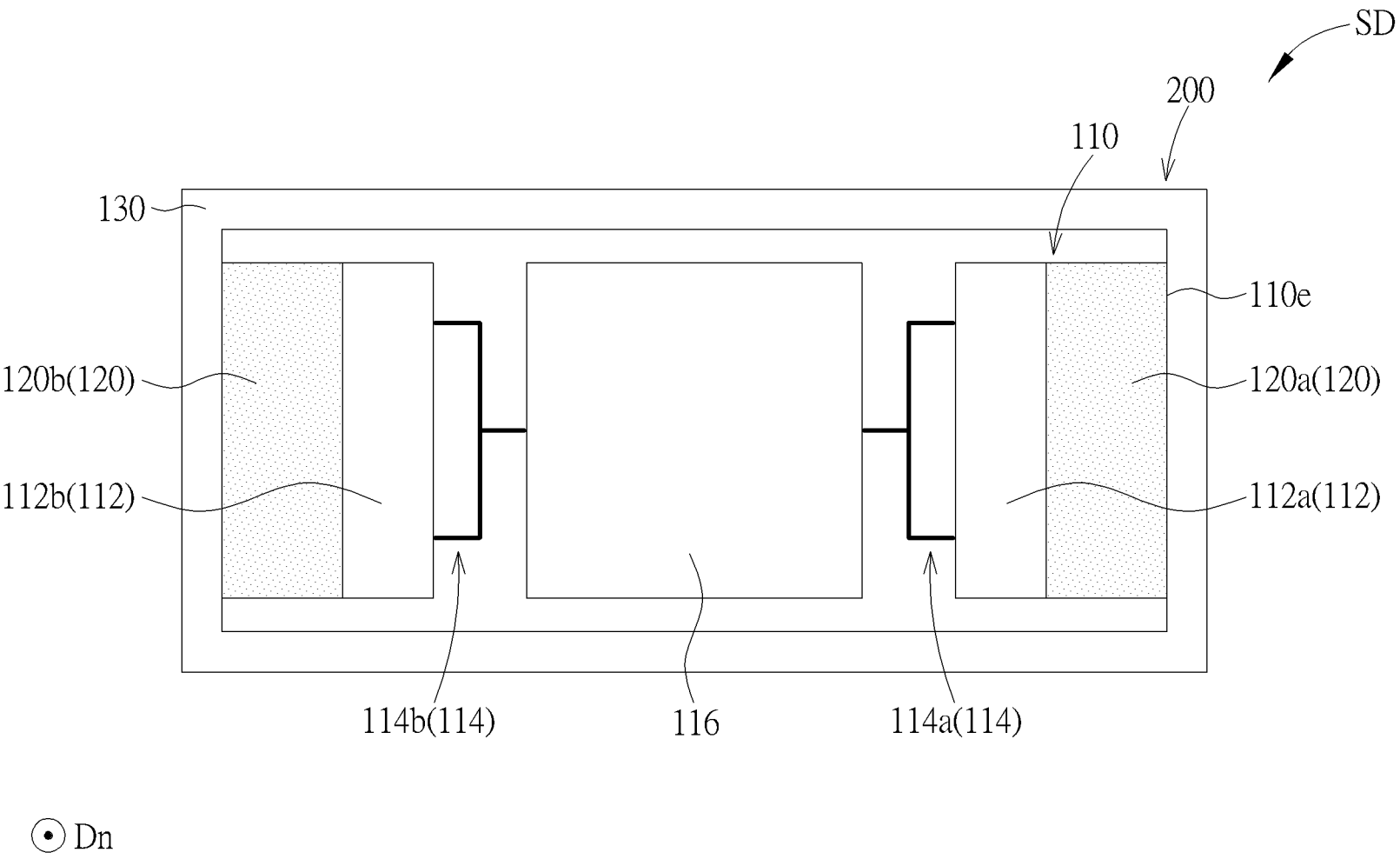
FIG. 16 is a schematic diagram of a top view illustrating a sound producing device having a second type of a sound producing chip according to an embodiment of the present invention.

FIG. 16 is a schematic diagram of a top view illustrating a sound producing device having a second type of a sound producing chip according to an embodiment of the present invention. As shown in FIG. 16, compared with the first type of the sound producing chip 100, the actuator 120 in the second type of the sound producing chip 200 may not surround the coupling plate 116. In detail, the actuator 120 of this embodiment may include a first part 120*a* and a second part 120*b*, and the first part 120*a* and the second part 120*b* may be disposed on opposite sides of the coupling plate 116. Correspondingly, the driving plate 112 of the membrane 110 may include a first driving part 112*a* on which the first part 120*a* of the actuator 120 is disposed and a second driving part 112*b* on which the second part 120*b* of the actuator 120 is disposed, and the first driving part 112*a* and the second driving part 112*b* may be disposed on opposite sides of the coupling plate 116. Correspondingly, the sound producing chip 200 may include a first spring structure 114*a* and a second spring structure 114*b* (a plurality of spring structures 114), and the first spring structure 114*a* and the second spring structure 114*b* may be disposed on opposite sides of the coupling plate 116, wherein the first spring structure 114*a* is connected between the coupling plate 116 and the first driving part 112*a*, the second spring structure 114*b* is connected between the coupling plate 116 and the second driving part 112*b*. In other words, the membrane 110 may be actuated by the actuator 120 from two directions.

In some embodiments, the spring structure 114 may be referred to the arrangements of the slits SL described in the above, but not limited thereto. In some embodiments, any other suitable arrangement of the slits SL which can increase the displacement of the membrane 110 and/or release the residual stress of the membrane 110 can be used in the present invention.

Figure 17:
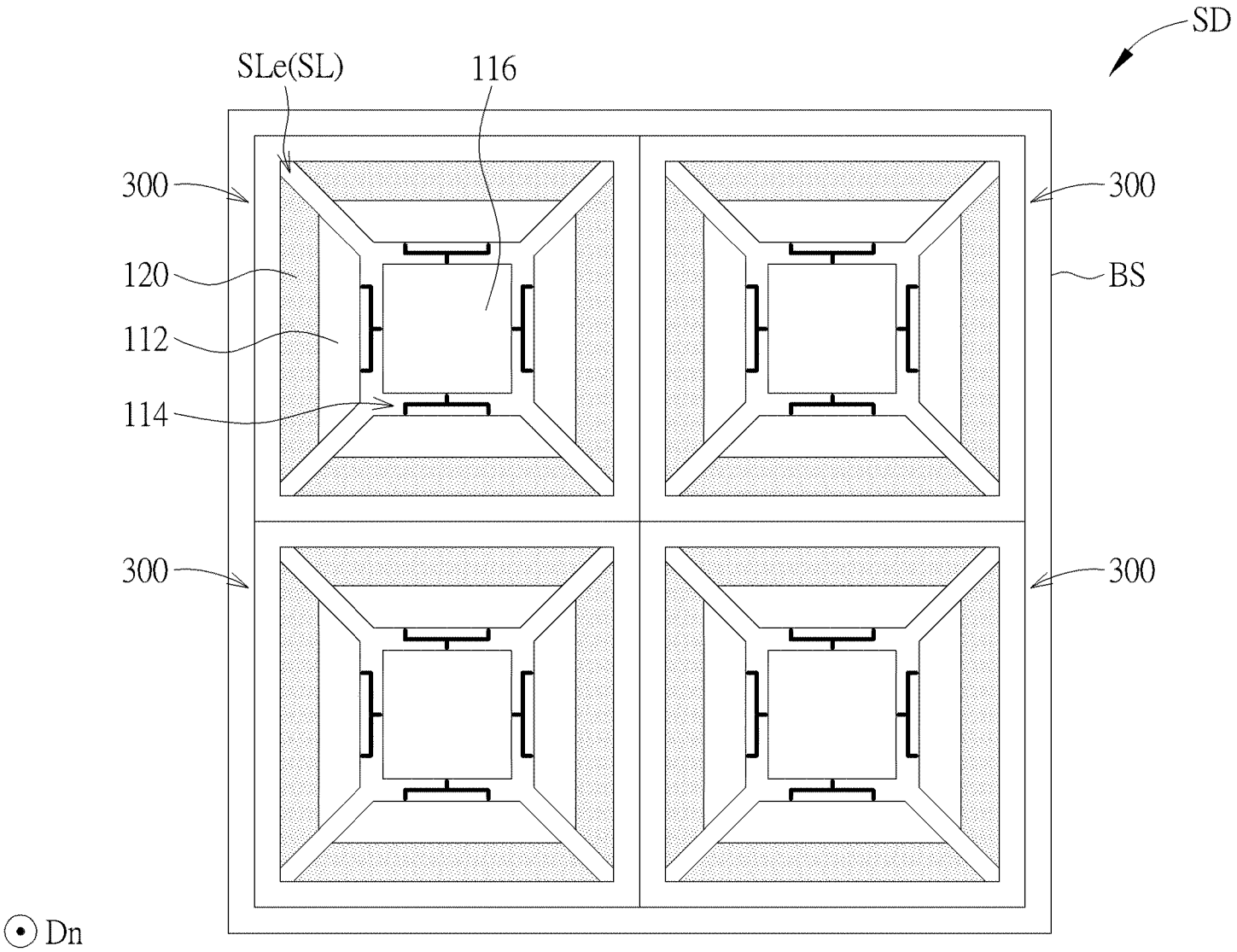
FIG. 17 is a schematic diagram of a top view illustrating a sound producing device according to an eighth embodiment of the present invention.

FIG. 17 is a schematic diagram of a top view illustrating a sound producing device according to an eighth embodiment of the present invention.

As shown in FIG. 17, the sound producing device SD may include a plurality of membranes. The sound producing device SD may be manufactured simultaneously (or disposed) on the base silicon layer BL as one single sound producing chip 300 or alternatively disposed on the base BS with multiple sound producing chips 300. Each sound producing chip 300 serves as a sound producing unit to produce the sound wave, wherein the sound producing chips 300 may be the same or different. In the present invention, each sound producing chip 300 may be the first type, the second type or any other suitable type.

In one perspective, the sound producing device SD comprises one single sound producing chip 300, and the sound producing chip 300 comprises a plurality of sound producing units, and each sound producing unit can be realized by the sound producing chip 100 illustrated in FIG. 1 (i.e., one single sound producing chip 300 may include a plurality of membranes 110 and a plurality of actuators 120). In another perspective, the sound producing device SD comprises multiple sound producing chips 300, and each sound producing chip 300 can be realized by the sound producing chip 100 illustrated in FIG. 1.

Note that, FIG. 17 is for illustrative purpose, which demonstrates a concept of the sound producing device SD comprising multiple sound producing units (or multiple sound producing chips). Construct of each membrane (cell) is not limited. For example, the sound producing unit (or sound producing chip 300) may also be realized by one of the sound producing chips 100_1 (illustrated in FIG. 4), 100_2 (illustrated in FIG. 7), 100_3 (illustrated in FIG. 8), 100_4 (illustrated in FIG. 9), 100_5 (illustrated in FIG. 11), 100_6 (illustrated in FIG. 13), and 200 (illustrated in FIG. 16) in the above, in addition to the sound producing chip 100 (illustrated in FIG. 1). Even more, the sound producing unit (or sound producing chip 300) may be a variant embodiment without departing from the spirit of the present invention, which is also within the scope of the present invention. For example, in FIG. 17, each sound producing chip 300 may be the first type of sound producing chip similar to the FIG. 1, but not limited thereto.

In another embodiment, the sound producing device SD may include one sound producing chip containing a plurality of sound producing units to produce the sound wave. In detail, one sound producing chip may include a plurality of membranes 110, a plurality of actuators 120 and an anchor structure 130, and a combination of one membrane 110 and one actuator 120 serves as one sound producing unit.

In the following, the details of a method of manufacturing a sound producing chip SPC will be further exemplarily explained. Note that the manufacturing method is not limited by the following embodiments which are exemplarily provided, and the manufacturing method may manufacture the sound producing chip SPC which is the first type, the second type or any other suitable type. Note that in the following manufacturing method, the actuator 120 in the sound producing chip SPC may be a piezoelectric actuator for example, but not limited thereto. Any suitable type actuator 120 can be used in the sound producing chip SPC.

In the following manufacturing method, the forming process may include atomic layer deposition (ALD), a chemical vapor deposition (CVD) and other suitable process(es) or a combination thereof. The patterning process may include such as a photolithography, an etching process, any other suitable process(es) or a combination thereof.

Figure 18:
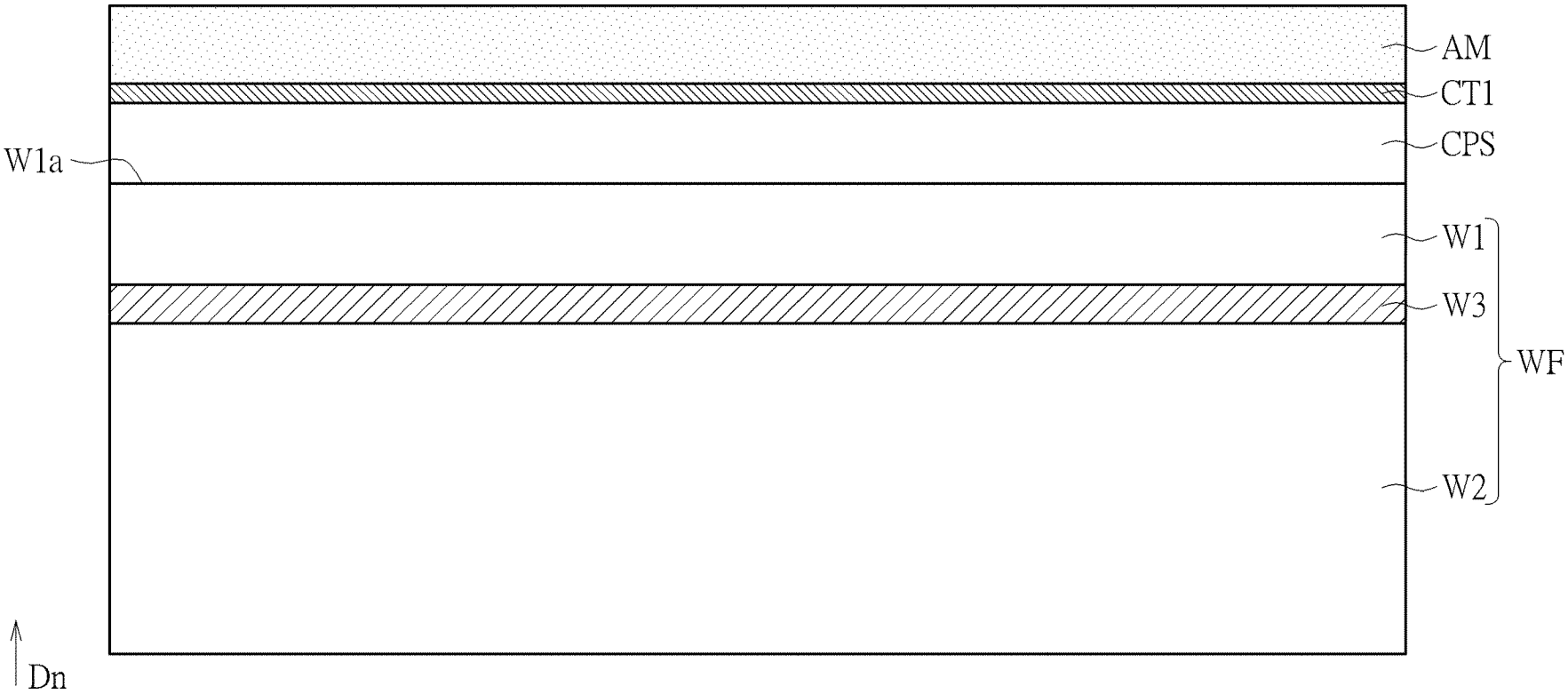
FIG. 18 to FIG. 24 are schematic diagrams illustrating structures at different stages of a method of manufacturing a sound producing chip according to an embodiment of the present invention.

Referring to FIG. 18 to FIG. 24, FIG. 18 to FIG. 24 are schematic diagrams illustrating structures at different stages of a method of manufacturing a sound producing chip according to an embodiment of the present invention. In this embodiment, the sound producing chip SPC may be manufactured by at least one semiconductor process to be a MEMS chip, but not limited thereto. As shown in FIG. 18, a wafer WF is provided, wherein the wafer WF includes a first layer W1, an insulating layer W3 and a second layer W2, wherein the insulating layer W3 is formed between the first layer W1 and the second layer W2.

The first layer W1, the insulating layer W3 and the second layer W2 may individually include any suitable material, such that the wafer WF may be any suitable type. For instance, the first layer W1 and the second layer W2 may individually include silicon (e.g., single crystalline silicon or poly-crystalline silicon), silicon carbide, germanium, gallium nitride, gallium arsenide, stainless steel, and other suitable high stiffness material or a combination thereof. In some embodiments, the first layer W1 may include single crystalline silicon, such that the wafer WF is a silicon on insulator (SOI) wafer, but not limited thereto. In some embodiments, the first layer W1 may include poly-crystalline silicon, such that the wafer WF is a polysilicon on insulator (POI) wafer, but not limited thereto. For instance, the insulating layer W3 may include oxide, such as silicon oxide (e.g., silicon dioxide), but not limited thereto.

The thicknesses of the first layer W1, the insulating layer W3 and the second layer W2 may be individually adjusted based on requirement(s). For example, the thickness of the first layer W1 may be 5 μm, and the thickness of the second layer W2 may be 350 μm, but not limited thereto.

In FIG. 18, a compensation oxide layer CPS may be optionally formed on a first side of the wafer WF, wherein the first side is upper than a top surface W1*a* of the first layer W1 opposite to the second layer W2, such that the first layer W1 is between the compensation oxide layer CPS and the second layer W2. The material of oxide contained in the compensation oxide layer CPS and the thickness of the compensation oxide layer CPS may be designed based on requirement(s).

In FIG. 18, a first conductive layer CT1 and an actuating material AM may be formed on the first side of the wafer WF (on the first layer W1) in sequence, such that the first conductive layer CT1 may be between the actuating material AM and the first layer W1 (e.g., and/or between the actuating material AM and the compensation oxide layer CPS). In some embodiments, the first conductive layer CT1 is in contact with the actuating material AM.

The first conductive layer CT1 may include any suitable conductive material, and the actuating material AM may include any suitable material. In some embodiments, the first conductive layer CT1 may include metal (such as platinum), and the actuating material AM may include a piezoelectric material, but not limited thereto. For example, the piezoelectric material may include such as a lead-zirconate-titanate (PZT) material, but not limited thereto. Moreover, the thicknesses of the first conductive layer CT1 and the actuating material AM may be individually adjusted based on requirement(s).

Figure 19:
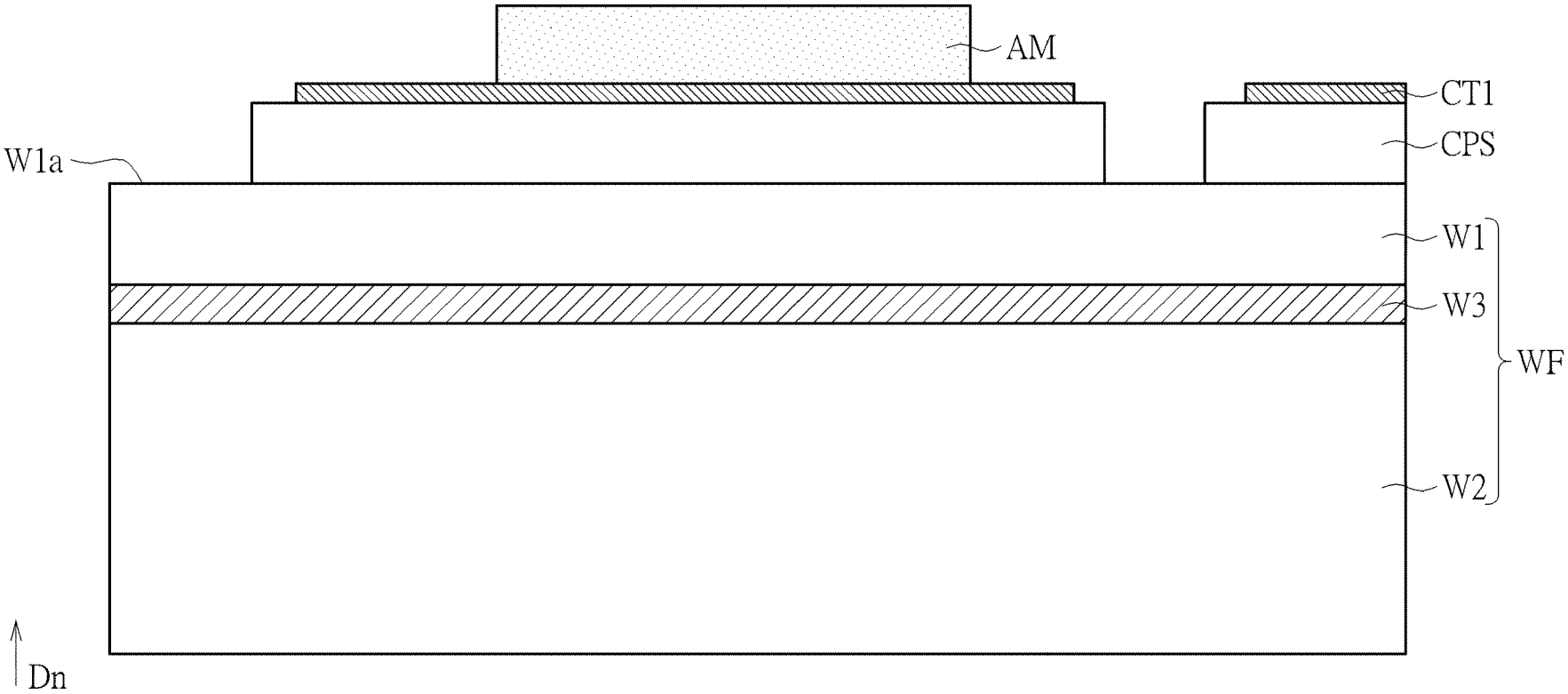

As shown in FIG. 19, the actuating material AM, the first conductive layer CT1 and the compensation oxide layer CPS may be patterned. In some embodiments, the actuating material AM, the first conductive layer CT1 and the compensation oxide layer CPS may be patterned in sequence.

Figure 20:
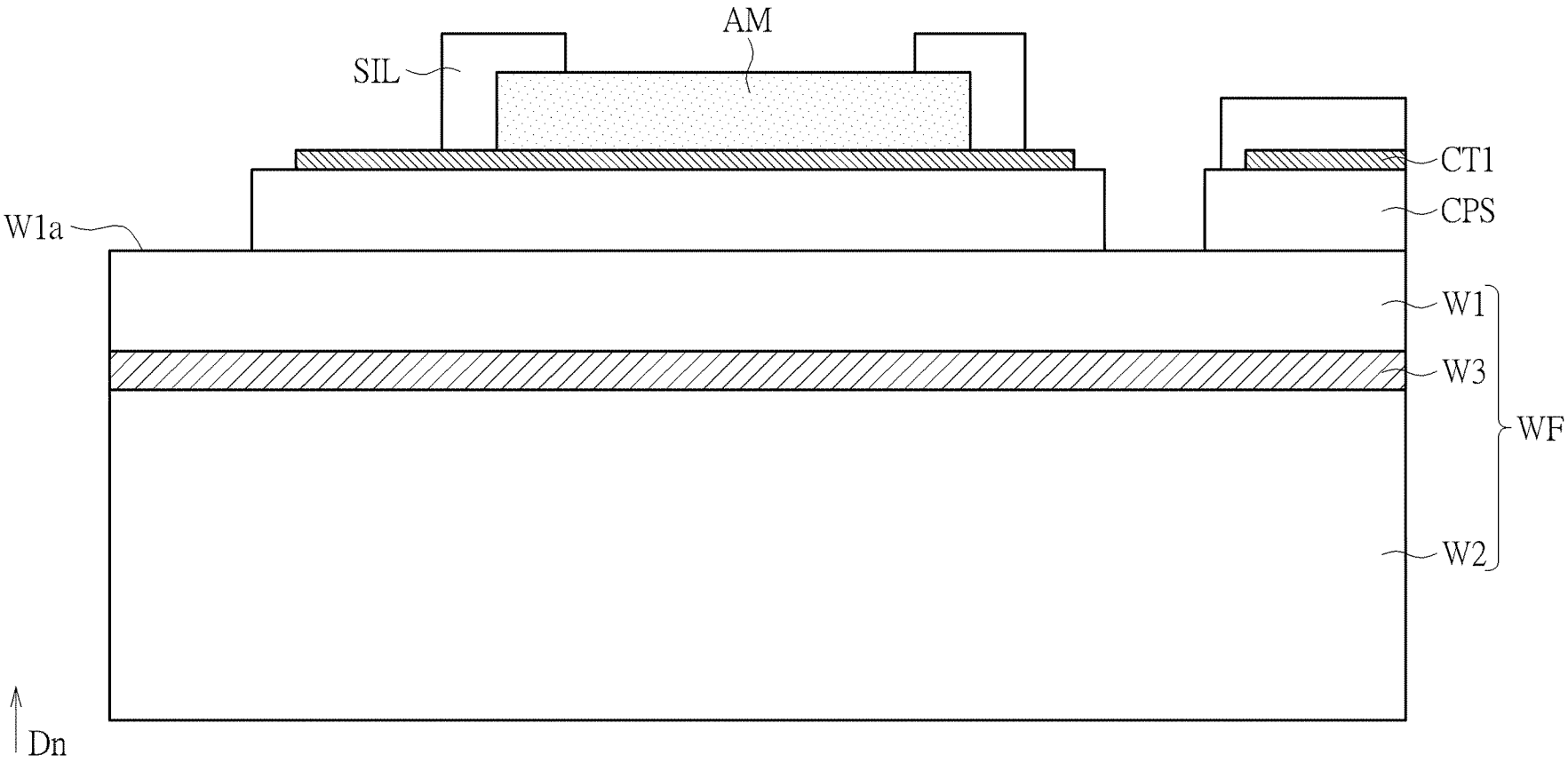

As shown in FIG. 20, a separating insulating layer SIL may be formed on the actuating material AM and be patterned. The thickness of the separating insulating layer SIL and the material of the separating insulating layer SIL may be designed based on requirement(s). For instance, the material of the separating insulating layer SIL may be oxide, but not limited thereto.

Figure 21:
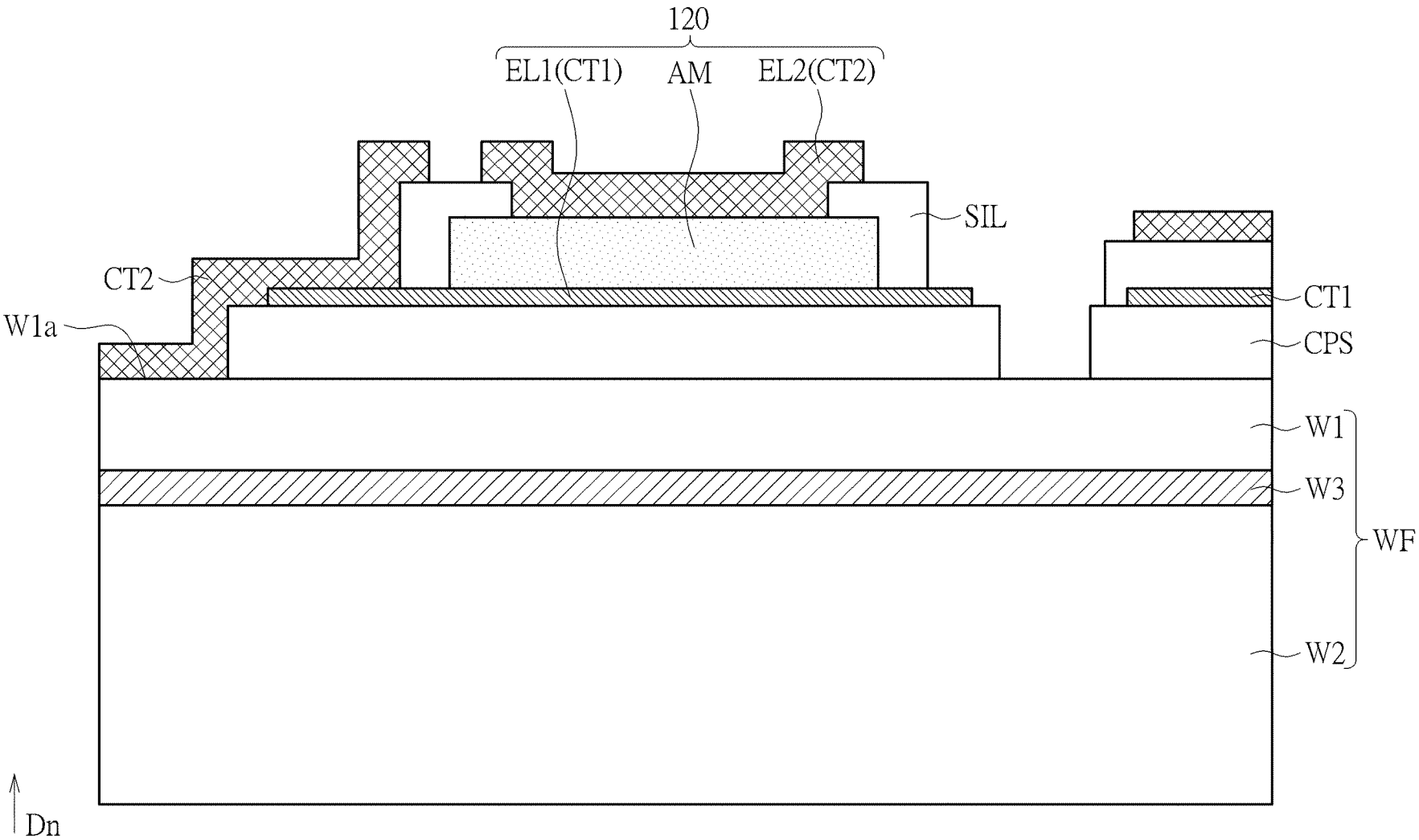

As shown in FIG. 21, a second conductive layer CT2 may be formed on the actuating material AM and the separating insulating layer SIL, and then, the second conductive layer CT2 may be patterned. The thickness of the second conductive layer CT2 and the material of the second conductive layer CT2 may be designed based on requirement(s). For instance, the second conductive layer CT2 may include metal (such as platinum), but not limited thereto.

The patterned first conductive layer CT1 functions as the first electrode EL1 for the actuator 120, the patterned second conductive layer CT2 functions as the second electrode EL2 for the actuator 120, and the actuating material AM, the first electrode EL1 and the second electrode EL2 may be components in the actuator 120 in the sound producing chip SPC, so as to make the actuator 120 be a piezoelectric actuator. For example, the first electrode EL1 and the second electrode EL2 are in contact with the actuating material AM, but not limited thereto.

In FIG. 21, the separating insulating layer SIL may be configured to separate at least a portion of the first conductive layer CT1 from at least a portion of the second conductive layer CT2.

Figure 22:
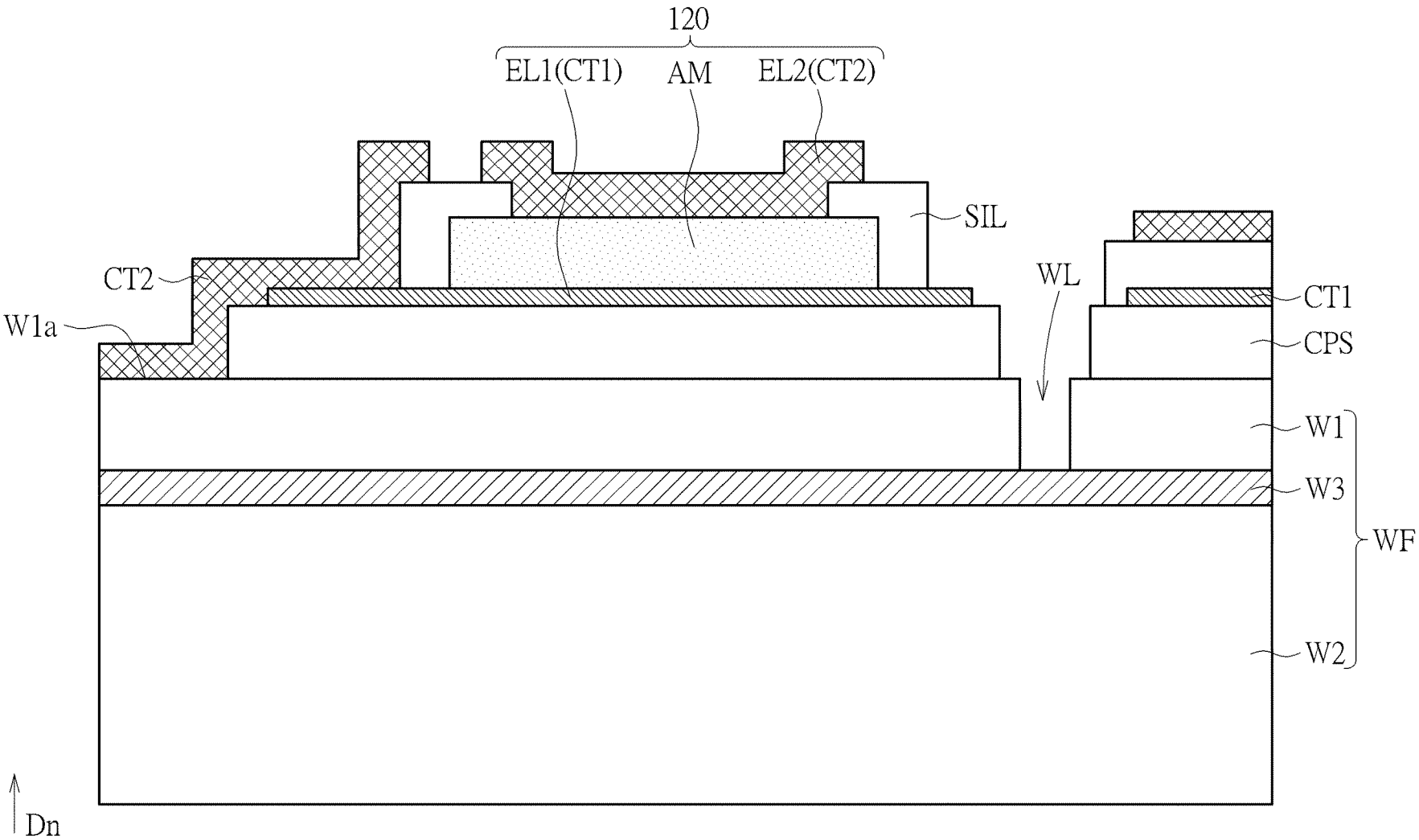

As shown in FIG. 22, the first layer W1 of the wafer WF may be patterned, so as to form a trench line WL. In FIG. 22, the trench line WL is a portion where the first layer W1 is removed. That is to say, the trench line WL is between two parts of the first layer W1.

Figure 23:
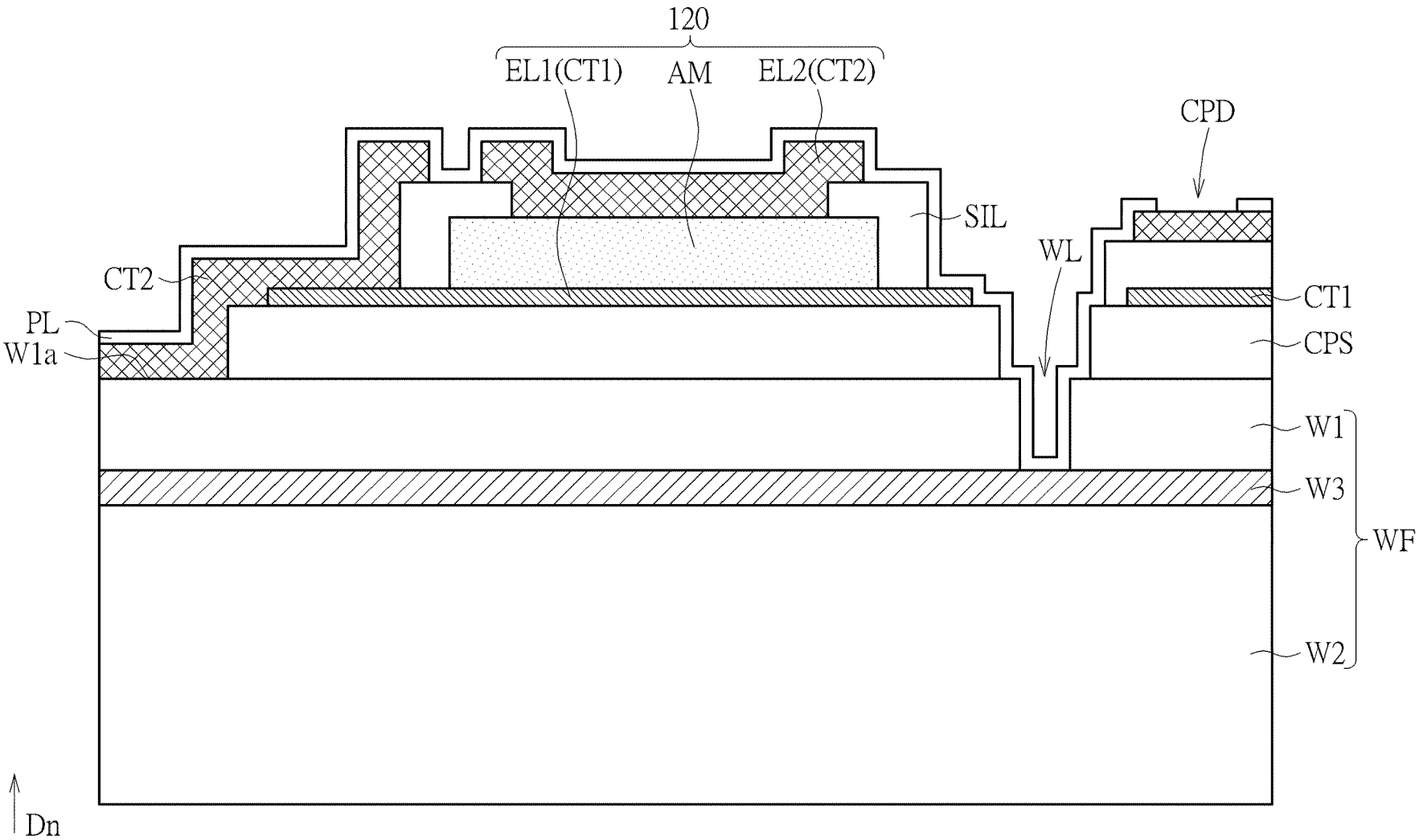

As shown in FIG. 23, a protection layer PL may be optionally formed on the second conductive layer CT2, so as to cover the wafer WF, the first conductive layer CT1, the actuating material AM, the separating insulating layer SIL and the second conductive layer CT2. The protection layer PL may include any suitable material, and may have suitable thickness.

In some embodiments, the protection layer PL may be configured to protect the actuator 120 from ambient exposure and to ensure the reliability/stability of the actuator 120, but not limited thereto. In some embodiments, the protection layer PL may be the aforementioned conformal layer CFL shown in FIG. 14, but not limited thereto. In the present application, the protection layer PL and the conformal layer CFL may be used interchangeably.

Optionally, in FIG. 23, the protection layer PL may be patterned for exposing a portion of the second conductive layer CT2 and/or a portion of the first conductive layer CT1, so as to form a connecting pad CPD to be electrically connected to outer device.

Figure 24:
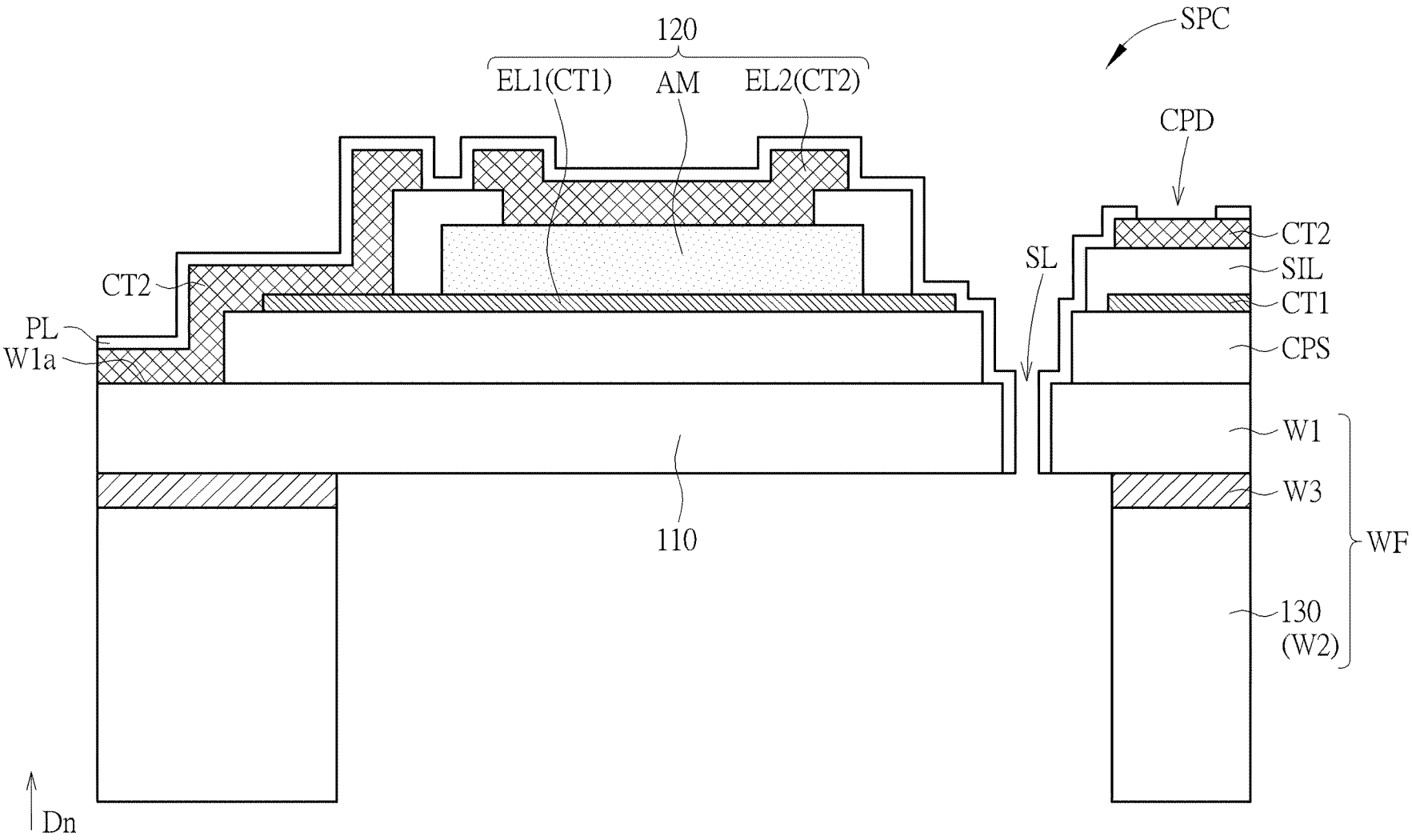

As shown in FIG. 24, the second layer W2 of the wafer WF may be patterned, so as to make the second layer W2 form at least one anchor structure 130 and to make the first layer W1 form the membrane 110 anchored by the anchor structure 130, wherein the membrane 110 includes the coupling plate 116 and the spring structure 114 connected to the coupling plate 116. In detail, the second layer W2 of the wafer WF may have a first part and a second part, the first part of the second layer W2 may be removed, and the second part of the second layer W2 may form the anchor structure 130. Since the first part of the second layer W2 is removed, the first layer W1 forms the membrane 110.

Optionally, in FIG. 24, since the insulating layer W3 of the wafer WF exists, after the second layer W2 of the wafer WF is patterned, a part of the insulating layer W3 corresponding to the first part of the second layer W2 may be removed also, so as to make the first layer W1 form the membrane 110, but not limited thereto.

In FIG. 24, since the first part of the second layer W2 is removed to make the first layer W1 form the membrane 110, the slit SL is formed within and penetrates through the membrane 110 because of the trench line WL. As the result, the spring structure 114 included in the membrane 110 is formed because of the slit SL. Since the slit SL is formed because of the trench line WL, the width of the trench line WL may be designed based on the requirement of the slit SL. For example, the width of the trench line WL may be less than or equal to 5 μm, less than or equal to 3 μm, or less than or equal to 2 μm, so as to make the slit SL have desire width, but not limited thereto. As shown in FIG. 24, the protection layer PL may be formed within the slit SL, i.e., (vertical portion of the protection layer PL) formed between side walls of the membrane 110. Forming the protection layer PL (or conformal layer) may reduce slit width or even (substantially) seal the slit, which is to reduce/minimize the SPL drop at the low frequency of the sound wave.

Figure 25:
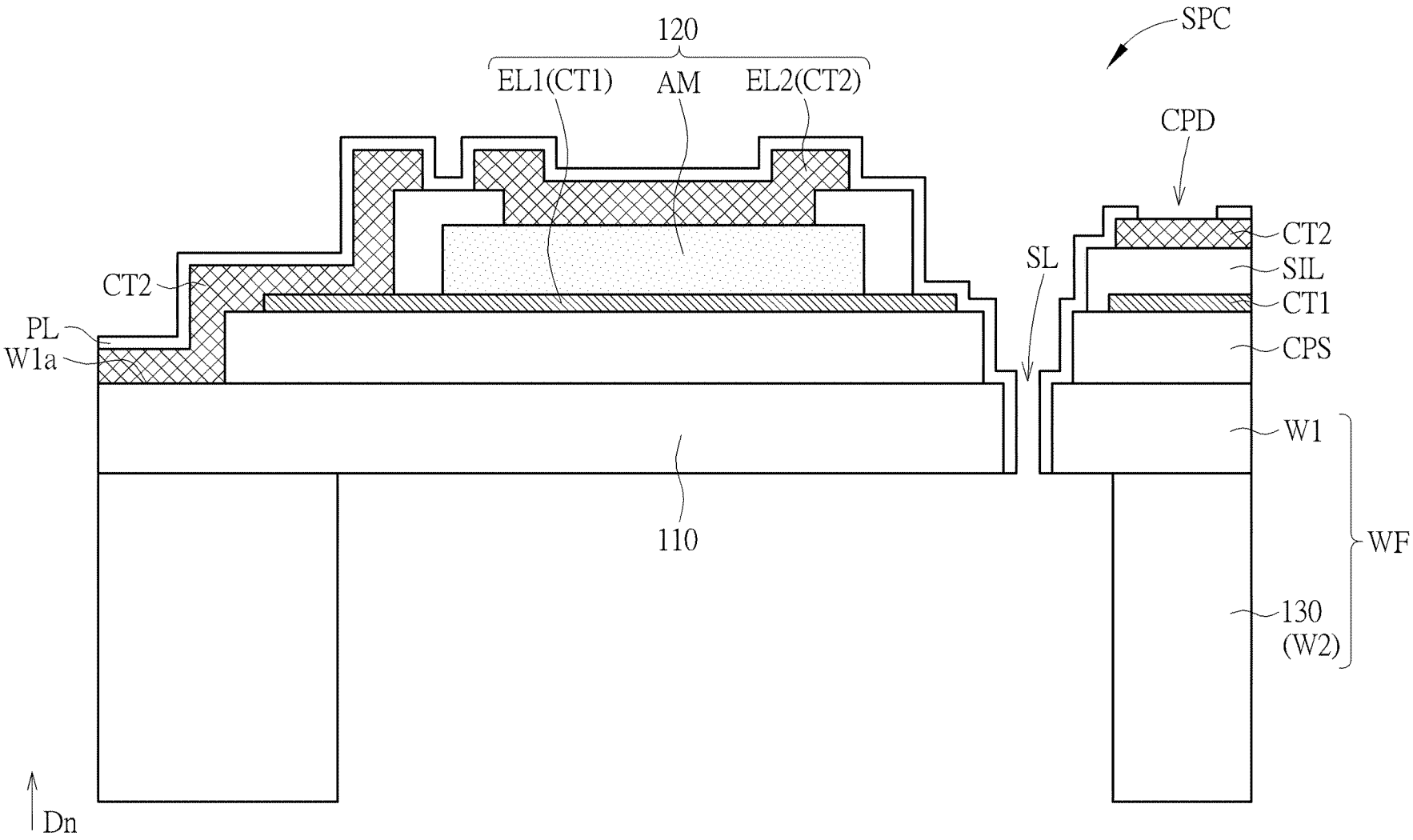
FIG. 25 is a schematic diagram illustrating a cross sectional view of a sound producing chip according to an embodiment of the present invention.
Figure 26:
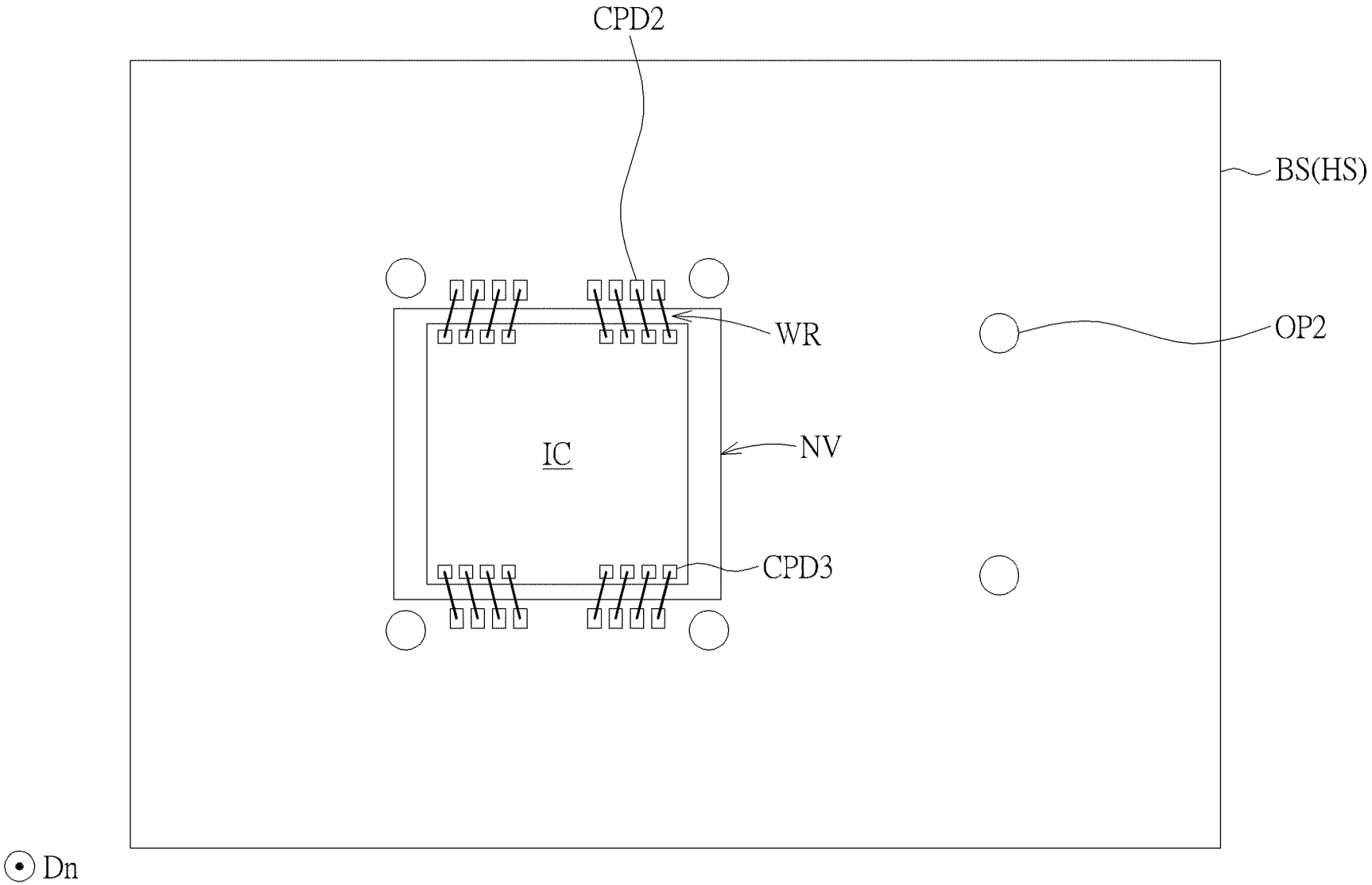
FIG. 26 is a schematic diagram of a top view illustrating a base and an integrated circuit chip of a package structure according to an embodiment of the present invention.

FIG. 25 is a schematic diagram illustrating a cross sectional view of a sound producing chip according to another embodiment of the present invention. In another embodiment, compared with the structure shown in FIG. 24, the structure shown in FIG. 25 does not have the insulating layer W3 of the wafer WF. Namely, the first layer W1 is directly formed on (in contact with) the second layer W2. As the result, the membrane 110 is direct formed of the first layer W1 of the wafer WF owing to patterning the second layer W2 of the wafer WF. In this case, the first layer W1 (i.e., the membrane 110) may include oxide, such as silicon oxide, but not limited thereto.

In the following, the details of a package structure PKG of a sound producing chip SPC will be further exemplarily explained. Note that the package structure PKG is not limited by the following embodiments which are exemplarily provided, and the package structure PKG may have the sound producing chip SPC which is the first type, the second type or any other suitable type.

Figure 27:
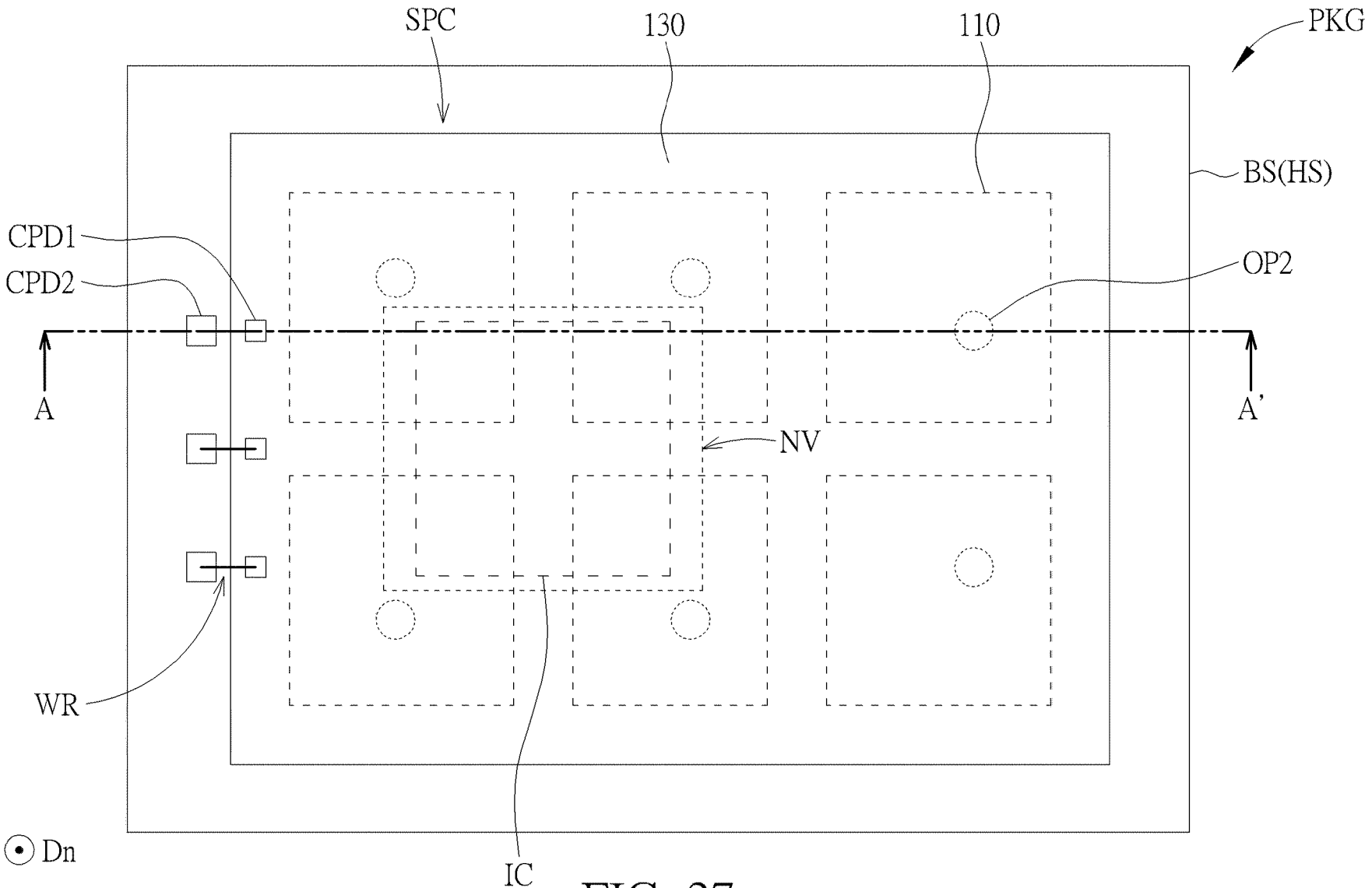
FIG. 27 is a schematic diagram of a top view illustrating a package structure according to an embodiment of the present invention.
Figure 28:
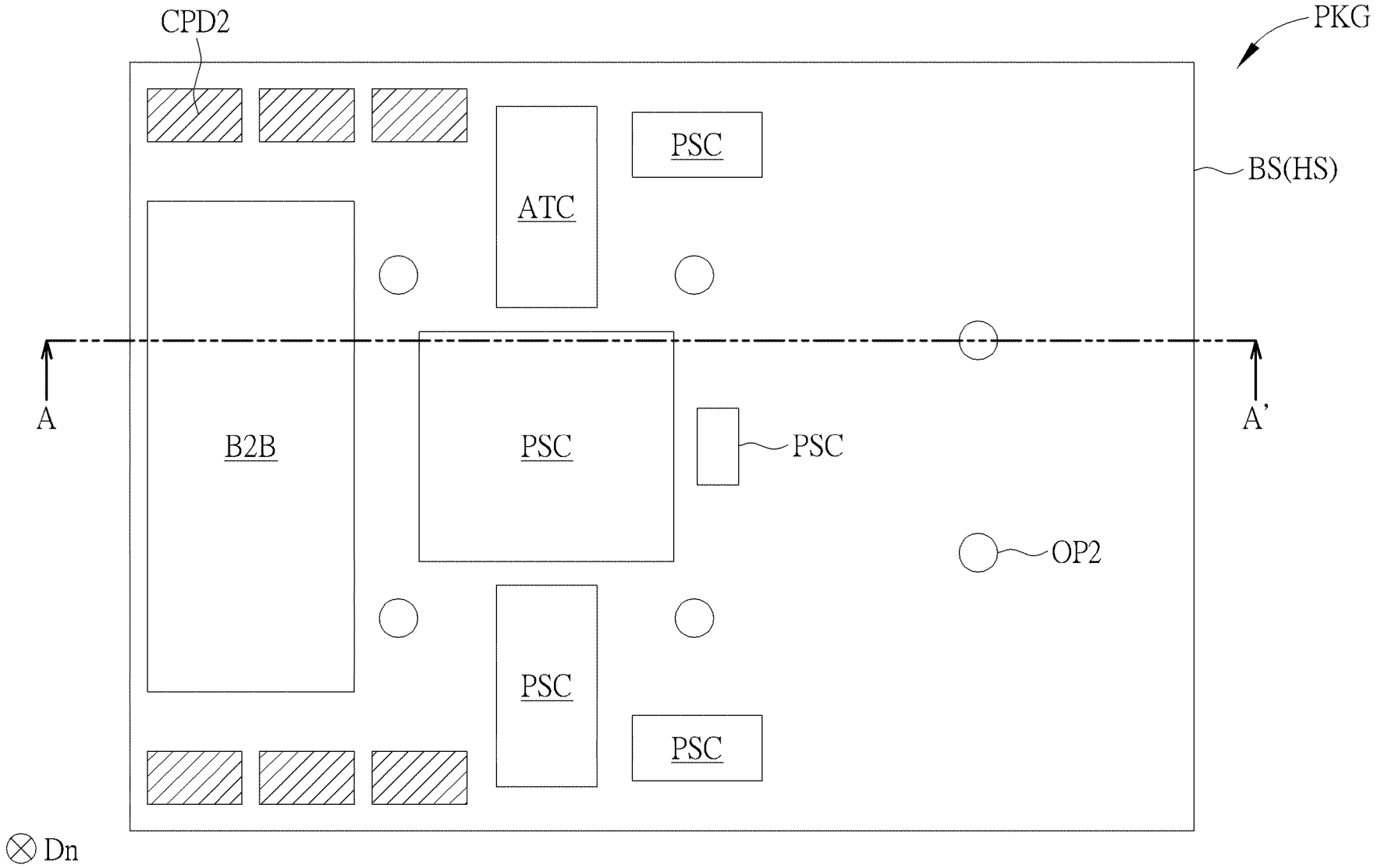
FIG. 28 is a schematic diagram of a bottom view illustrating a package structure according to an embodiment of the present invention.
Figure 29:
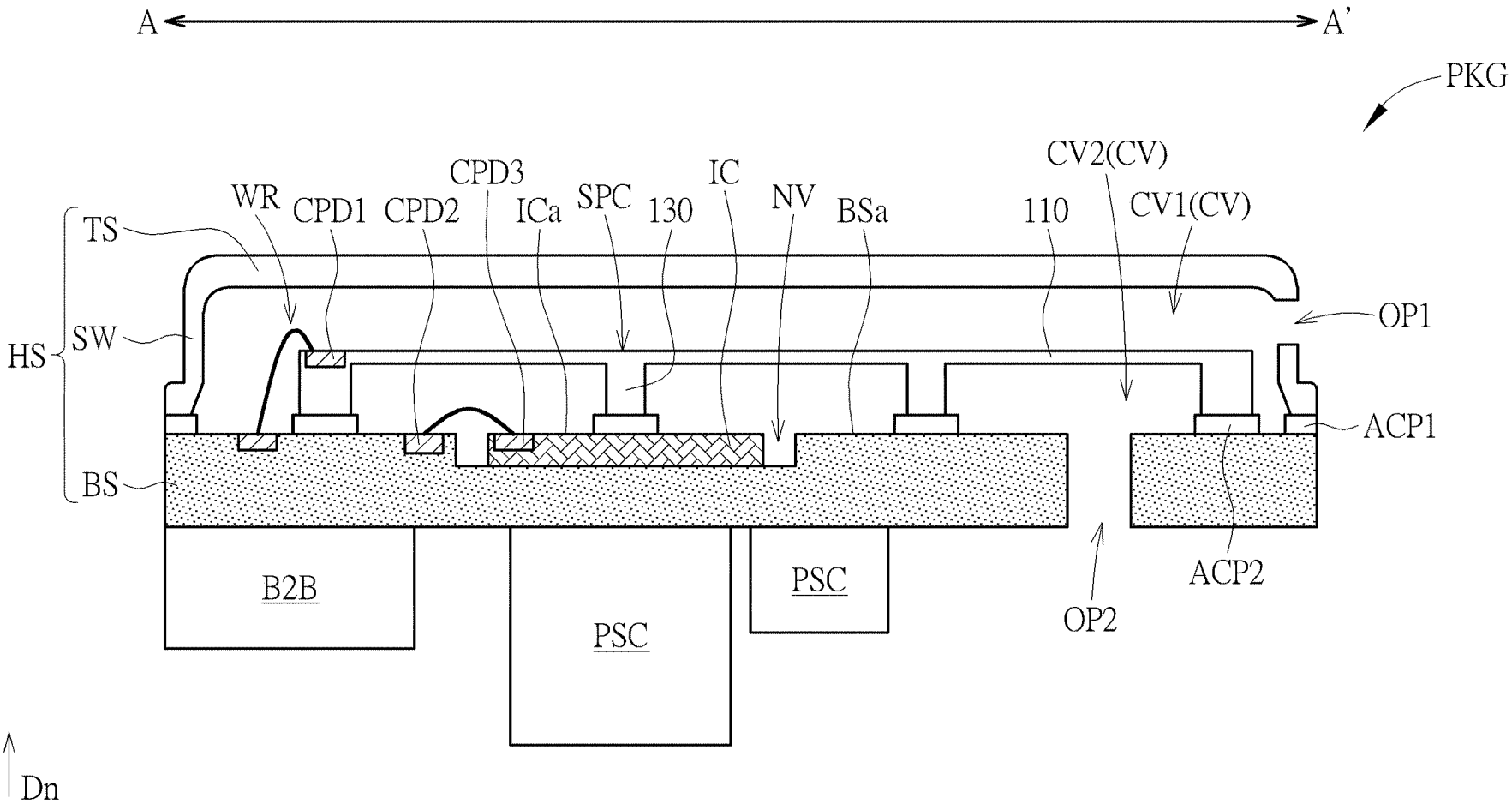
FIG. 29 is a schematic diagram of a cross sectional view taken along a cross-sectional line A-A' in FIG. 27 and FIG. 28.

Referring to FIG. 26 to FIG. 29, FIG. 26 is a schematic diagram of a top view illustrating a base and an integrated circuit chip of a package structure according to an embodiment of the present invention, FIG. 27 is a schematic diagram of a top view illustrating a package structure according to an embodiment of the present invention, FIG. 28 is a schematic diagram of a bottom view illustrating a package structure according to an embodiment of the present invention, and FIG. 29 is a schematic diagram of a cross sectional view taken along a cross-sectional line A-A' in FIG. 27 and FIG. 28. As shown in FIG. 26 to FIG. 29, the package structure PKG of the sound producing chip SPC of the present invention includes a housing HS and an aforementioned sound producing chip SPC disposed within the housing HS, wherein the sound producing chip SPC may have six membranes 110 for example.

The housing HS may include a base BS, a top structure TS and at least one sidewall SW between the base BS and the top structure TS, wherein the base BS and the top structure TS may be substantially parallel to each other. Note that the term "substantially parallel" means that an angle between two components may be less than or equal to 5 degrees, 3 degrees or 1 degree. In this embodiment, the base BS and the top structure TS may be substantially parallel to the membrane 110 of the sound producing chip SPC, and the sidewall(s) SW may surround the sound producing chip SPC.

The base BS, the top structure TS and the sidewall SW may be hard or flexible, and they may include any suitable material. For instance, the base BS, the top structure TS and the sidewall SW may individually include silicon, germanium, glass, plastic, quartz, sapphire, metal, polymer (e.g., PI, PET), any other suitable material or a combination thereof. As an example, in FIG. 26 to FIG. 29, the base BS may be a circuit board including a laminate (e.g. copper clad laminate, CCL), a land grid array (LGA) board or any other suitable board containing conductive material, such that the base BS may include one or more conductive component(s), such as connecting trace(s), active component(s), passive component(s) and/or connecting pad(s), but not limited thereto. As an example, in FIG. 26 to FIG. 29, the top structure TS and the sidewall SW may include metal and form a one-piece structure (e.g., a cap), and the sidewall SW may be connected to the base BS through adhesive component(s) ACP1, but not limited thereto.

As shown in FIG. 29, a cavity CV inside the housing HS may be divided into two sub-cavities (i.e., a first sub-cavity CV1 and a second sub-cavity CV2) by the membrane 110 of the sound producing chip SPC, wherein the membrane 110 is between two sub-cavities. The first sub-cavity CV1 may be between the membrane 110 and the top structure TS, and the second sub-cavity CV2 may be between the membrane 110 and the base BS.

Moreover, in FIG. 29, at least one first opening OP1 and at least one second opening OP2 may be formed on the housing HS, wherein the first opening OP1 may be connected to the first sub-cavity CV1, and the second opening OP2 may be connected to the second sub-cavity CV2. The first opening OP1 and the second opening OP2 may be formed at any suitable position of the housing HS, such as the base BS, the top structure TS and/or the sidewall(s) SW. For example, as shown in FIG. 29, the first opening OP1 may be formed on the sidewall(s) SW, and the second opening OP2 may be formed on the base BS, but not limited thereto.

The number of the first opening(s) OP1, the arrangement of the first opening(s) OP1, the number of the second opening(s) OP2 and the arrangement of the second opening(s) OP2 may be designed based on requirement(s). For instance, in FIG. 26 and FIG. 27, the housing HS may have six the second openings OP2 (the diameter may be such as, but not limited to, 0.3 mm), and each membrane 110 may be corresponding to at least one second opening OP2 (such as corresponding to one second opening OP2), but not limited thereto. The corresponding position of the membrane 110 overlapping the second opening OP2 may be designed based on requirement(s).

The sound producing chip SPC may use any suitable method to be disposed on the base BS. In some embodiments, as shown in FIG. 29, the sound producing chip SPC may be connected to the base BS through at least one adhesive component ACP2, such that the sound producing chip SPC may be fixed on the base BS, but not limited thereto. In this embodiment, at least one adhesive component ACP2 may be between and in contact with the base BS and the sound producing chip SPC, but not limited thereto. Note that the adhesive components ACP1, ACP2 may be conductive or insulating based on requirement(s), and the adhesive components ACP1, ACP2 may include any suitable adhesive material.

The sound producing chip SPC may use any suitable method to be electrically connected to the outer device. For example, in FIG. 27 and FIG. 29, the top of the sound producing chip SPC may have at least one connecting pad CPD1 (e.g., formed of the second conductive layer CT2 shown in FIG. 24 and FIG. 25), the base BS may have at least one connecting pad CPD2, and a conductive wire WR may be connected to the connecting pad CPD1 of the sound producing chip SPC and the connecting pad CPD2 of the base BS, such that the sound producing chip SPC may be electrically connected to the outer device through the conductive wire WR, the connecting pad CPD2 of the base BS and the trace(s) of the base BS, but not limited thereto. In this case, the adhesive component ACP2 may be insulating, but not limited thereto.

For instance, in some embodiments, the connecting pad CPD1 of the sound producing chip SPC may be electrically connected to the connecting pad CPD2 of the base BS through the adhesive component ACP2, wherein the adhesive component ACP2 may be conductive (e.g., the adhesive component ACP2 may be solder). As an example, the connecting pad CPD1 of the sound producing chip SPC may be at the bottom of the sound producing chip SPC, and the connecting pad CPD1 of the sound producing chip SPC may be electrically connected to the actuator 120 through the trace of the sound producing chip SPC (e.g., the trace may be in a through silicon via of the sound producing chip SPC), but not limited thereto. As an example, the connecting pad CPD1 of the sound producing chip SPC may be electrically connected to the connecting pad CPD2 of the base BS by a flip chip package (i.e., the sound producing chip SPC may be disposed upside down), but not limited thereto.

As shown in FIG. 26 to FIG. 29, the package structure PKG may include an integrated circuit chip IC electrically connected to (coupled to) the sound producing chip SPC, wherein the integrated circuit chip IC is configured to generate the driving signal, and the driving signal may be applied on the actuator 120 to actuate the membrane 110.

The position of the integrated circuit chip IC may be adjusted based on requirement(s). As shown in FIG. 26 to FIG. 29, the integrated circuit chip IC and the sound producing chip SPC may be overlapped in the normal direction Dn of the membrane 110, so as to reduce the size of the package structure PKG, but not limited thereto. For example, in FIG. 29, the anchor structure 130 is disposed on the integrated circuit chip IC, and the anchor structure 130 is connected to the integrated circuit chip IC through the adhesive component ACP2 (i.e., the anchor structure 130 may overlap the integrated circuit chip IC), but not limited thereto. In FIG. 29, the integrated circuit chip IC may be between the sound producing chip SPC and the base BS, but not limited thereto.

In particular, as shown in FIG. 26 to FIG. 29, a notch cavity NV is formed on the base BS, and the integrated circuit chip IC is disposed within the notch cavity NV. In this embodiment, the top of the integrated circuit chip IC has a circuit chip surface ICa, the top of the base BS has a base surface BSa corresponding to a part of the base BS surrounding the notch cavity NV (i.e., surrounding the integrated circuit chip IC), and the circuit chip surface ICa is substantially aligned to the base surface BSa. Note that the term "substantially aligned" means that the difference between two components may be less than or equal to a certain threshold. In the embodiment shown in FIG. 29, the certain threshold may be 20 μm, 10 μm, 5 μm, 3 μm or 1 μm. In this case, due to the design of the notch cavity NV where the integrated circuit chip IC is disposed, the sound producing chip SPC may be disposed on the integrated circuit chip IC easily.

The integrated circuit chip IC may use any suitable method to be electrically connected to the conductive component of the base BS, so as to be electrically connected to the sound producing chip SPC. For example, in FIG. 26 and FIG. 29, the top of the integrated circuit chip IC may have at least one connecting pad CPD3, and a conductive wire WR may be connected to the connecting pad CPD3 of the integrated circuit chip IC and the connecting pad CPD2 of the base BS, but not limited thereto. For instance, in some embodiments, the connecting pad CPD3 of the integrated circuit chip IC may be electrically connected to the connecting pad CPD2 of the base BS through the adhesive component (not shown in figures) between the integrated circuit chip IC and the base BS, wherein the adhesive component may be conductive.

The package structure PKG may optionally include at least one passive component PSC and/or at least one active component ATC. The passive component PSC may include resistor, capacitor, inductor, etc. The active component ATC may include transistor, diode, etc. As shown in FIG. 26 to FIG. 29, the sound producing chip SPC may overlap the passive component PSC and the active component ATC in the normal direction Dn of the membrane 110, so as to reduce the size of the package structure PKG, but not limited thereto. For instance, in FIG. 26 to FIG. 29, the integrated circuit chip IC and the passive component PSC may be disposed on opposite sides of the base BS, but not limited thereto.

The package structure PKG may optionally include any other suitable component. For instance, the package structure PKG may further include a board to board connector B2B, but not limited thereto. For instance, the package structure PKG may further include at least one mesh covering the first opening OP1 and/or the second opening OP2, so as to reduce the adverse impact of the dust and/or the liquid on the sound producing chip SPC and/or other structures within the housing HS, but not limited thereto.

The method of forming a package structure PKG may be any suitable forming method. In the forming method of some embodiments, the housing HS may be provided, and the sound producing chip SPC may be manufactured by the aforementioned method. Then, the sound producing chip SPC may be disposed within the housing HS. For example, the sound producing chip SPC is disposed on the base BS before the top structure TS and the sidewall SW are disposed on the base BS, but not limited thereto.

Figure 30:
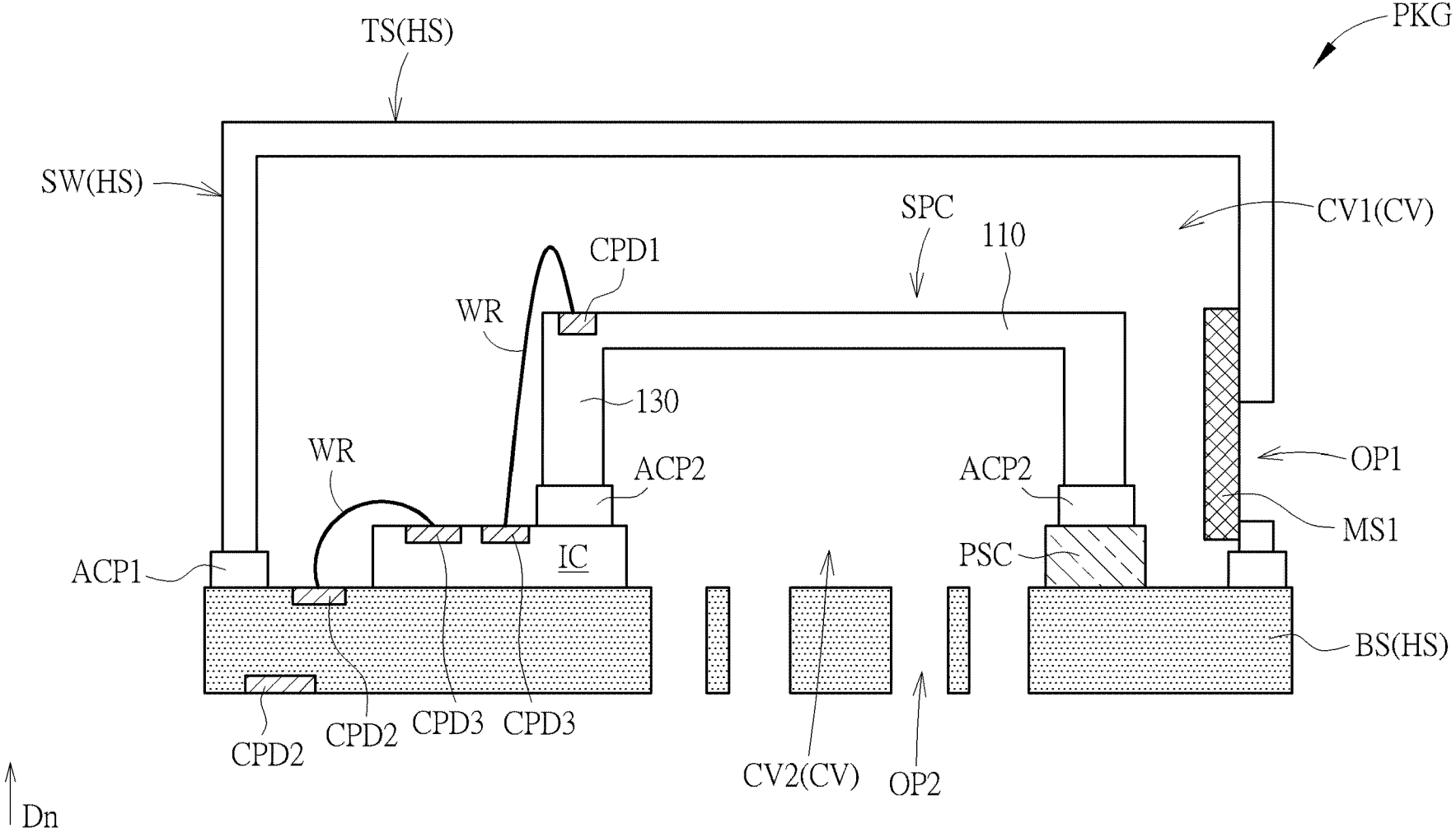
FIG. 30 is a schematic diagram of a cross sectional view illustrating a package structure according to an embodiment of the present invention.

Referring to FIG. 30, FIG. 30 is a schematic diagram of a cross sectional view illustrating a package structure according to an embodiment of the present invention. As shown in FIG. 30, in another package structure PKG, the passive component PSC, the integrated circuit chip IC and the sound producing chip SPC may be disposed on the same side of the base BS, and the anchor structure(s) 130 of the sound producing chip SPC may overlap the passive component PSC and the integrated circuit chip IC. In FIG. 30, the anchor structure(s) 130 of the sound producing chip SPC may be connected to the passive component PSC and the integrated circuit chip IC through the adhesive component ACP2, but not limited thereto.

In addition, as shown in FIG. 30, a conductive wire WR may be electrically connected between the connecting pad CPD1 of the sound producing chip SPC and the connecting pad CPD3 of the integrated circuit chip IC, but not limited thereto.

Moreover, in FIG. 30, the mesh MS1 may cover the first opening OP1, wherein the mesh MS1 may be within the housing HS, but not limited thereto.

Figure 31:
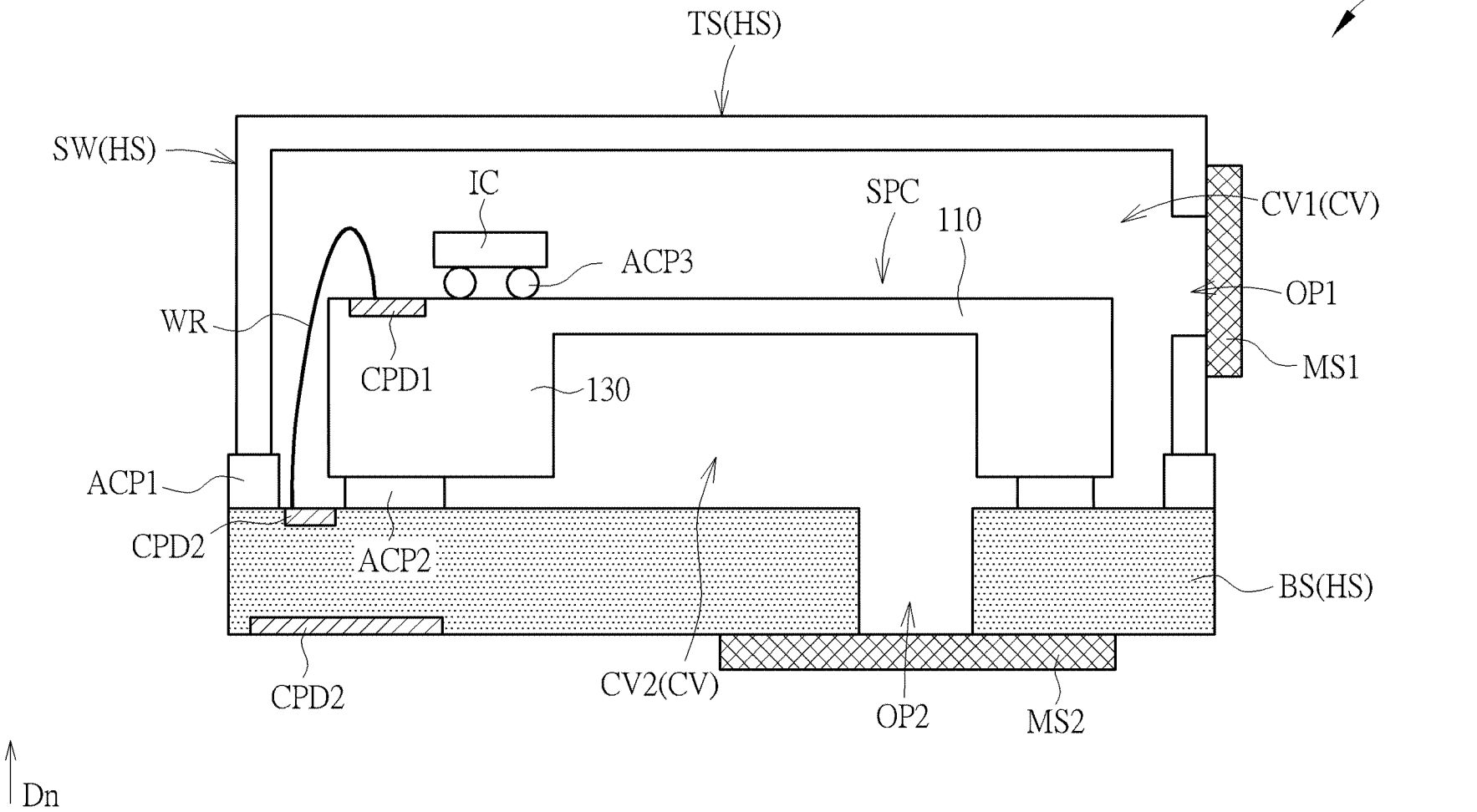
FIG. 31 is a schematic diagram of a cross sectional view illustrating a package structure according to an embodiment of the present invention.

Referring to FIG. 31, FIG. 31 is a schematic diagram of a cross sectional view illustrating a package structure according to an embodiment of the present invention. As shown in FIG. 31, the sound producing chip SPC may overlap the integrated circuit chip IC, and the sound producing chip SPC between the integrated circuit chip IC and the base BS. In addition, in FIG. 31, the integrated circuit chip IC may be electrically connected to the sound producing chip SPC through the adhesive component(s) ACP3 (e.g., the integrated circuit chip IC may be disposed on the sound producing chip SPC by the flip chip package), but not limited thereto.

Moreover, in FIG. 31, the mesh MS1 may cover the first opening OP1, the mesh MS2 may cover the second opening OP2, wherein the meshes MS1 and MS2 may be outside the housing HS, but not limited thereto.

Figure 32:
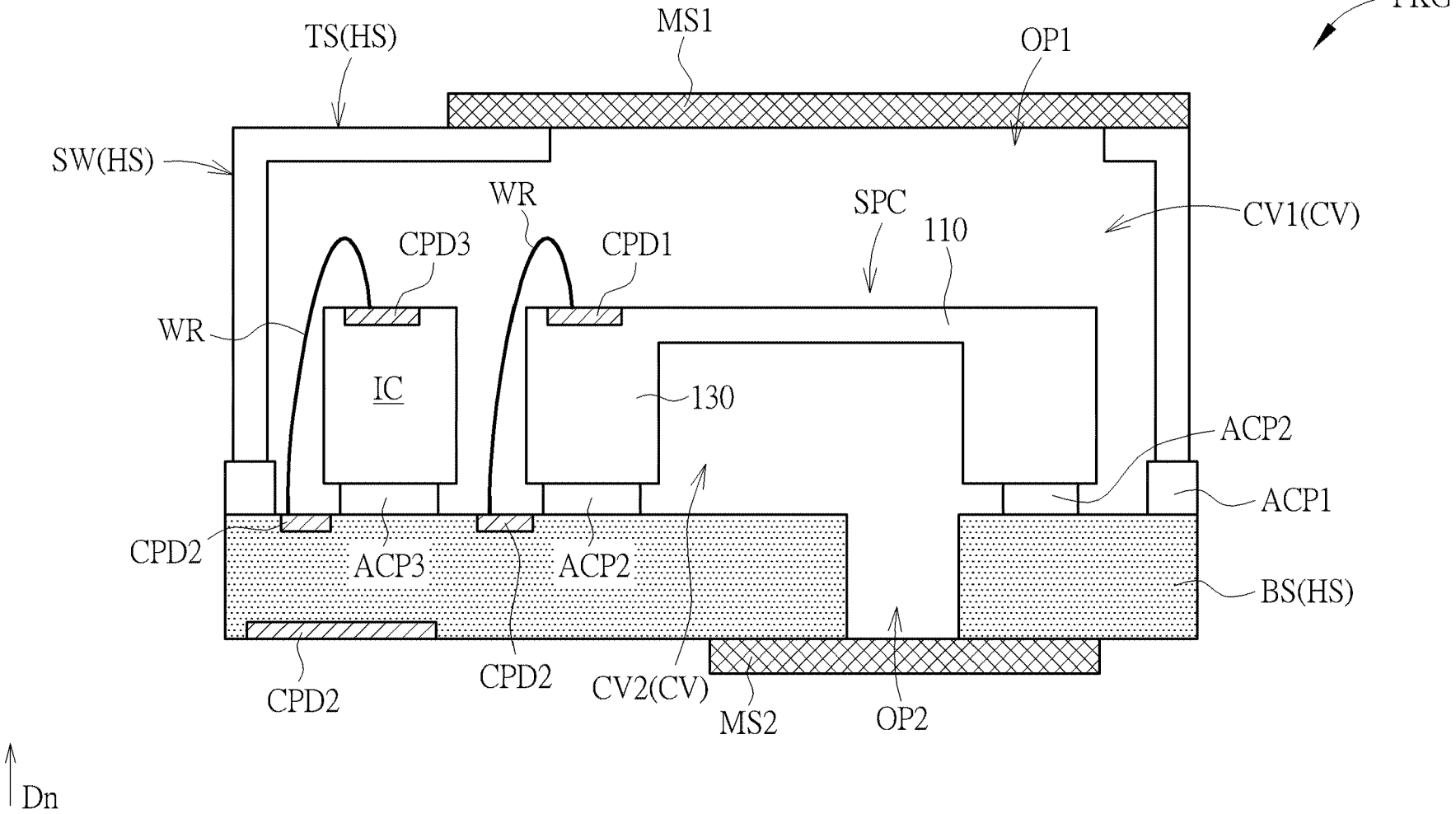
FIG. 32 is a schematic diagram of a cross sectional view illustrating a package structure according to an embodiment of the present invention.

Referring to FIG. 32, FIG. 32 is a schematic diagram of a cross sectional view illustrating a package structure according to an embodiment of the present invention. As shown in FIG. 32, the sound producing chip SPC may not overlap the integrated circuit chip IC, and the sound producing chip SPC and the integrated circuit chip IC may be disposed on the same side of the base BS, but not limited thereto. In FIG. 32, the first opening OP1 may be formed on the top structure TS of the housing HS, but not limited thereto.

In some embodiments (not shown in figures), the sound producing chip SPC may not overlap the integrated circuit chip IC, the sound producing chip SPC and the integrated circuit chip IC may be disposed on the same side of the base BS, and a conductive wire WR may be electrically connected between the connecting pad CPD1 of the sound producing chip SPC and the connecting pad CPD3 of the integrated circuit chip IC, but not limited thereto.

Figure 33:
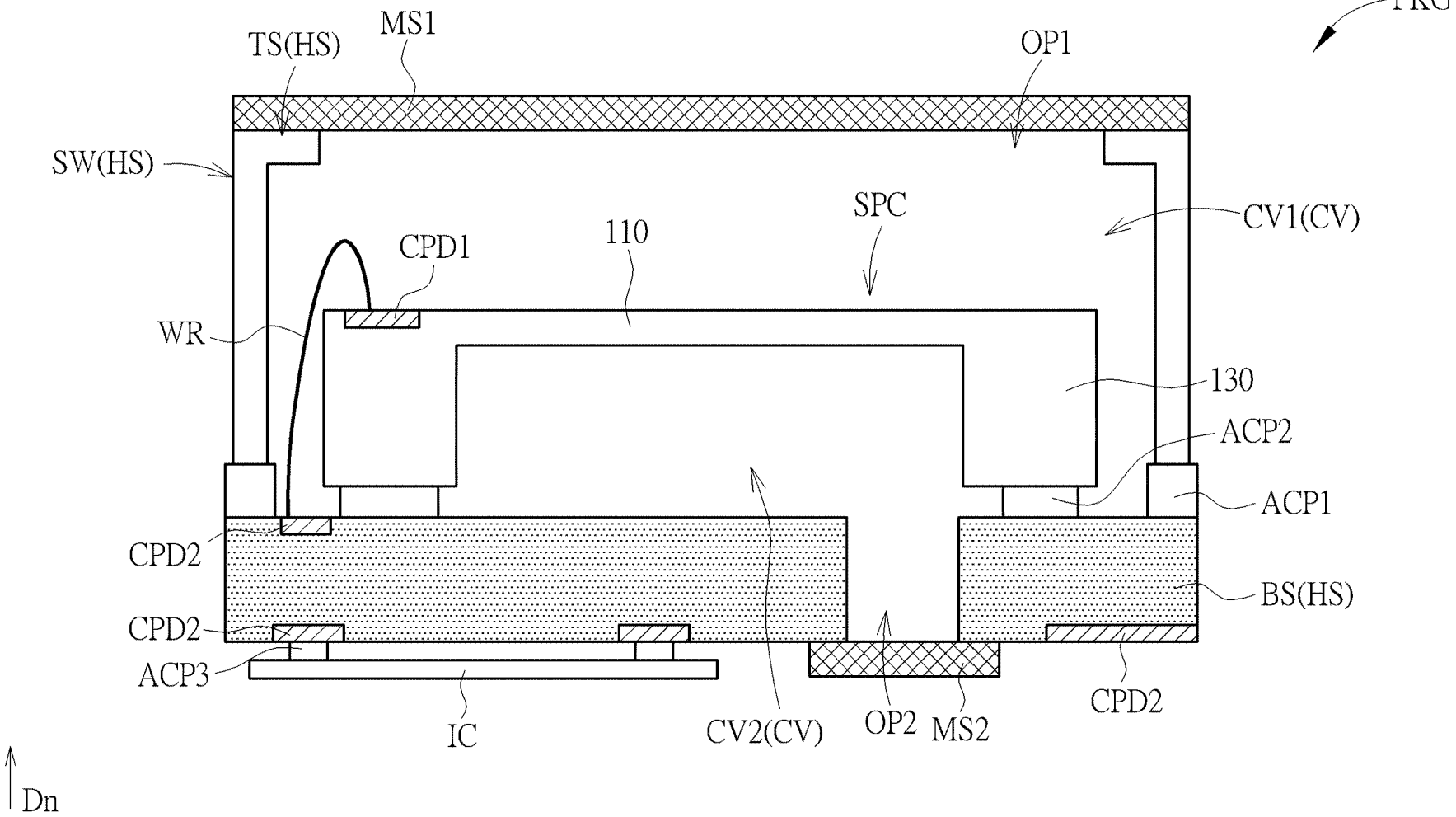
FIG. 33 is a schematic diagram of a cross sectional view illustrating a package structure according to an embodiment of the present invention.

Referring to FIG. 33, FIG. 33 is a schematic diagram of a cross sectional view illustrating a package structure according to an embodiment of the present invention. As shown in FIG. 33, the sound producing chip SPC may overlap the integrated circuit chip IC, and the sound producing chip SPC and the integrated circuit chip IC may be disposed on different sides of the base BS, but not limited thereto. That is to say, the integrated circuit chip IC may be disposed outside the housing HS, but not limited thereto.

Figure 34:
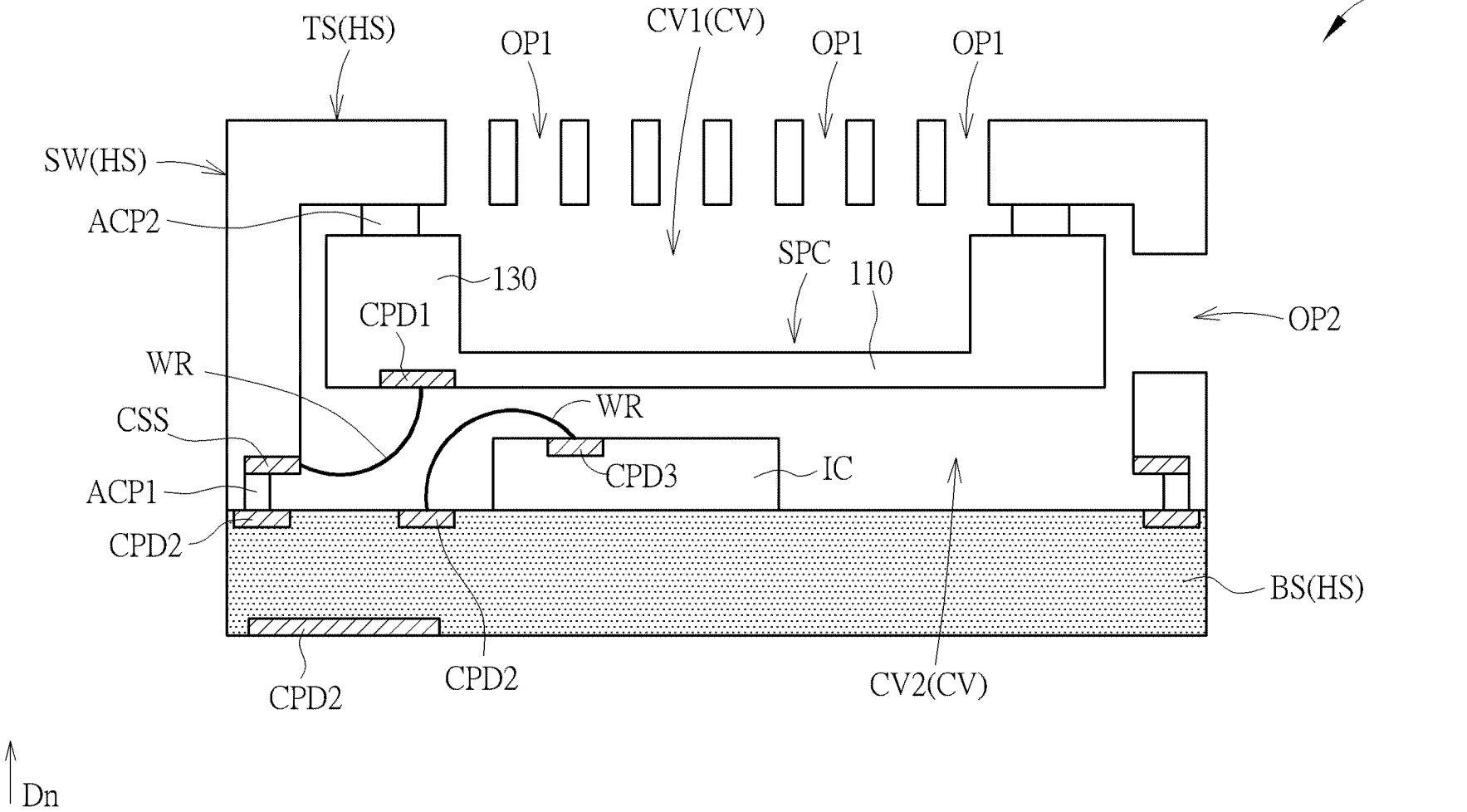
FIG. 34 is a schematic diagram of a cross sectional view illustrating a package structure according to an embodiment of the present invention.

Referring to FIG. 34, FIG. 34 is a schematic diagram of a cross sectional view illustrating a package structure according to an embodiment of the present invention. As shown in FIG. 34, the sound producing chip SPC and the integrated circuit chip IC may be disposed within the housing HS, the sound producing chip SPC may be connected to the top structure TS of the housing HS through the adhesive component ACP2, the integrated circuit chip IC may be connected to the base BS through the adhesive component (not shown in FIG. 34), and the sound producing chip SPC may overlap the integrated circuit chip IC, but not limited thereto.

Optionally, in FIG. 34, the sidewall SW of the housing HS may have a conductive structure CSS electrically connected to the connecting pad CPD2 of the base BS through the conductive adhesive component ACP1, wherein the conductive wire WR is connected between the conductive structure CSS and the connecting pad CPD1 of the sound producing chip SPC for electrical connection, but not limited thereto.

Moreover, in FIG. 34, the first openings OP1 may be formed on the top structure TS of the housing HS, and the second opening OP2 may be formed on the sidewall(s) SW of the housing HS, but not limited thereto.

Figure 35:
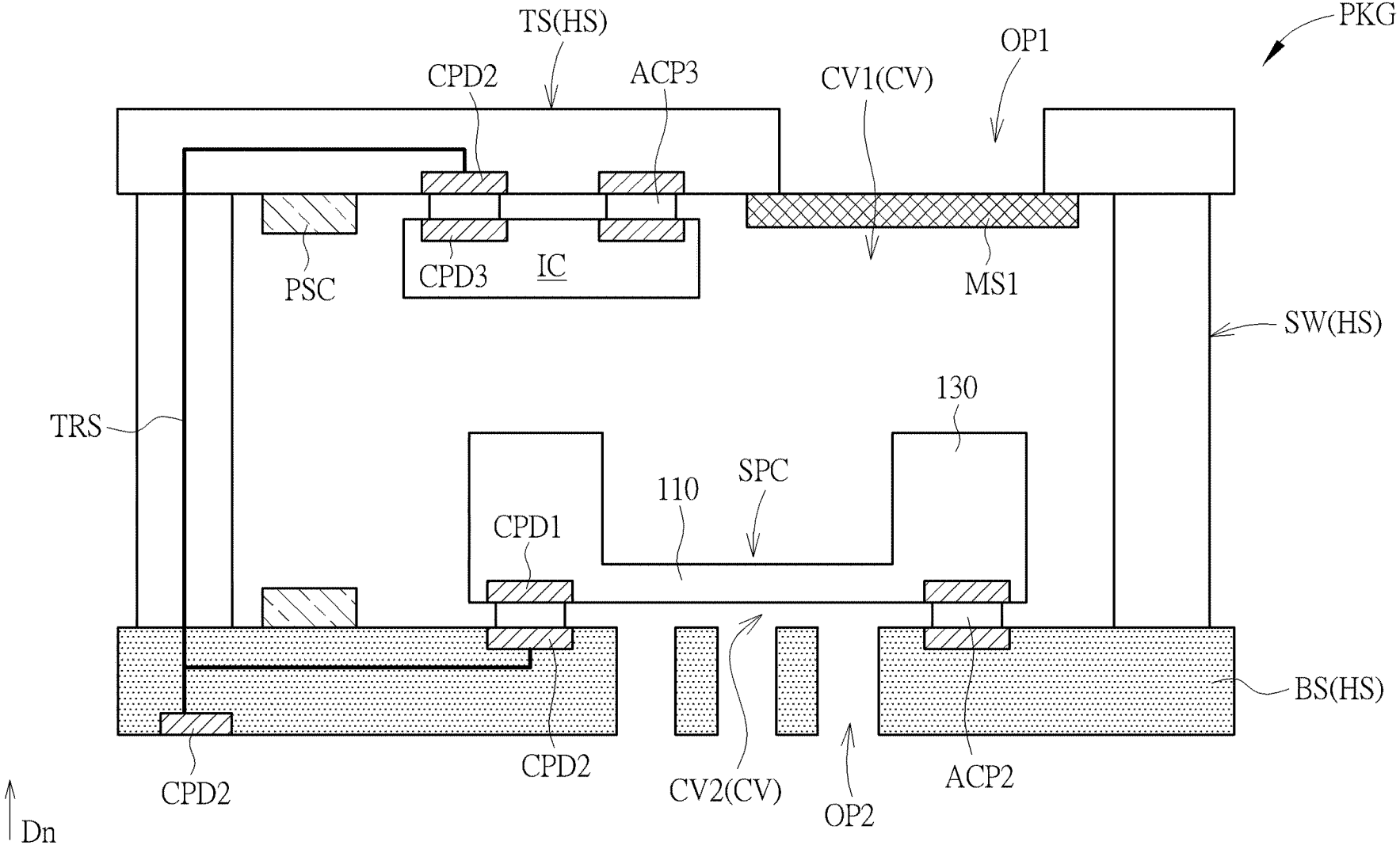
FIG. 35 is a schematic diagram of a cross sectional view illustrating a package structure according to an embodiment of the present invention.

Referring to FIG. 35, FIG. 35 is a schematic diagram of a cross sectional view illustrating a package structure according to an embodiment of the present invention. As shown in FIG. 35, the top structure TS and the sidewall SW of the housing HS do not form a one-piece structure, wherein the sidewall SW may be connected to the top structure TS and the base BS by an adhesive component (the adhesive component may be conductive or insulating). For example, the top structure TS, the sidewall SW and the base BS may be circuit boards, such that the electronic component (e.g., the integrated circuit chip IC) connected to the top structure TS may be electrically connected to the electronic component (e.g., the sound producing chip SPC) connected to the base BS through a connecting trace TRS in the sidewall SW, but not limited thereto.

In addition, in FIG. 35, the sound producing chip SPC may be disposed on the base BS by the flip chip package, and the integrated circuit chip IC may be disposed on the top structure TS by the flip chip package, but not limited thereto.

Moreover, in FIG. 35, the passive components PSC may be disposed within the housing HS, and the passive components PSC may be respectively connected to the top structure TS and the base BS, but not limited thereto.

In the following, the details of a sound producing apparatus APT having the aforementioned sound producing chip SPC will be further exemplarily explained. Note that the sound producing apparatus APT is not limited by the following embodiments which are exemplarily provided, and the sound producing chip SPC included in the sound producing apparatus APT may be the first type, the second type or any other suitable type. Note that the package structure PKG of the sound producing chip SPC may be one of the aforementioned embodiments or a combination of aforementioned embodiments.

Figure 36:
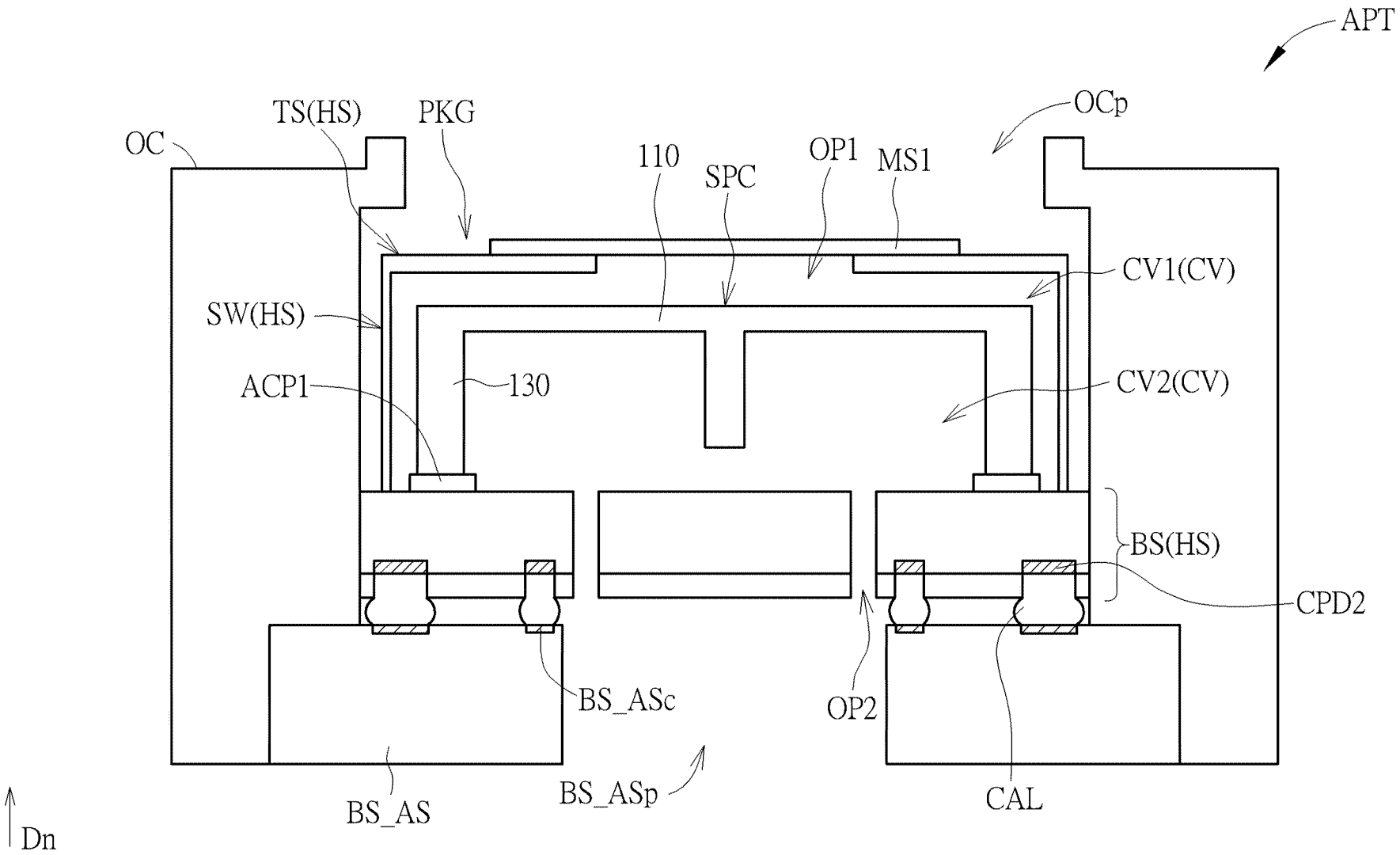
FIG. 36 is a schematic diagram of a cross sectional view illustrating a sound producing apparatus according to an embodiment of the present invention.

Referring to FIG. 36, FIG. 36 is a schematic diagram of a cross sectional view illustrating a sound producing apparatus according to an embodiment of the present invention. As shown in FIG. 36, the sound producing apparatus APT may include an outer casing OC, a package structure PKG of a sound producing chip SPC and an apparatus base BS_AS, wherein the package structure PKG may be disposed on the apparatus base BS_AS and inside the outer casing OC.

The apparatus base BS_AS may include silicon, germanium, glass, plastic, quartz, sapphire, metal, polymer (e.g., PI, PET), any other suitable material or a combination thereof. As an example, in FIG. 36, the apparatus base BS_AS may be a circuit board including a laminate (e.g. copper clad laminate, CCL), a land grid array (LGA) board or any other suitable board containing conductive material, such that the apparatus base BS_AS may include one or more conductive component(s), such as connecting trace(s), active component(s), passive component(s) and/or connecting pad(s), but not limited thereto.

As shown in FIG. 36, the apparatus base BS_AS may have at least one apparatus-base opening BS_ASp, and the second sub-cavity CV2 of the package structure PKG may be connected to the apparatus-base opening BS_ASp of the apparatus base BS_AS through the second opening OP2 of the package structure PKG. That is to say, the second sub-cavity CV2 of the package structure PKG may be connected to an ambient environment back of the sound producing apparatus APT through the second opening OP2 and the apparatus-base opening BS_ASp.

As shown in FIG. 36, the outer casing OC may have at least one outlet opening OCp, and the first sub-cavity CV1 of the package structure PKG may be connected to an ambient environment in front of the sound producing apparatus APT through the first opening OP1 of the package structure PKG and the outlet opening OCp of the outer casing OC.

Optionally, the outer casing OC of this embodiment may clamp the apparatus base BS_AS and the package structure PKG (e.g., the outer casing OC may be in contact with the sidewall(s) of the apparatus base BS_AS and the sidewall(s) SW of the package structure PKG), so as to further fix the apparatus base BS_AS and the package structure PKG, and to separate the first sub-cavity CV1 and the second sub-cavity CV2 from each other in the sound producing apparatus APT, but not limited thereto. Optionally, a gasket may be further included in the sound producing apparatus APT, wherein the gasket may be disposed between the package structure PKG and the outer casing OC, and the gasket may surround the outlet opening(s) OCp, but not limited thereto.

In FIG. 36, the package structure PKG may be assembled into the sound producing apparatus APT via a surface mount technology, wherein a conductive adhesive layer CAL (e.g., including solder) is disposed between the apparatus base BS_AS and the base BS of the package structure PKG by the surface mount technology, so as to make the package structure PKG be disposed on the apparatus-base BS_AS.

In the present invention, since the surface mount technology is performed, the package structure PKG may need to be designed for being capable of tolerating a highest process temperature of the surface mount technology. As the result, the package structure PKG has a heat resistant temperature which has an upper bound higher than the highest process temperature of the surface mount technology, such that the breakdown of the package structure PKG would not occur and the package structure PKG would maintain its normal operation (i.e., the sound wave can be generated normally) after performing the surface mount technology. In some embodiments, the highest process temperature of the surface mount technology may range from 240° C. to 250° C., and therefore, the upper bound of the heat resistant temperature of the package structure PKG may be higher than 240° C. or higher than 250° C., but not limited thereto. Moreover, in some embodiments, each material contained in the package structure PKG has a heat resistant temperature which has an upper bound higher than the highest process temperature of the surface mount technology, so as to ensure that the package structure PKG would not be damaged during surface mounting technology. For example, each material contained in the package structure PKG has the heat resistant temperature which has the upper bound higher than 240° C. or higher than 250° C., but not limited thereto.

The surface mount technology will be described in the following, and the following surface mount technology is an example, and some steps are omits for making the description of the surface mount technology clear.

In the process of the surface mount technology, the apparatus base BS_AS having at least one conductive pad BS_ASc, at least one conductive trace and the apparatus-base opening BS_ASp may be provided firstly, wherein the conductive pad BS_ASc and the apparatus-base opening BS_ASp may be formed before performing the surface mount technology. Then, the conductive adhesive layer CAL is disposed on conductive pad BS_ASc of the apparatus base BS_AS. For example, the conductive adhesive layer CAL may be printed on the apparatus base BS_AS, but not limited thereto. Next, the electronic component such as the package structure PKG of the sound producing chip SPC is put on and in contact with the conductive adhesive layer CAL, wherein the connecting pad CPD2 of the package structure PKG is in contact with the conductive adhesive layer CAL. Then, a temperature increasing step (e.g., a reflow step) is performed to make the process temperature increase, such that the conductive adhesive layer CAL melt to adhere to the conductive pad BS_ASc of the apparatus base BS_AS and the connecting pad CPD2 of the package structure PKG. As the result, by using the surface mount technology, the package structure PKG is disposed on the apparatus base BS_AS and electrically connected to the conductive pad BS_ASc through the conductive adhesive layer CAL.

In conventional speakers or conventional sound producing devices, since some components (such as a rubber suspension and/or an adhesive material adhere to a coil) cannot tolerate the highest process temperature of the surface mount technology, the surface mount technology cannot be used in the conventional speakers (or conventional sound producing devices). In comparison, in the present invention, since the package structure PKG is designed to be capable of tolerating the highest process temperature of the surface mount technology, the breakdown of the package structure PKG would not occur and the package structure PKG can normally operate after performing the surface mount technology. Moreover, since the surface mount technology is applied in the present invention, there is no need to perform a wire bonding method/process (a method/process using a conductive wire for being electrically connected between the electronic component and the apparatus base BS_AS), such that the lateral size of the sound producing apparatus APT may be reduced significantly.

The method of forming the sound producing apparatus APT may be any suitable forming method. In the method of forming the sound producing apparatus APT of some embodiments, the package structure PKG may be formed by the aforementioned method. Then, the package structure PKG may be assembled into the sound producing apparatus APT via the surface mount technology. For example, the package structure PKG is disposed on the apparatus base BS_AS of the sound producing apparatus APT through the surface mount technology.

In summary, the present invention provides the sound producing device of which the first resonance frequency $f_R$ of the membrane is higher than the maximum frequency $f_{max}$ of the input audio band, so as to be capable of enhancing sound quality. Moreover, the package structure of the sound producing chip, the sound producing apparatus, the method of manufacturing the sound producing chip, the method of forming the package structure and the method of forming the sound producing apparatus are further provided in the present invention.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A package structure, comprising:

a housing; and a sound producing chip disposed within the housing, the sound producing chip comprising:

a membrane comprising a coupling plate and a spring structure connected to the coupling plate; and an actuator configured to receive a driving signal corresponding to an input audio signal to actuate the membrane, wherein the input audio signal and the driving signal have an input audio band which has an upper bound at a maximum frequency;

wherein the spring structure is situated between the coupling plate and the actuator;

wherein the coupling plate is actuated to move by the actuator via the spring structure;

wherein the membrane has a first resonance frequency higher than the maximum frequency.

2. The package structure of claim 1, wherein a first opening is formed on the housing, the housing comprises a top structure and a sidewall, the top structure is substantially parallel to the membrane, and the first opening is formed on the top structure.

3. The package structure of claim 1, wherein a first opening is formed on the housing, the housing comprises a top structure and a sidewall, and the first opening is formed on the sidewall.

4. The package structure of claim 1, wherein the housing comprises a base, and a second opening is formed on the base.

5. The package structure of claim 1, further comprising an integrated circuit chip coupled to the sound producing chip, wherein the integrated circuit chip is configured to generate the driving signal.

6. The package structure of claim 5, wherein the integrated circuit chip and the sound producing chip are overlapped in a normal direction of the membrane.

7. The package structure of claim 5, wherein the sound producing chip comprises an anchor structure, and the anchor structure is disposed on the integrated circuit chip.

8. The package structure of claim 5, wherein the housing comprises a base, a notch cavity is formed on the base, and the integrated circuit chip is disposed within the notch cavity.

9. The package structure of claim 8, wherein a circuit chip surface of the integrated circuit chip is substantially aligned to a base surface corresponding to a part of the base surrounding the integrated circuit chip.

10. The package structure of claim 5, further comprising a passive component.

11. The package structure of claim 10, wherein the housing comprises a base, the integrated circuit chip and the passive component are disposed on opposite sides of the base.

12. The package structure of claim 1, wherein the package structure is assembled into a sound producing apparatus via a surface mount technology.

13. A method of manufacturing a sound producing chip, comprising:

providing a wafer, wherein the wafer comprises a first layer and a second layer;

forming and patterning an actuating material on a first side of the wafer;

patterning the first layer of the wafer, so as to form a trench line; and removing a first part of the second layer of the wafer;

wherein a second part of the second layer forms at least one anchor structure, and the patterned first layer forms a membrane anchored by the at least one anchor structure;

wherein a slit is formed within and penetrates through the membrane because of the trench line;

wherein the membrane comprises a coupling plate and a spring structure connected to the coupling plate, and the spring structure is formed because of the slit;

wherein the spring structure is situated between the coupling plate and an actuator including the actuating material;

wherein the actuator is configured to receive a driving signal corresponding to an input audio signal to actuate the membrane, wherein the input audio signal and the driving signal have an input audio band which has an upper bound at a maximum frequency;

wherein the coupling plate is actuated to move by the actuator via the spring structure;

wherein the membrane has a first resonance frequency higher than the maximum frequency.

14. The method of claim 13, wherein an insulating layer is formed between the first layer and the second layer within the wafer, and the manufacturing method comprises:

removing a part of the insulating layer, such that the slit penetrates through the membrane.

15. The method of claim 13, wherein the first layer comprises single crystalline silicon, and the wafer is a silicon on insulator wafer.

16. The method of claim 13, wherein the first layer comprises poly-crystalline silicon, and the wafer is a poly-silicon on insulator wafer.

17. The method of claim 13, wherein the first layer is directly formed on the second layer.

18. The method of claim 17, wherein the first layer comprises oxide.

19. The method of claim 18, wherein the first layer comprises silicon oxide.

20. The method of claim 13, comprising:

forming and patterning a first conductive layer between the actuating material and the first layer of the wafer;

wherein the patterned first conductive layer functions as a first electrode for the actuator.

21. The method of claim 13, comprising:

forming and patterning a second conductive layer on the actuating material;

wherein the patterned second conductive layer functions as a second electrode for the actuator.

22. The method of claim 21, comprising:

forming a protection layer covering the second conductive layer.

23. The method of claim 22, wherein the protection layer is formed within the slit.

24. The method of claim 13, wherein the actuating material comprises a piezoelectric material.

25. The method of claim 24, wherein the piezoelectric material comprises a lead-zirconate-titanate material.

26. A method of forming a package structure, comprising:

providing a housing;

manufacturing a sound producing chip by a method according to claim 13; and disposing the sound producing chip within the housing.

27. A method of forming a sound producing apparatus, comprising:

forming a package structure by a method according to claim 26; and assembling the package structure into the sound producing apparatus via a surface mount technology.

* * * * *